US005411157A

United States Patent [19]

King et al.

[11] Patent Number: 5,411,157

[45] Date of Patent: May 2, 1995

[54] CONTAINER AND THE MANUFACTURE THEREOF

[75] Inventors: Roger M. King; Witney M. King, both of Bucks, United Kingdom

[73] Assignee: Beeson and Sons Limited, United Kingdom

[21] Appl. No.: 956,033

[22] Filed: Oct. 2, 1992

Related U.S. Application Data

[63] Continuation-in-part of Ser. No. 706,891, May 29, 1991, Pat. No. 5,213,225, and a continuation-in-part of Ser. No. 769,198, Sep. 30, 1991, abandoned, and a continuation-in-part of Ser. No. 796,946, Nov. 22, 1991, abandoned, and a continuation-in-part of Ser. No. 835,290, Feb. 13, 1992, Pat. No. 5,219,084.

[30] Foreign Application Priority Data

| | | | |
|---|---|---|---|
| May 30, 1990 | [GB] | United Kingdom | 9012041 |
| Jul. 10, 1991 | [GB] | United Kingdom | 9114871 |
| Sep. 23, 1991 | [GB] | United Kingdom | 9120264 |
| Oct. 17, 1991 | [GB] | United Kingdom | 9122097 |
| Nov. 22, 1991 | [GB] | United Kingdom | 9124872 |
| Nov. 29, 1991 | [GB] | United Kingdom | 9125397 |
| Dec. 11, 1991 | [GB] | United Kingdom | 9126242 |
| Jan. 24, 1992 | [GB] | United Kingdom | 9201494 |
| Apr. 30, 1992 | [GB] | United Kingdom | 9209299 |
| Apr. 30, 1992 | [GB] | United Kingdom | 9209374 |
| Apr. 30, 1992 | [GB] | United Kingdom | 9209420 |
| May 12, 1992 | [GB] | United Kingdom | 9210194 |
| Jul. 10, 1992 | [GB] | United Kingdom | PCT/GB92/01255 |

[51] Int. Cl.[6] ..... B65D 41/04

[52] U.S. Cl. ..... 215/330; 215/216; 215/305; 215/321; 215/346; 215/353

[58] Field of Search ..... 215/305, 316, 329, 330, 215/339, 341, 346, 353, 216, 317, 321

[56] References Cited

U.S. PATENT DOCUMENTS

| | | |
|---|---|---|
| D. 20,377 | 12/1890 | Meinecke . |
| D. 93,690 | 10/1934 | Steelman . |
| D. 207,887 | 6/1967 | Parsisson . |
| D. 217,543 | 5/1970 | Pomodoro . |
| D. 277,459 | 2/1985 | Baum et al. . |

(List continued on next page.)

FOREIGN PATENT DOCUMENTS

| | | |
|---|---|---|
| 117948 | 9/1984 | European Pat. Off. . |
| 0148527 | 7/1985 | European Pat. Off. . |
| 1052164 | 2/1988 | European Pat. Off. . |
| 724431 | 4/1932 | France . |
| 2036272 | 12/1970 | France . |
| 2558443 | 7/1985 | France . |
| 3605963 | 5/1986 | France . |
| 0179706 | 8/1987 | Germany . |
| 6707565 | 2/1968 | Netherlands . |
| 261370 | 5/1927 | United Kingdom . |
| 1582111 | 12/1980 | United Kingdom . |
| 2094274 | 9/1982 | United Kingdom . |
| 2100236 | 12/1982 | United Kingdom . |
| 2134873 | 8/1984 | United Kingdom . |
| 2142911 | 1/1985 | United Kingdom . |
| 2159801 | 12/1985 | United Kingdom . |
| 2163732 | 3/1986 | United Kingdom . |
| WO9004546 | 2/1989 | United Kingdom . |
| 2558443 | 5/1990 | WIPO . |

OTHER PUBLICATIONS

U.S. Patent Application Serial No. 07/878,872 filed May 4, 1992 by Roger M. King.

U.S. Patent Application Serial No. 07/956,039 filed Oct. 2, 1992 filed by King et al.

U.S. Application Serial No. 08/053,179 filed Apr. 26, 1993 by Roger M. King.

U.S. Patent Application Serial No. 08/066,546 filed May 24, 1993 by King et al.

U.S. Patent Application Serial No. 08/121,970 filed Sep. 15, 1993 by Roger M. King.

*Primary Examiner*—Allan N. Shoap

*Assistant Examiner*—Kanessa Caretto

*Attorney, Agent, or Firm*—Willian Brinks Hofer Gilson & Lione

[57] ABSTRACT

A container closure assembly having a container neck and a closure for said container neck. The closure is retained on the container neck by a screw thread on at least one of the closure and the container neck. A sealing mechanism is provided for forming a seal between the closure and the container neck when the closure is at a sealing position on the container neck. Furthermore, there is an urging mechanism co-operating between the closure and the container neck when the closure is near the sealing position to urge the closure into the sealing position independently of whether an external closing torque is being applied to the closure, and thereafter the urging mechanism maintains the closure in the sealing position until a sufficient external release force is applied to the closure.

20 Claims, 26 Drawing Sheets

U.S. PATENT DOCUMENTS

D. 311,328 10/1990 van der Tang .
D. 312,043 11/1990 van der Tang .
D. 327,644 7/1992 Offley et al. .
D. 329,980 10/1992 Powell et al. .
198,528 12/1877 Woodward .
1,070,748 8/1913 Stollberg .
1,850,911 3/1932 Barlow .
2,026,889 1/1936 Gray et. .
2,313,161 3/1943 Merolle .
2,423,582 7/1947 Coleman .
2,646,183 7/1953 Pellett .
3,253,728 5/1966 Putron .
3,347,403 10/1967 Lehrman .
3,651,972 3/1972 Itoh ..... 215/321 X
3,737,064 6/1973 Patel et al. .
3,741,421 6/1973 Wittwer .
3,767,076 10/1973 Kennedy .
3,770,153 11/1973 Gach et al. .
3,826,395 7/1974 Montgomery .
3,827,592 8/1974 Deussen .
3,831,797 8/1974 Stevens, Jr. .
3,841,514 10/1974 Montgomery .
3,861,549 1/1975 Watson et al. .
3,894,647 7/1975 Montgomery .
3,917,097 11/1975 Uhlig .
3,917,100 11/1975 Dukess .
3,924,769 12/1975 Fillmore .
3,941,268 3/1976 Owens et al. .
3,944,101 3/1976 Landen .
3,944,102 3/1976 Grau .
3,952,899 4/1976 Cooke .
3,958,708 5/1976 Le Brun, Jr. .
3,984,021 10/1976 Uhlig .
3,993,209 11/1976 Julian .
4,034,886 7/1977 Galer ..... 220/288
4,037,746 7/1977 Ver Hage .
4,076,152 2/1978 Mumford .
4,084,717 4/1978 King .
4,093,096 6/1978 Augros .
4,134,513 1/1979 Mumford ..... 215/216
4,138,028 2/1979 Price et al. .
4,147,268 4/1979 Patel et al. .
4,157,144 6/1979 Weiler et al. .
4,177,906 12/1979 Von Hagel .
4,213,534 7/1980 Montgomery .
4,273,248 6/1981 Lehmann .
4,278,178 7/1981 Geiser .
4,280,631 7/1981 Lohrman .
4,289,248 9/1981 Lynn .
4,298,132 11/1981 Galer ..... 220/288
4,310,101 1/1982 Sekine .
4,328,905 5/1982 Hardt .
4,335,824 6/1982 Bush .
4,351,443 9/1982 Uhlig ..... 215/216
4,371,091 2/1983 Gelina .
4,376,497 3/1983 Mumford .
4,383,618 5/1983 Dougherty .
4,386,712 6/1983 De Wallace ..... 215/211
4,387,817 6/1983 Wiles .
4,387,822 6/1983 Lynn .
4,399,926 8/1983 Eidels-Dubovoy ..... 220/288
4,413,743 11/1983 Summers ..... 215/216
4,469,235 9/1984 Parker .
4,480,760 11/1984 Schonberger .
4,489,844 12/1984 Breskin .
4,493,427 1/1985 Wolkonsky .
4,494,665 1/1985 Lehmann .
4,527,701 7/1985 Schaubeck .
4,562,931 1/1986 Brach et al. .
4,579,240 4/1986 Ou-Yang .
4,596,338 6/1986 Yousif .
4,605,136 8/1986 Debetencourt .
4,658,977 4/1987 Crisci ..... 215/256
4,662,530 5/1987 Goncalves et al. .
4,669,624 6/1987 Wiles et al. .
4,731,512 3/1988 Barriac .
4,746,026 5/1988 Leonhardt .
4,754,892 7/1988 Retief .
4,767,016 8/1988 Cook, Jr. et al. .
4,770,308 9/1988 Lynn .
4,782,965 11/1988 Wassilieff .
4,840,281 6/1989 Phillips et al. .
4,856,674 8/1989 Berney .
4,913,299 4/1990 Petro ..... 215/330
4,934,544 6/1990 Han et al. .
4,934,547 6/1990 Mayes et al. .
4,954,191 9/1990 Delespaul et al. .
4,957,210 9/1990 Kusz .
4,960,216 10/1990 Giles et al. .
4,991,733 2/1991 Marino ..... 215/330
5,020,681 6/1991 Kusz .
5,020,683 6/1991 Strassheimer .
5,050,754 9/1991 Marino .
5,060,813 10/1991 Gollasch et al. .
5,103,991 4/1992 Collins .
5,197,618 3/1993 Goth .
5,213,225 5/1993 King et al. .
5,219,084 6/1993 King .

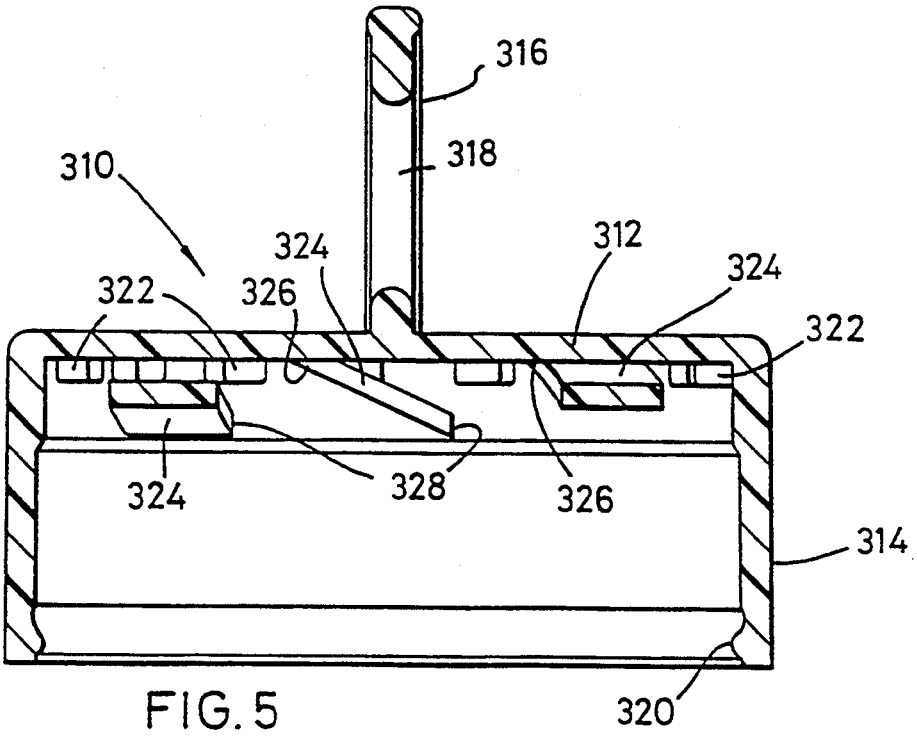
FIG. 5
FIG. 6
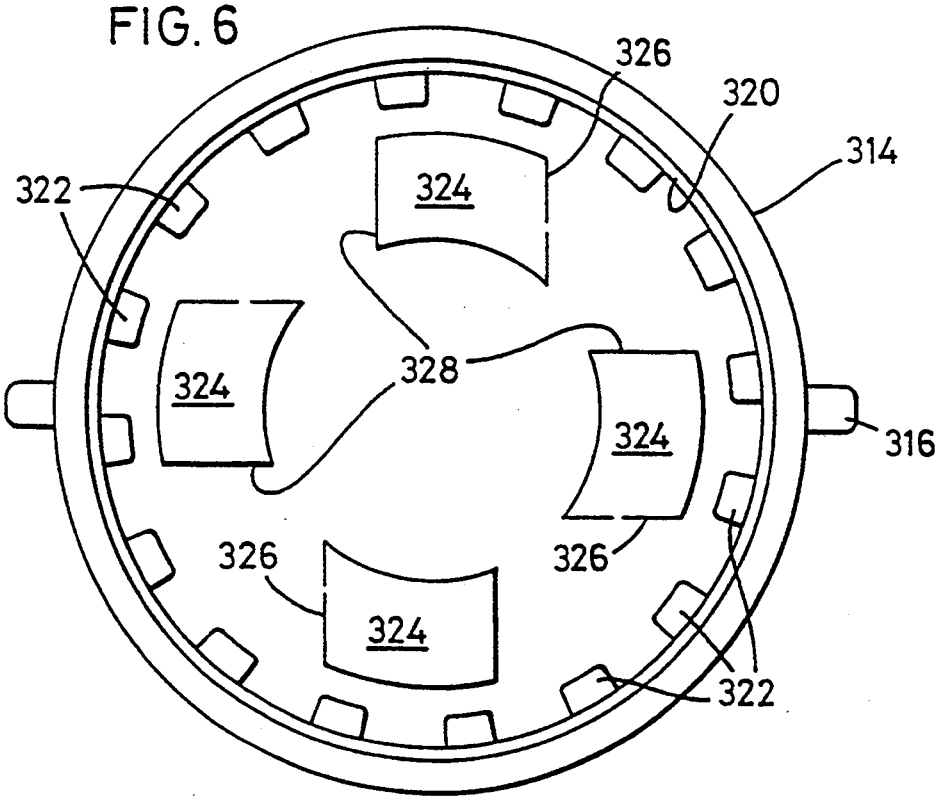

FIG. 13
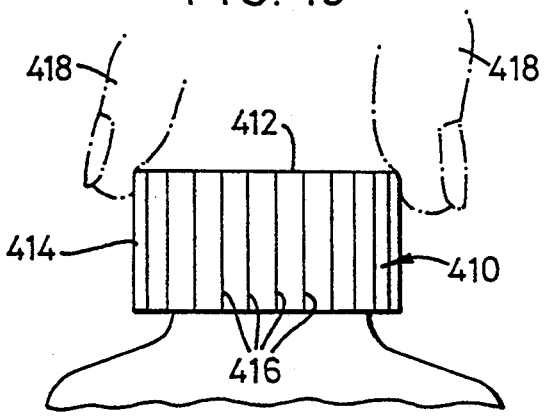
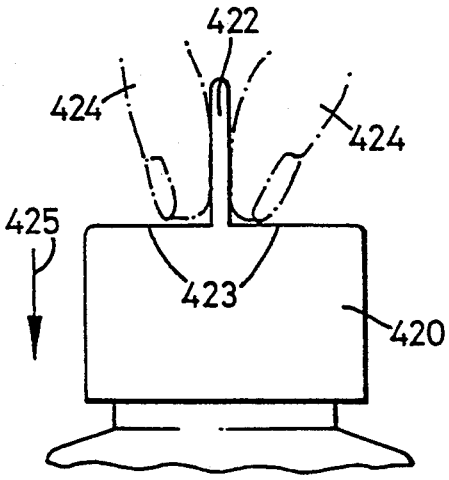
FIG. 14
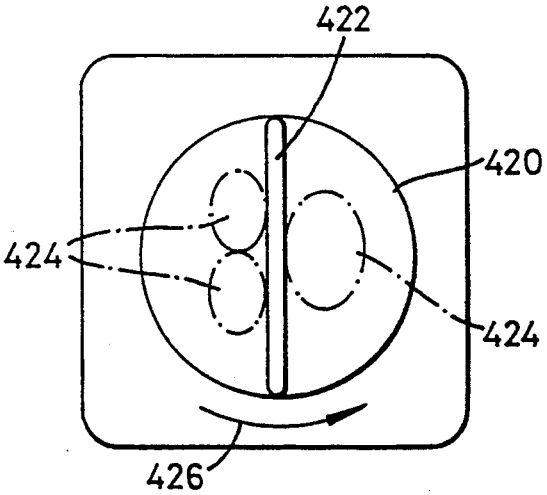
FIG. 15

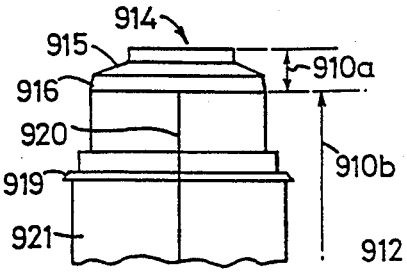
FIG. 34
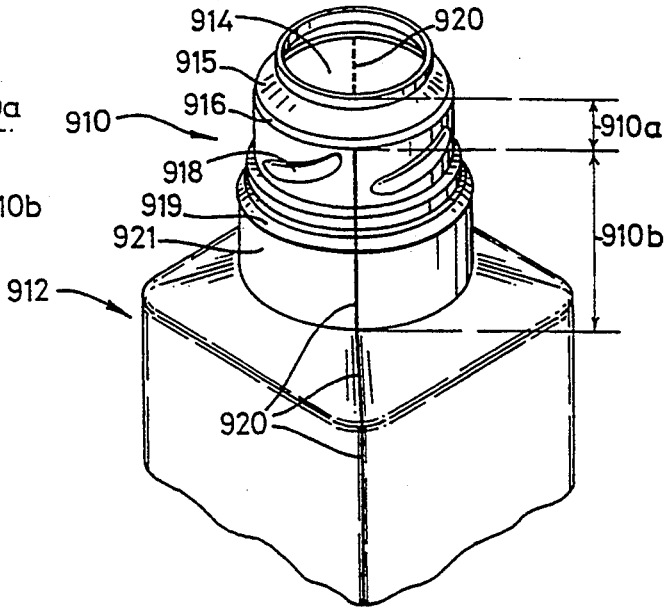
FIG. 33
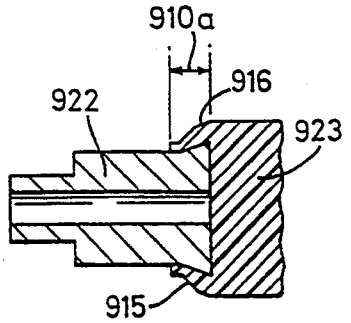
FIG. 35
FIG. 36
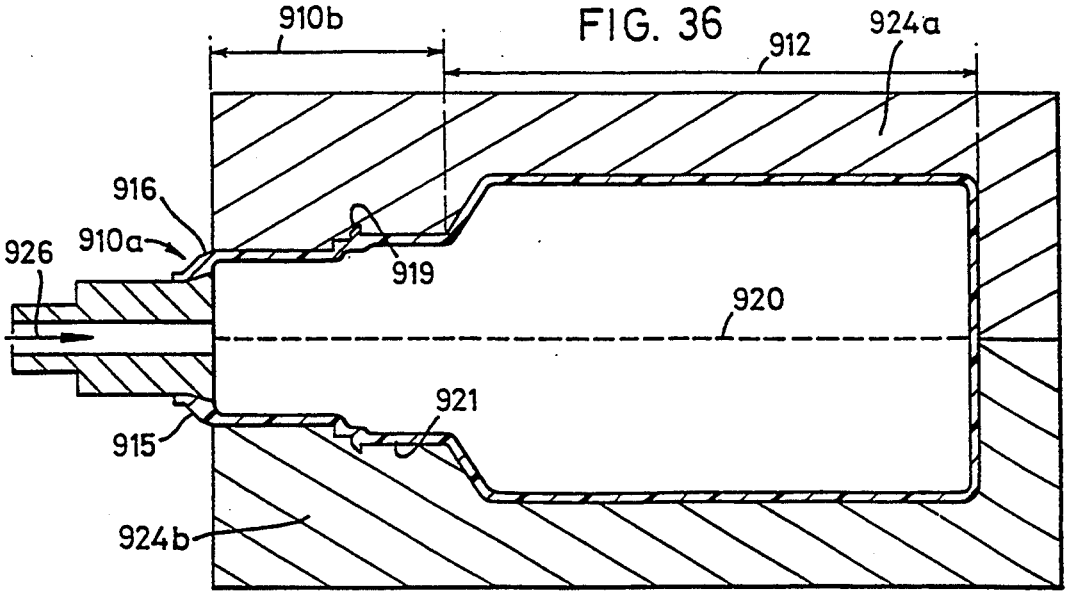

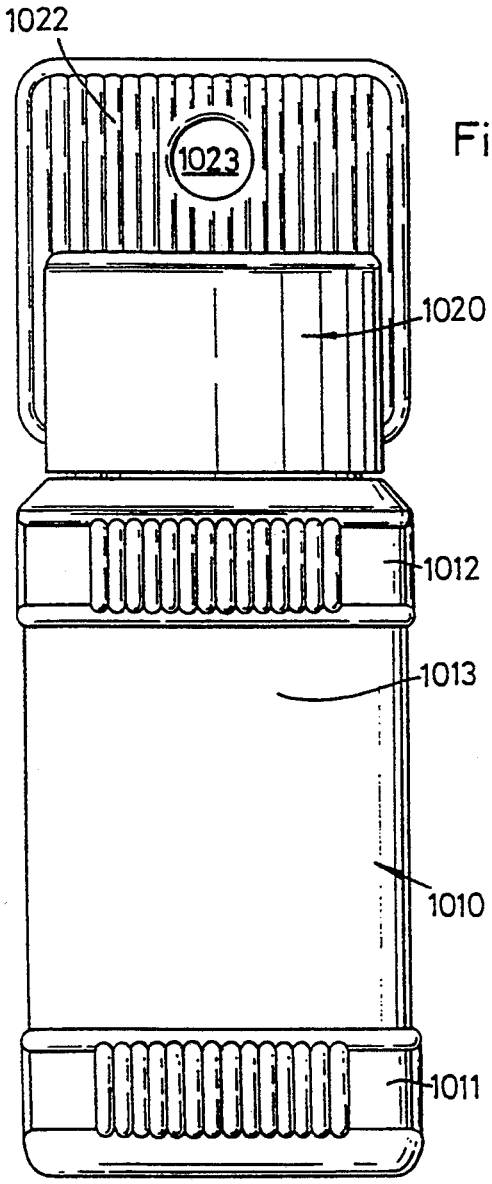
Fig. 47
Fig. 48
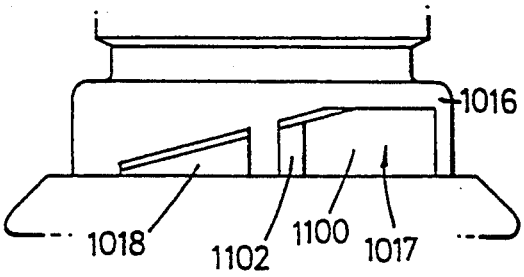
Fig. 49
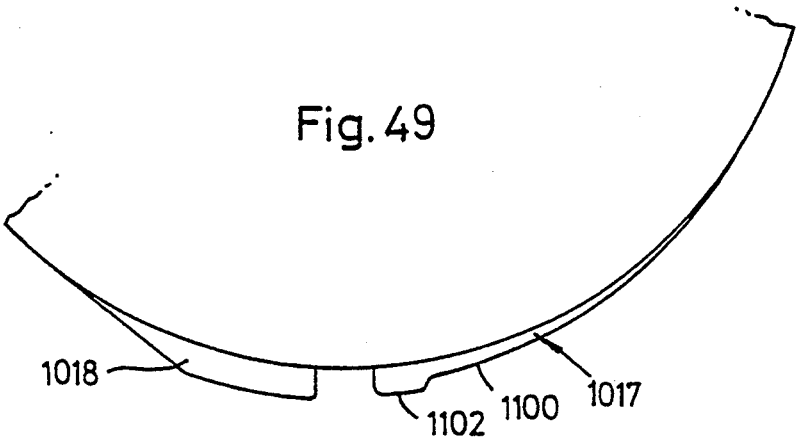

CONTAINER AND THE MANUFACTURE THEREOF

CROSS-REFERENCE

This application is a continuation-in-part of U.S. application Ser. Nos. 07/706,891, (filed 29th May 1991), now U.S. Pat. No. 5,213,225, 07/769,198, (filed 30th September 1991), abandoned, 07/796,946, (filed 22nd November 1991), abandoned, and 07/835,290, (filed 13th February 1992), now U.S. Pat. No. 5,219,084. The contents of these applications are incorporated herein at least by the references thereto. The present application also refers to International application No. PCT/GB91/00850 (now published) which describes a container closure assembly, and the content of which is incorporated by reference.

FIELD OF THE INVENTION

This invention relates to various aspects of a container, also to various aspects of a container neck and aspects of a closure for the neck. In one form the invention is particularly, but not exclusively, directed to a container which is designed to be sealed against the ingress of air, or liquid, or other contaminants when the closure is fitted to the container neck. In another form, the invention is particularly, but not exclusively, directed to a closure which includes a child-resistant feature. In a further form, the invention is particularly, but not exclusively, directed to a closure which includes a tamper-evident feature. In yet a further form the invention relates to the manufacture of containers.

In this specification, a so-called "child-resistant" closure (hereinafter referred to as a "relevant child-resistant closure") comprises an inner closure part adapted to be engaged with the neck of a container by rotation in one sense and to be disengaged therefrom by rotation in the other sense; an outer closure part capable of being moved relative to the inner closure part between a predetermined rest position and a displaced position; means to rotate the inner closure part with the outer closure part on rotation of the latter in the said one sense when the outer closure part is in either of its rest position and its displaced position; and means to rotate the inner closure part with the outer closure part on rotation of the latter in the said other sense when the outer closure part is in its displaced position, but when the outer closure part is in its rest position only when any torque resisting rotation of the inner closure part is below a predetermined threshold; wherein the outer closure part is capable of adopting its displaced position only when its angular displacement with respect to the inner closure part is within any one of a number of predetermined discrete angular ranges. It will be appreciated that the term "discrete angular ranges" covers the case where the ranges are zero, and the outer closure part can adopt its displaced position only at discrete angles relative to the inner closure part.

BACKGROUND OF THE INVENTION

Prior art relating to sealing container closure assemblies is described in U.S. Pat. Nos. 4,177,906, 3,894,647, 4,273,248, 4,093,096, 4,310,101, 4,493,427, 4,746,016, 4,856,674, 3,861,549, 4,328,905, 4,954,191, 1,850,911, 2,313,161, 2,026,889, 3,767,076, 4,335,824, 4,605,136, and in Netherlands specification No. 6707565.

Prior art relating to child-resistant container closure assemblies is described in U.S. Pat. Nos. 3,894,647, 4,213,534, 3,770,153, 3,94,4101, 3,831,797, 4,376,497, 3,994,4102, and in PCT application No. WO 90/04546.

Prior art relating to tamper-evident container closure assemblies is described in U.S. Pat. Nos. 4,147,268, 4,157,144, 4,746,026, 3,944,102, 3,737,064, 4,493,427.

Additional prior art relating to container closure assemblies is described in U.S. Pat. Nos. 4,662,530, 4,669,624, 4,289,248, 3,347,403, in European specification No. EP-A-0117948 and in French specifications Nos. 2572369, 2558443 and 2036272.

SUMMARY OF THE INVENTION

In one aspect the invention relates to a container having one or more features of the invention. In a second aspect, the invention relates to a container neck having one or more features of the invention. In a third aspect, the invention relates to a closure having one or more features of the invention. In a fourth aspect, the invention relates to a container closure assembly comprising a container neck and a closure in combination, the assembly having one or more features of the invention.

The invention is characterised by one or more of the following independent features which may be used independently, or some in combination. The independent features have been devised with the aim of improving over the prior art in certain areas, as exemplified by the following headings (which refer to preferred embodiments and are not to be regarded as limiting the invention):

AUTOMATIC CLOSURE WITH ONLY QUARTER TURN (1) The closure is movable from fully disengaged from the neck to fully closed by turning the closure relative to the neck by less than 360°. Preferably this is about 180° or less, and more preferably about 90° or less. For example, the rotation may be about 45°–50°.

The threads may have three, four or more starts to allow respectively three, four or more start positions of the closure on the container neck.

Engageable catches or catch projections are preferably provided. There my be 2 catch projections on the container neck or container shoulder, and 4 catch projections on the closure. The projections on the closure may be spaced apart angularly by 90°, and those on the neck by 180°. This arrangement can match the preferred quarter turn feature of the closure, allowing the closure to be secured by the catch projections when rotated from any of the four start positions.

(2) The closure and the container neck are provided with screw threads for threadedly securing the closure on the container neck, and co-operating retaining means are provided on the container neck and on the closure for retaining the closure in a predetermined closed position on the neck until a predetermined external release torque is applied to the closure.

The retaining means may comprise one or more inwardly facing projections on the closure for co-operating with one or more outwardly facing projections on the container neck.

The retaining means may produce a detectable "click" effect when the closed position is reached.

At least one of the projections may be profiled to have a circumferential ramp surface over which the other projection can ride relatively easily on the closure means the closed position, and a relatively steep or radial abutment surface against which the other projection bears when the closure is to be unscrewed from the closed position.

(3) The closure and the container neck are provided with screw threads for threadedly securing the closure on the container neck, and the assembly further comprises means for preventing the closure from being overtightened substantially beyond a predetermined closed position, or beyond a predetermined sealed position.

The closure and the container neck may have complementary sealing surfaces for forming a seal widen the closure is in its closed position on the container neck. The complementary sealing surfaces may form the means for preventing the closure from being overtightened substantially beyond the predetermined position. The sealing surfaces may extend in a direction at least a component of which is lateral, or radial. With this arrangement, if the closure is overtightened beyond its closed position, the sealing surfaces will bear against each other more strongly, to thereby oppose further tightening of the closure.

An alternative arrangement is to provide one or more stop projections on the container neck at positions circumferentially beyond the projections which define the closed position. Such stop projections may have a radial abutment surface adapted to engage one or more projections on the closure.

(4) The closure and the container neck are provided with screw threads for threadedly securing the closure on the container neck, and sealing means for forming a seal between the closure and the container neck, the assembly further comprising means for positively defining a closed position of the closure on the container neck at which position the closure is adequately seated on the container neck to obtain a seal, whereby overtightening of the closure can be avoided.

The assembly may also comprise means for retaining the closure, in use, in the closed position until a predetermined release torque is applied between the closure and the container neck.

The means for defining the closed position may produce a detectable "click" effect when the closed position is reached.

(5) The container neck and the closure include screw thread means on at least one of the closure and the container neck for retaining the closure on the container neck, sealing means for forming a seal between the closure and the container neck when the closure is at a sealing position on the container neck, and urging means co-operating between the closure and the container neck when the closure is near the sealing position for urging the closure automatically into the sealing position independently of whether an external closing torque is being applied to the closure, and thereafter for maintaining the closure in the sealing position until a sufficient external release torque is applied to the closure.

The urging means may maintain a force on the sealing means when the closure is in its sealing position. This can ensure that the respective sealing surfaces of the sealing means are firmly seated against each other, even though the closure may not be screwed down especially tightly when in the sealing position. The arrangement can thus increase the force experienced by the sealing means, leading to an improved seal, without requiring the closure to be screwed down very tightly on the container neck.

The urging means may comprise first means on the container neck for co-operating with second means on the closure, at least one of the first and second means including a ramp surface against which the other of the first and second means bears when the closure is near the sealing position, the ramp surface extending in a direction to urge the closure in a direction towards its sealing position.

The first and second means may each comprise a respective ramp surface extending in a direction to urge the closure towards its sealing position.

The first means may comprise one or more outwardly facing projections on the container neck, and the second means may comprise one or more inwardly facing projections on the closure.

The or each second means projection maybe mounted on a resilient portion of the closure which portion is capable of deforming to enable that projection to ride over the first means projection when the closure is screwed into, or out of, the sealing position.

The projections may include respective lead-in ramp surfaces which bear against each other, in use, to ease the projections over each other when the closure is being screwed towards its sealing position, before the aforementioned ramp surfaces which apply an urging force begin to bear against each other.

The urging means maybe arranged to apply a rotational urging force to the closure relative to the container neck.

Preferably, the closure can be moved between its sealing position and a fully open position by relative rotation through 180° or less, and more preferably through about 90° or less. The rotation may, for example, be about 45°-50°.

The resilience of the material of the closure may be used to supply an urging force. The closure may deform slightly from its circular shape to an oval shape when the first and second means projections engage, and the resilience of the closure tend to urge the closure to return to its circular shape with a spring action.

(6) The container neck and the closure include screw thread means on at least one of the closure and the container neck for retaining the closure on the container neck, sealing means for forming a seal between the closure and the container neck when the closure is at a sealing position on the container neck, which sealing position is within a predetermined tolerance range of possible sealing positions, and urging means cooperating between the closure and the container neck when the closure is at a position anywhere within the tolerance range of possible sealing positions, for urging the closure into its sealing position independently of whether an external closing torque is being applied to the closure, and thereafter for maintaining the closure in the sealing position until a sufficient external release torque is applied to the closure.

With this aspect of the invention, closure assemblies can be manufactured which achieve an automatic and reliable seal, and which avoid overtightening, without requiring each container neck and each closure to be manufactured to strict tolerances. The container necks and the closures can therefore be made easily, and quite cheaply without prejudicing the reliability of each closure assembly. The invention can also compensate for any wear of the closure or of the container neck, if they are made of materials which will wear in use, e.g. soft plastics material.

The automatic seal thus achieved can achieve liquid-tight, air-tight, and hermetic seals. The seal is also able to withstand knocks to the container, for example, if it is dropped, or pressure within the container, e.g. from carbonated drinks. Thus, such a container closure assembly enables containers to be suitable for all kinds of applications, such as holding foods and drinks by keeping them fresh, carbonated drinks to maintain their "fizz" or spirits and perfumes to prevent evaporation loss.

The invention is especially advantageous in enabling such a seal to be formed automatically each time that the closure is secured on the neck. This has not be achieved hitherto, especially with a closure that may be securable by rotation through 90° or less without requiring the closure to be screwed down very tightly and with easy-open and child-resistant features, for examples, as described below.

FLANGE (TAB-LEVER) TOP (7) The closure comprises handle means on the closure, the handle means providing a wall or surface arranged to facilitate application or removal of the closure to or from the container neck. The handle means preferably comprise upstanding handle means.

The closure may be a child-resistant closure. In particular it may be a relevant child resistant closure.

The closure may be a quarter-turn closure which can be opened by rotation through about 90° or less, for example, as described above.

The closure may be fitted with a tamper evident ring, for example, such as described in (25) below.

The handle on the closure is particularly suitable for use with a container having a shape to enable the container to be gripped easily, for easy opening. For example, the container may be polygonal (e.g. square) in section.

The handle means may comprise one or more projections such as a flange or flanges. The flange or flanges may project from the closure in a direction parallel to the rotational axis of the closure.

The handle means may in particular comprise a diametric flange upstanding from the upper surface of the closure.

The closure may comprise a substantially flat surface extending adjacent either side of the handle means, the flat surface providing a surface on which a person may push to press axially down on the closure.

In the case of the closure being a relevant child-resistant closure, the handle means may be formed integrally with the outer closure part of the said relevant child resistant closure.

AUTOMATIC AIR- AND LIQUID-TIGHT SEAL (8) The closure has a skirt portion, the inner surface of which is adapted to seal against an outer surface of the container neck.

The inner surface of the closure adapted to seal is preferably a radially inwardly facing surface which is adapted to seal against a radially outwardly facing surface of the container neck. The inner surface may also, or alternatively, be tapered to form a seal with a corresponding tapered portion of the container neck.

In one embodiment, this arrangement can be used with a container neck having a sealing web attached thereto. No contact other than accidental contact need occur between the closure and the lip of the container neck during application or tightening of the closure. The skirt portion of the closure can be made large enough to pass cleanly over the lip of the neck, and only seal with the neck in a region where the neck is radially wider.

The skirt portion of the closure may include an inwardly tapered surface to form an interference fit seal with a tapered portion of the neck. Preferably, the angle of taper is between about 1° and about 45°, more preferably between about 1° and about 25°, and in particular about 4° or 5°.

(9) The closure has a skirt portion, an inner surface of which is adapted to seal against an outer sealing surface of the container neck, and co-operating securing means are provided on the closure and on the container neck for removably retaining the closure on the container neck, the securing means on the container neck being positioned further from the open end of the container neck than the sealing surface of the container neck. The securing means may comprise a screw thread.

(10) The closure includes first sealing means for sealing against an outer surface of the container neck when the closure is in its closed position, and second sealing means for sealing against an inner surface of the container neck when the closure is in its closed position.

The outer surface of the neck against which the first means is adapted to form a seal may be a circumferentially facing outer surface, or it may alternatively be any other surface, such as a top surface, on the outside of the container neck.

The first and second sealing means may form respective seals with the container neck at positions which are substantially directly opposite each other. This can further improve the sealing effect by "wedging" the wall of the container neck between the first and second means of the closure.

The first sealing means may comprise an inner surface of a skirt portion of the closure, which inner surface is adapted to seal against the neck. The outer surface of the neck may include an outwardly tapered portion, and the inner surface of the skirt portion of the closure may be adapted to form an interference fit with the outwardly tapered portion of the neck. The skirt portion of the closure may include an inwardly tapered surface to form a complementary fit with the outwardly tapered portion of the neck.

The angle of taper of the tapered portion of the neck may be between about 1° and 45°, preferably between about 1° and 25°, and in particular about 4° or 5°.

The second sealing means may comprise a plug portion of the closure, which plug portion is shaped to fit inside the container neck, the circumferential surface of the plug portion being adapted to seal against the inner surface of the neck.

The inner surface of the container neck may include an outwardly tapered portion, the circumferential surface of the plug portion being adapted to form an interference fit with the tapered portion of the neck. The plug portion may include an inwardly tapered surface to form a complementary fit with the outwardly tapered inner surface of the neck. The angle of taper may be between about 1° and 45°, preferably between about 1° and 25°, and in particular about 4° or 5°.

The angle of taper of the inner surface of the neck preferably matches the angle of taper of the outer surface of the neck.

The sealing surfaces of the closure may be formed a V-shaped channel on the inner surface of the closure.

SEAMLESS AIR- AND LIQUID-TIGHT SEAL

(11) The container has an opening intended to be sealable by means of a closure releasably retainable over the opening, the container comprising a seamless first portion including a sealing surface extending around the opening, the sealing surface being intended to seal in use against a said closure, and a second portion which may include a seam or seams.

The first portion may have been formed by injection molding. The second portion may have been formed by blow-molding.

The container may be formed of plastics material, the first and second portions being integrally formed.

The first portion of the container may comprise generally a neck, or at least the upper portion of a neck, of the container. In particular, the first portion may consist of the portion of the neck from the container opening to the sealing surface. The second portion consists of the remainder of the neck below the sealing surface and the body of the container.

The neck may include means for releasably retaining a closure on the neck to cover the opening. Such means may comprise a screw thread, or snap fit means. The portion of the neck carrying the retaining means maybe blow molded.

The invention also extends to cover a method for forming a container having an opening which is intended to be sealable by means of a closure releasably retainable over the opening, the method comprising forming a seamless first portion of the container by a first process, which first portion includes a sealing surface extending around the opening, the sealing surface being intended to seal in use against a said closure, and forming a second portion of the container by a second process, which second portion may include a seam or seams.

The first process may comprise injection molding. The second process may comprise blow molding. The method may comprise injection molding the first portion of the container around a hollow floating mandrel, and blow molding the second portion of the container by blowing gas through the hollow floating mandrel.

The invention also extends to cover means for forming a container as aforesaid by a process of injection molding and blow molding, the means comprising a floating mandrel about which a seamless first portion of the container can be injection molded, the first portion of the container including an opening and a sealing surface extending around the opening, the sealing surface being intended in use to seal against a releasably retainable closure for sealing the opening, and the floating mandrel being hollow to enable gas to be blown through the mandrel for blow-molding a second portion of the container.

SQUARE SECTION THREADS

(12) The closure and the container neck are formed with thread profiles which fully engage to prevent play between the container and the closure, and ensure axial movement of the closure on the container neck. The threads may be of square or rectangular section to provide maximum stability when the threads first engage, and increasingly thereafter.

Such fully engaging threads are advantageous with the engaging projections on the container neck and on the closure, as they enable more leverage to be applied to the closure.

Such threads are also advantageous if the closure is fitted with a tamper-evident ring, as they provide positive axial movement of the closure when rotated to facilate separation or releasing of the tamper-evident ring. This is particularly advantageous for a quarter-turn closure since the amount of rotation of the closure through which the tamper-evident ring must be released is restricted to about 90°, or even less.

TAMPER PROOF PEEL OFF SEAL

(13) The container neck has a sealing web adhered thereto, and at least a circumferential portion of an outer edge of the lip of the container neck under the sealing web is cut away. This provides that the part of the sealing web which overlies the cut away edge may be used as a pull away tab for the web. Such an arrangement is particularly useful for webs which are adapted to be peeled off.

In one embodiment, the sealing web is at most coextensive with the lip of the container neck. Thus, when the closure is fitted to the neck, the sealing web will not be fouled by the closure.

(14) The arrangement of the container neck and the closure is such that when the closure is in its fitted or closed position on the container neck, a clearance exists between the outer surface of the top of the neck and the corresponding inner surface of the closure.

With this arrangement, the closure remains entirely clear of the lip of the neck, and therefore of any sealing web which may be provided thereon.

In the case where a sealing web is provided on the container neck, a clearance preferably exists between the closure and the sealing web at all points around the web, so that the closure does not foul the sealing web when the closure is fitted to the container neck.

This clearance may be afforded by providing the outer surface of the lip with a recess. Preferably, the recess includes a substantially outwardly facing surface which is inclined to the longitudinal axis of the container neck so as to form an overhanging rim on the container. Preferably the inclination of the recess surface is between about and about 45°, preferably about 20°.

(15) The container neck has a peelable sealing web attached thereto, an edge or edges of the sealing web projecting radially proud of the container neck.

The container neck may have a reduced circumference portion under the sealing web With this arrangement, at least one edge of the sealing web projects radially over the reduced circumference portion of the neck to provide a tab by which the seal can be peeled off. The entire periphery of the seal may project, so that an annular tab is formed around container neck.

The reduced circumference portion may be formed substantially-as a step, or groove, at the open end of the container neck. The size of the step, or groove, will be sufficient to enable a user to grasp the projecting portion of the sealing web so that it can be peeled back.

In one embodiment, the side of the step may be chamfered radially outwardly away from the open end of the container neck.

The closure assembly is preferably such that the closure does not bear down on the sealing web when the closure is fitted to the container neck. This avoids damage or fouling of the sealing web which might otherwise occur resulting in the loss of sealing integrity.

(16) The container neck has a semi-rigid sealing web adhered to the rim of the neck, an edge of the web extending outwardly beyond the rim to facilitate removal of the web in a peel-off manner.

The semi-rigid web may comprise a semi-rigid foil, or a layer of flexible foil with a semi-rigid backing layer.

For mass production using induction welding, the web may comprise a metallic foil on its underside. The web might consist entirely of metallic foil, or it might comprise an upper layer of, for example, paper or card to which the foil is laminated.

The upper surface of the web may carry printed promotional material, and for this the web may comprise an upper layer of card or paper so that the material can be printed easily.

The edge of the sealing web may project beyond the rim around the entire periphery of the rim.

In the case of a circular container neck, the sealing web may comprise a circular disc having a diameter slightly larger than the diameter of the rim of the neck, to provide a 360° projecting edge.

(17) The container neck has a relatively rigid sealing web adhered to the rim of the neck, an edge of the web extending beyond the rim to facilitate removal of the web in a "flip-off" manner.

The web in rigid form may be constructed as a rigid metallic layer or as a flexible or semi-rigid layer attached to a rigid backing. The lower surface of the web may be metallic so that the web can be secured using induction welding.

PEEL-OFF WEB REUSABLE IN CAP

(18) The rim of the container neck has a semi-rigid or relatively rigid sealing web bonded thereto, the web being removable in one piece to gain access to the container contents, and the container closure having an internal region into which the web can be fitted and retained by the closure after the web has been removed from the container rim, the web thereafter acting as a sealing member or pad retained in the closure to fit against the rim when the closure is replaced on the neck.

This arrangement is particularly advantageous when the container and closure have surfaces adapted to form a seal on the outside of the neck. When the container is used to hold liquids, granules, powder or other flowable products, the reusable sealing member retained in the closure ensures that the product cannot collect in the closure if, for example, the container is dropped accidentally or is tipped over. Some of the product might otherwise be able to collect in the closure outside the container neck even once the container has been uprighted, and might then congeal there, or else spill out when the closure is removed.

Preferably, the sealing web is semi-rigid or relatively rigid in a radial direction, so that it can be lifted off or peeled off the rim initially, but the web is compressible in an axial direction. The compressible web will then form a compressible pad when fitted in the closure, thereby providing better sealing characteristics when the closure is replaced on the container neck.

The sealing web may be coated with a coloured film, for example, of the type discussed in (20) below.

The sealing web preferably includes at least one layer of metal or metalised material, so that the sealing web can be bonded to the rim of the container by induction welding.

The sealing web/member when fitted back into the closure may be retained either by clips or projections, or merely by being a friction fit inside the closure. The sealing web/member is retained sufficiently strongly to prevent it from falling back out of the closure during normal repeated removal of the closure. However, the arrangement is designed so that the initial bond between the web and the rim of the container neck is stronger than the means which retain the web in the closure during later use. This ensures that, when the closure is removed for the first time, the sealing web remains integrally bonded to the rim as a tamper proof peel-off seal but, in later use, the sealing web serving as a sealing member or pad for the closure remains retained within the closure each time the closure is removed.

(19) A container neck sealing web suitable for reuse in a closure as a sealing pad, wherein the web is relatively rigid or semi-rigid in a planar direction so that the web will retain substantially its planar shape when in use, the web being resiliently compressible in a direction perpendicular to the plane of the web.

Preferably, the web comprises a laminate of at least one relatively rigid or semi-rigid layer and at least one compressible layer. More preferably, the web comprises upper and lower layers made of semi-rigid or relatively rigid material, these layers being separated by a layer of compressible material.

Preferably, at least one of the layers comprises metal or metalised material so that the web can be bonded to the rim of the container neck by induction welding. The under surface of the sealing web may be coated with a coloured film, for example, of the type discussed in (20) below.

COLOURED FILM

(20) The container neck has a sealing web adhered thereto, and a coloured film on the sealing web which is bonded to the container rim to provide colouring on the rim of the neck visible once the sealing web is removed, whereby an indication on the rim can be given that the sealing web has been removed.

The material of the film is preferably difficult to scrape or clean off the rim once it has been welded thereto. The film may be coated over substantially the whole under surface of the web. The web may be bonded to the container rim by welding, for example, by induction welding.

The colouring may, for example, be green.

The colouring preferably contrasts against the colour of the container neck so that it is immediately apparent to a user.

CHILD RESISTANT SYSTEM

Preferably this provides easy opening, for example, for elderly or handicapped people, but a reliable child-resistant feature.

(21) The closure is a relevant child-resistant closure, and the container neck and the closure include means for retaining the closure in a closed position on the container neck, the retaining means holding, in use, the closure in the closed position sufficiently strongly for the outer closure part to be rotatable in said other sense relative to the inner closure part when the inner closure part is in said rest position.

The retaining means may include one or more inwardly facing projections on the inner closure part for co-operating with one or more outwardly facing projections on the container neck.

At least one of the projections may be profiled to have a circumferential ramp surface over which another projection can ride relatively easily as the closure nears the closed position, and a relatively steep or radial abutment surface against which the other projection bears when the closure is to be unscrewed from the closed position.

(22) The closure is a relevant child-resistant closure comprising a plurality of cantilever leaf springs extending obliquely from one part of the closure towards the other part of the closure, each cantilever leaf spring having a cross-section which tapers towards it free end.

The profile at the acute angle between each cantilever leaf spring and the closure part from which said spring extends is radiused.

Additionally or alternatively, the said other part of the closure may have a number of angularly spaced ratchet ramps against which the leaf springs bear to restrict rotation of the outer closure part relative to the inner closure part in the said one sense, but to permit such rotation in said other sense. The number of ratchet ramps may be sixteen.

(23) The closure moves from fully closed to a fully open position by relative rotation through less than 360°, preferably approximately 90° or less, the closure being a relevant child-resistant closure and the number of said predetermined discrete angular ranges being such that angular displacement of the outer closure member relative to the inner closure member between adjacent positions in which the outer closure member can move to its displaced position is not greater than 45°, and preferably not greater than 25°.

The closure may include means for biassing rotationally the outer closure member relative to the inner closure member away from each angular position of which the outer closure member can move to its displaced position.

The angular displacement may be about 22.5°, in which case, from a normal rest position, the outer closure would move to a position where it could be moved with its displaced position by rotation through 12.25° relative to the inner closure member. This arrangement is provided by the closure having sixteen castellations, in which the maximum turn required for engagement is only one sixteenth, i.e. 22.5°.

In one embodiment, the angular displacement may be about 22.5°, and thereafter the closure can be moved from a fully closed to a fully open position by relative rotation through about 90° or less.

(24) The closure is a relevant child-resistant closure comprising means for biassing rotationally the outer closure part relative to the inner closure part away from each angular displacement at which the outer closure part can adopt its displaced position to a respective angular displacement at which the outer closure part cannot adopt it displacement position.

The rotational biassing means may exert a torque which is greater in absolute value than any frictional torque resisting relative rotation of the closure parts.

In the preferred case, at no time can the closure of the invention be left in a condition at which immediate movement of the outer closure part from its rest position to its displaced position is possible. The outer closure part must first be rotated against some restoring force before such displacement can be effected.

The means to rotate the inner closure part with the outer closure part may comprise a ratchet mechanism which restricts rotation of the outer closure part relative to the inner closure part in the said one sense, but permits such rotation in the said other sense.

The rotational biassing means may comprise the or a ratchet mechanism.

The number of the said discrete angular ranges may be equal to the number of stable positions of the ratchet mechanism.

The number of the said discrete angular ranges may be at least eight, preferably sixteen. This can enable the closure to be removed with a relatively small amount of rotation.

(25) The closure is a relevant child resistant closure, the container and closure having fully engaging thread profiles to prevent play between the container and closure and ensure axial movement of the closure on the container, the closure being movable from a fully opened to a fully closed position by rotation of the inner closure part through about 90° or less, and the container and the closure further comprise retaining means for retaining the closure in the closed position.

The retaining means may comprise one or more projections on the container neck for engaging one or more projections on the closure. The projections may "click" past each other when the closure is rotated into, or out of, its fully closed position.

(26) The closure is a relevant child-resistant closure, the angular positions at which the outer closure member can move to its displaced position are defined by castellations on each of the inner and outer closure members, there being at least eight and preferably sixteen equally angularly spaced castellations on at least one of the inner and outer closure members, which castellations mate when the outer closure member is depressed, the closure further comprising resiliently biased ratchet means for biasing the inner and outer closure members apart and for restricting rotation of the outer closure member relative to the inner closure member in the said one sense, but permitting such rotation in the other sense when the castellations are not engaged, the ratchet means further biasing the outer closure member in a rotational direction away from the said angular positions at which the outer closure member can move to its displaced position, in use. The closure being movable from a fully open to a fully closed position by relative rotation through about 90° or less, and the container neck and closure further comprising retaining means for holding, in use, the closure in the closed position sufficiently strongly for the outer closure part to be rotatable in said other sense relative to said inner closure part when said inner part is in said rest position.

The retaining means may comprise one or more projections on the container neck for engaging one or more projections on the closure. The projections may "click" past each other when the closure is rotated into, or out of, its fully closed position.

(27) The closure is a relevant child-resistant closure, in combination with a tamper-evident ring. The tamper-evident ring may be attached to or associated with the inner closure part. The closure may be removable by relative rotation through 360° or less, preferably 180° or less, or more preferably 90° or less.

SKIRT TO COVER TAMPER PROOF RING

(28) The closure has a tamper-evident ring, the ring being initially substantially concealed by the closure when the closure is fitted to the container neck, the arrangement being such that, in use, after the occasion on which the closure is first removed from the container neck, the tamper evident ring remains substantially visible on the container neck when the closure is replaced on the neck.

The tamper-evident ring may be integrally formed with the closure, or with at least a substantial part of the closure. The ring may be adapted to be retained on the container neck.

The tamper-evident ring may be movably retained on the container neck, and the assembly may further comprise releasable holding means for initially holding the tamper-evident ring in a first position in which it substantially concealed by the closure, the holding means releasing the tamper-evident ring when the closure is first removed from the container, to allow the ring to move into a second position in which it is not substantially concealed by the closure when the closure is replaced on the container neck.

The holding means may comprise severable connections between the tamper-evident ring and the closure, which connections are completely severed when the closure is first removed from the container neck. The severable connections may be integrally formed with the tamper-evident ring and with the closure.

The tamper-evident ring may be coloured a contrasting colour to the container so that the tamper-evident ring will be clearly visible, and easily discernable at a glance, once the closure has been removed for the first time. For example, the tamper-evident ring may be coloured red as a warning colour.

The portion of the container neck on which the tamper-evident ring sits when in its visible, second position may itself be coloured a colour which contrasts both the rest of the container and the tamper-evident ring. When the tamper-evident ring is in its concealed, first position, this portion of the neck will be visible, and so it may be coloured with a safety colour, such as blue or green, to indicate that the tamper-evident ring arrangement is intact.

The tamper-evident ring may be slidably retained on a portion of the neck, and is retained thereon. This prevents a person who has maliciously tampered with the container from discarding the tamper-evident ring.

In the second position the tamper-evident ring may be separated from the bottom of the closure by a distance at least equalling the axial width of the tamper-evident ring. With such an arrangement, a user can see quite clearly at a glance that the tamper-evident ring is detached from the closure.

The closure may include a recess, or a clearance, in which the tamper-evident ring is received when in its concealed, first position. The severable connections are preferably made between an inner wall or walls of the recess, and an edge of the tamper-evident ring. The recess may be defined by a skirt portion of the closure, which covers the tamper-evident ring.

The closure may be a child-resistant closure, for example, a relevant child resistant closure. The closure may include features described in (18)–(24) above. In addition, or alternatively, the closure may comprise upstanding handle means to facilitate the application of a sufficient opening torque to release the tamper-evident ring. For example, the handle means may include the features described in (7) above.

IMPROVED TAMPER PROOF RING

(29) The closure comprises a tamper evident ring integrally formed with at least a substantial part of the closure, the tamper evident ring being joined by severable connections each of which comprises a relatively wide or thick portion adjacent the closure and narrowing to a thin severable zone at the point where the connection joins the tamper evident ring, so that, in use, the tamper evident ring will, once detached, have a relatively smooth surface.

This can avoid the undesirable projecting "wires" or stubs which remain on the surface of some conventional tamper evident rings when the severable connections are broken.

The reverable connections may be made between an upper surface of the tamper evident ring and a lower or an upper surface of the closure.

The arrangement is particularly advantageous in the case where the closure substantially conceals the tamper evident ring from view when the closure has not yet been removed from the container neck for the first time. With this arrangement, the thick or wide parts of the severable connections remain integrally attached to an inner surface of the closure so that they are hidden.

In an alternative form, the closure may be shaped so that it does not conceal all of the tamper evident ring, but it still hides the thick or wide stub parts of the severable connections. For example, the closure may include a skirt portion which substantially conceals the severable connections when intact, and the remaining stubs once broken.

INNER SLEEVE

(30) The container is provided with an insert or liner which can be fitted through the neck of the container. The insert reduces the available capacity of the container. The insert is particularly advantageous when used with other independent features as described above.

In one embodiment a container comprises a container portion of a first cross sectional area and a neck of a second cross-sectional area less than the first cross sectional area, and an open tubular liner of less capacity than the container and capable of insertion into the container through the neck whereby the container can be used with the full container capacity or with a reduced capacity of the liner.

This feature enables the same container size to be used for a number of reduced capacities of contents. The embodiment is particularly useful when the container comprises features described hereinbefore for easy-opening of the container for elderly or handicapped people. The exterior shape of the container preferably enables the container to be gripped easily. For example it may be polygonal in section, e.g. rectangular or square. The size of the container preferably enables it to be held easily by hand. By using the liner of the present embodiment, this container body can be used to contain smaller volume of contents than the full capacity of the container. This might be desirable, for example, for tablets or other medicaments.

Therefore, this feature appreciates that while it might be desirable to use a relatively large container for easy opening, the capacity of such a container may be inappropriate for contents which occupy only a small volume.

DRIP PROOF RIM

(31) The container has a drip proof rim. This can reduce wastage and spillage of liquid when the container is used to pour liquids. The dripproof rim may comprise an annular recess formed in the outer, e.g.

radially outer, surface of the neck adjacent the open end of the neck. The drip proof rim may also be formed by chamferring the rim inwardly away from the open end of the neck to provide an overhanging portion. The rim may include a step profile. A sealing web may be adhered over the rim, preferably with an adge or edges of the web projecting radially outwardly over the rim to provide a peel-off or lift-off tab. The sealing web may, for example, have features described in (13)–(17) above.

Although each of the above (numbered) independent features may be used in isolation, further advantages may be achieved by combining one or more of the features together. The present application envisages all such combinations.

DESCRIPTION OF THE DRAWINGS

FIG. 5 is a longitudinal sectional view of an outer closure part of a related child-resistant closure;

FIG. 6 is an underneath view of the outer closure part of FIG. 5;

FIG. 13 is a side view illustrating a conventional child-resistant closure;

FIG. 14 is a side view of a child-resistant closure (such as the closure of FIGS. 5–12);

FIG. 15 is a plan view of the closure of FIG. 14;

FIG. 33 is a perspective view of the upper half of a container with a seamless sealing surface;

FIG. 34 is a side view of the neck of the container of FIG. 33;

FIG. 35 is a diagrammatic representation of a first processing stage for forming the container of FIG. 33;

FIG. 36 is a diagrammatic representation of a second processing stage for forming the container of FIG. 33;

FIG. 47 is a side view of the cap and container engaged;

FIG. 48 is a detail of an alternative embodiment of stop profile;

FIG. 49 is a plan view on an enlarged scale of the alternative embodiment of stop profile.

DESCRIPTIONS OF EMBODIMENTS

Various embodiments illustrating the features of the invention are now described by way of example only, with reference to the accompanying drawings.

FIGS. 1–3

Figure 1:
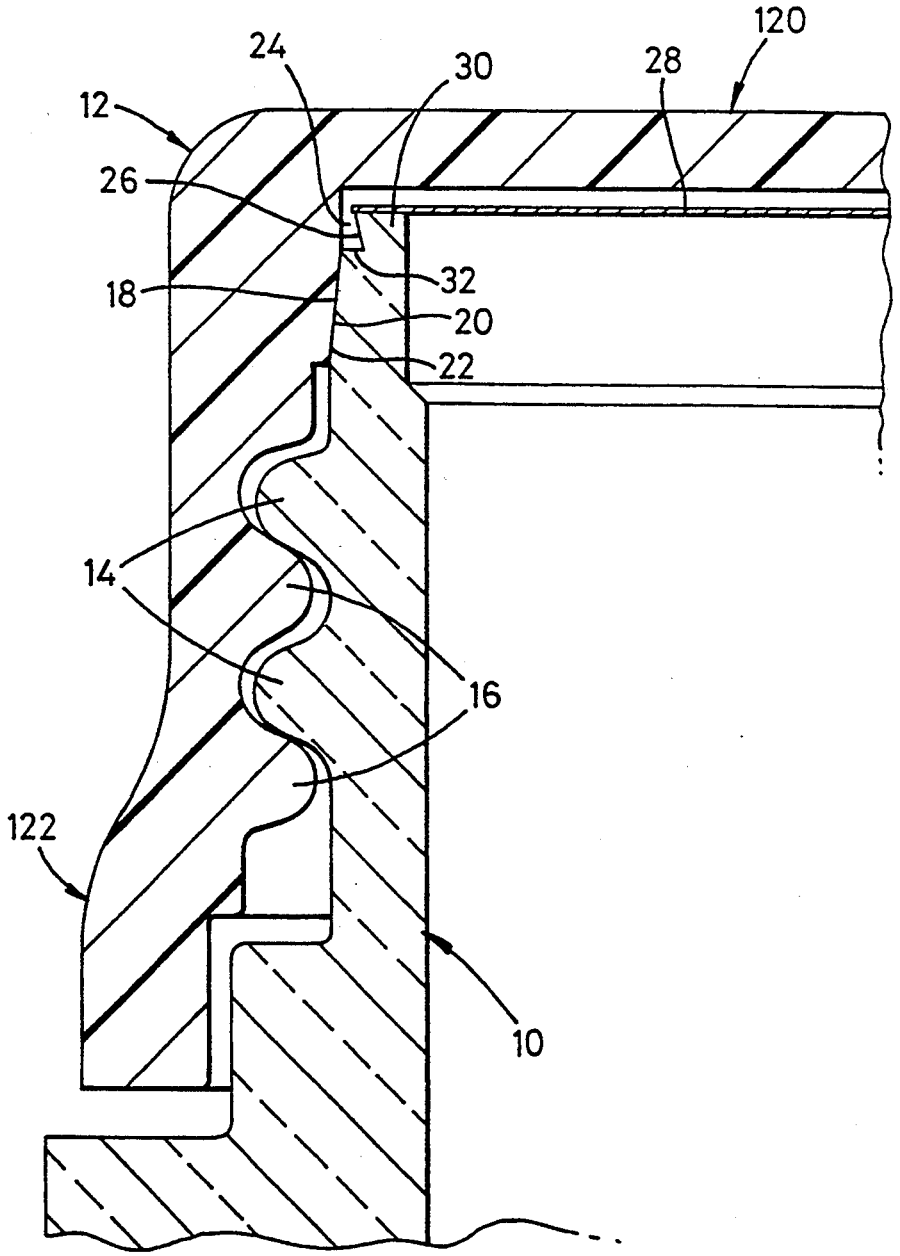
FIG. 1 is a section through a first embodiment of a container neck and a threaded closure.
Figure 2:
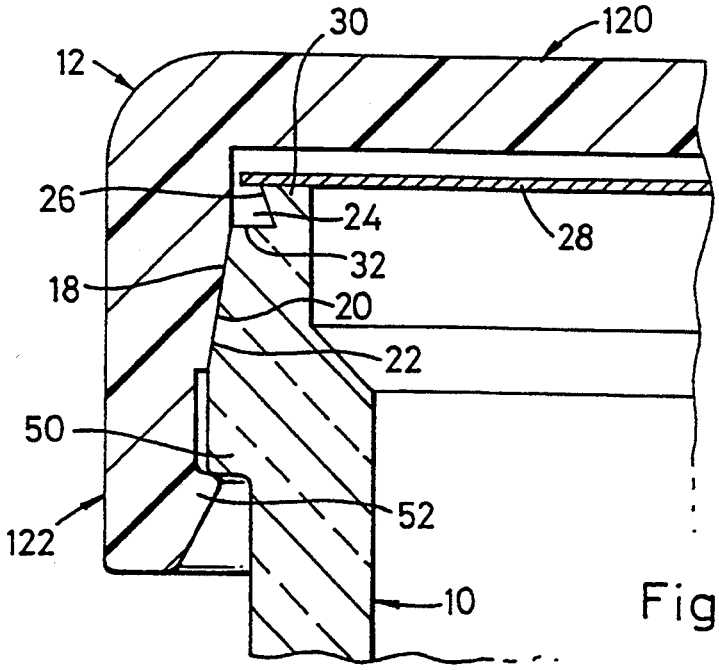
FIG. 2 is a section through a second embodiment, in which the closure is a snap fit onto the container neck.
Figure 3:
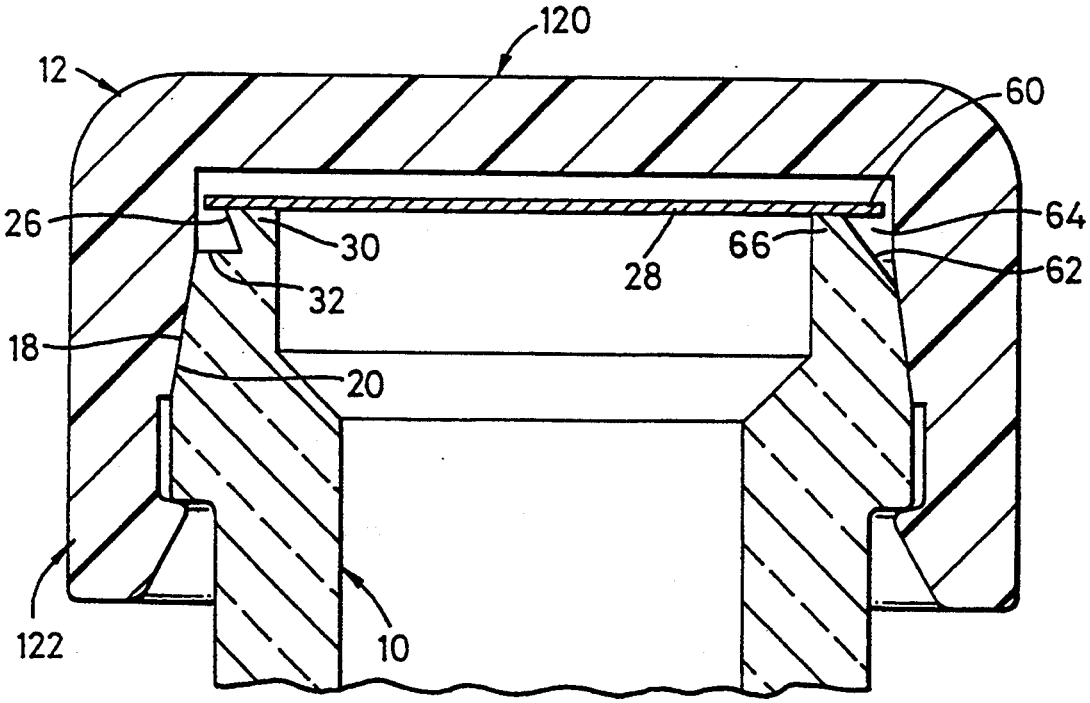
FIG. 3 is a section through the embodiment of FIG. 2, the lip of which has a chamfered edge.

The embodiments in FIGS. 1–3 relate to sealing a container neck.

Foil sealed containers are used for a variety of different purposes, particular examples being medicine bottles, coffee jars and drinks containers. Commonly, they are used in applications in which the contents of the container are consumed or exhausted over a fixed or well-defined period of time. In such cases, the foil seal provides that the contents of the container remain uncontaminated, or that they retain their original quality, until the foil seal is broken. A secondary seal, between the container and its complementary closure ensures a degree of protection for the contents of the container which is sufficient to preserve the quality of the contents throughout its consumption or usage period.

It has been common practice for the secondary seal to be provided between the lip of the container neck and the crown of the closure, which has the effect of sandwiching the foil seal between the two. Overtightening of the closure can tear or rupture the delicate foil seal.

Viewed from one aspect, the present embodiments include a container neck, a container closure and a thread for retaining the closure on the container neck, wherein the inner surface of a skirt portion of the closure is adapted to seal against the outer surface of the container neck.

With the above arrangement, the secondary seal remains entirely clear of the lip of the container neck, and therefore of any foil seal or other sealing web which may be provided thereon.

For additional protection of the sealing web, the assembly may be such that, when the closure is engaged with and sealed to the container neck, a clearance exists between the outer surface of the lip of the container neck and the corresponding inner surface of the closure.

In another aspect, the present embodiments include a container neck, a container closure and means for retaining the closure on the container neck, wherein the inner surface of a skirt portion of the closure is adapted to seal against the outer surface of the container neck and, when the closure is engaged with and sealed to the container neck, a clearance exists between the outer surface of the lip of the neck and the corresponding inner surface of the closure.

This clearance may be afforded by providing the outer surface of the lip with a recess. Preferably, the recess includes a substantially outwardly facing surface which is inclined to the longitudinal axis of the container neck so as to form an overhanging rim on the container. Preferably the inclination of the recess surface is between about 1° and about 45°, preferably about 20°.

Preferably, the container neck includes an outwardly tapered portion and the inner surface of the skirt portion of the closure is adapted to form an interference fit with that tapered portion. This will ensure that no contact, other than accidental contact, occurs between the closure and the lip of the container neck, or any sealing web thereon, during application or tightening of the closure. The skirt portion of the closure can be made large enough to pass over the relatively narrow lip of the container neck and only seal with the neck in a region where the tapered portion is wider.

To provide a good seal, the skirt portion of the closure preferably includes an inwardly tapered surface so as to correspond to the tapered neck. Preferably, the angle of taper is between about 1° and about 45°, most preferably about 1° and about 25°, and in particular about 4° or 5°.

In a case where the container neck and closure are of circular section, the means for retaining the closure on the neck preferably includes a thread. Most preferably a thread is provided on the closure and a complementary thread on the container neck.

Alternatively, the skirt portion of the closure may be provided with an inwardly facing deformable projection to engage a complementary outwardly facing projection on the neck. This provides a snap fit closure. Preferably, the projections comprise one or more outstanding beads.

In a further aspect, the present embodiments also include a container neck adapted to receive a complementary closure and having a sealing web sealed thereto, in which at least a circumferential portion of an outer edge of the lip of the container neck is cut away. This provides that the part of the sealing web which overlies the cut away edge may be used as a pull away tab for the web. Such an arrangement is particularly useful for webs which are adapted to be peeled off.

Preferably the sealing web is at most coextensive with the lip of the container neck. Thus, when the closure is applied, the sealing web is not fouled by the closure.

The cut away edge of the lip may be chamfered, and the container neck, with or without the sealing web may form part of a closure assembly according to the invention.

In detail, FIG. 1 illustrates a container closure assembly including a container neck (10) and a container closure (12). The closure (12) is illustrated in its engaged, sealed position on the container neck (10). In this exemplary embodiment both the neck (10) and the closure (12) are of circular section and are provided with complementary threads (14, 16).

The closure consists of a crown portion (120) and a skirt portion (122). The skirt portion (122) includes an inwardly tapered surface (20) and the container neck (10) includes a corresponding outwardly tapered surface (18). A seal (22) exists between the tapered surfaces (18, 20) by virtue of an interference fit between the two.

The lip (30) of the container neck (10) is sealed by a sealing web (28) which, in this exemplary embodiment is a foil seal. The neck (10) and closure (12) are constructed of materials common in the art, e.g. glass, plastics, metal etc.

As can be seen a clearance (24) exists between the outer surface (26) of the lip (30) and the inner surface of the closure (12). The clearance is of about 1 mm and corresponds to a recess (32) in the lip (30). As can be seen, the closure is held away from the edges of the foil seal, to reduce the likelihood of tearing the seal.

Whilst in the embodiment shown in FIG. 1 the clearance (24) is afforded by a recess (32) in the lip (30), it will be appreciated by one skilled in the art that such a clearance may be provided by an appropriate profile on the inner surface of the closure (12), or a combination of profiles on the closure (12) and the neck (10).

The recess (32) includes a substantially outwardly facing surface (26) which is inclined to the axis of the neck (10). This forms a drip-free, overhanging rim..

The diameter of the inside surfaces of the closure threads (16) is greater than that of the sealing web or foil (28). The complementary threads (14, 16) may therefore be engaged without any portion of the closure (12) contacting the sealing web (28). Rotation of the closure (12) advances it axially until its tapered surface (20) interferes with that (18) on the neck (10). No stress is applied to the sealing web (28).

The secondary seal (22) between the tapered surfaces (18, 20) has been found in shelf tests to be, for practical purposes, of equal integrity to the foil seal itself. This offers a substantial improvement over the prior art.

A container closure assembly according to this, or any other embodiment of the invention may for example be applied to the container and closure which forms the subject of our international patent application PCT GB91/00850.

FIG. 2 illustrates an assembly similar to that shown in FIG. 1, but which includes a snap-fit closure. The closure (12) is, in this embodiment, formed of deformable plastics material. Its skirt portion (122) is provided with an inwardly facing outstanding bead (52) which cooperates with an outstanding projection (50) on the container neck.

Once again, tapered surfaces (18, 20) are provided on the neck and closure to provide an interference seal (22). The outer surface of the container lip (30) is again provided with a recess (32) which is, practically, identical to the recess shown in FIG. 1. The inside diameter of the bead (52) is greater than the diameter of the sealing web (28).

As can be seen, the foil is of a larger diameter than is the recessed container lip so as to provide an overhanging edge of foil to facilitate the removal of the foil. Nevertheless, the foil diameter is not so large that the foil makes contact with the inner surface of the cap.

FIG. 3 shows the embodiment of FIG. 2 an edge (66) of the lip (30) of which is chamfered. The chamfer results in an inclined surface (62) which creates a space (64) beneath a peripheral portion (60) of the web (28).

This peripheral portion (60) performs the function of pull tab on the web (28) and is particularly useful when the web (28) is adapted to be peeled off the container lip (30). Of course, the web (28) is still fully sealed to the horizontal surfaces of the lip (30).

FIG. 4

Figure 4:
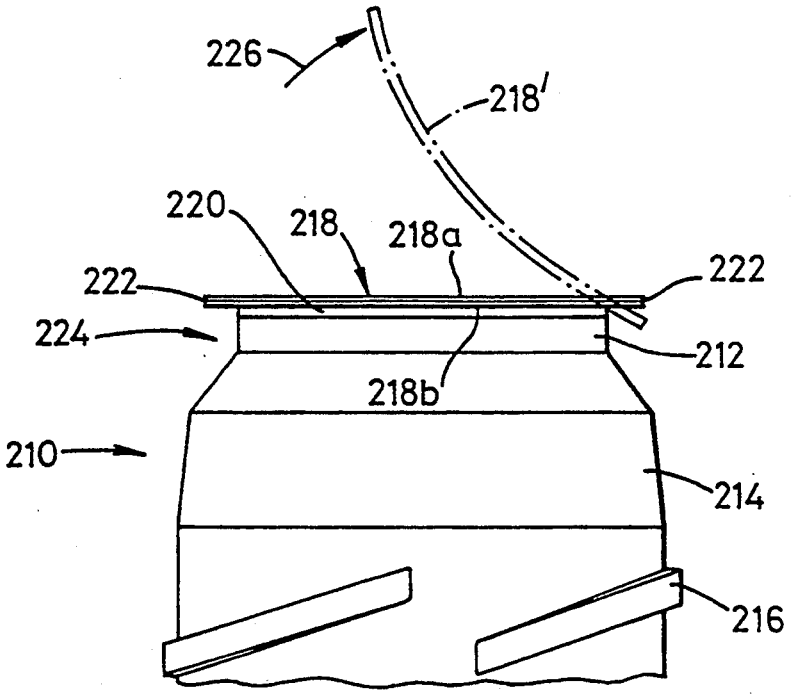
FIG. 4 is a side view of an alternative sealing arrangement for a container neck.

The embodiment in FIG. 4 also relates to a sealing arrangement for a container neck. In one aspect it relates to an improved sealing web arrangement.

As explained above, seals of this type are commonly used in containers for food, drinks and medicaments to act as a primary seal until the container is opened for the first time and to provide a tamper-proof feature. A typical type of seal comprises a thin flexible web made of a single material such as foil or paper which is adhered, for example, by adhesive or by heat welding, to the rim of the container. Such very thin webs can be difficult or inconvenient to peel because the web has a fairly low resistance to tearing. This can be a particular problem in cases when the bond strength between the web and the rim of the neck is greater than the tearing strength of the web. In such a case, any tabs or projecting edges of the web have to be made fairly substantial in size if they are to be effective, to enable a person to grip the tab or projecting edge properly.

From one aspect, the present embodiments include a sealing arrangement for a container neck, the sealing arrangement comprising a semi-rigid sealing web adhered to the rim of the neck, an edge of the web extending outwardly beyond the rim to facilitate removal of the web in a peel-off manner.

With this arrangement, removal of the web is simplified by the peel-off design of the web, and its semi-rigidity which can prevent over-bending and consequent tearing. The semi-rigid design also requires a smaller projecting area than do, for example, the tabs or projecting edges for the thin flexible sealing webs of the prior art.

Preferably, the semi-rigid sealing web comprises semi-rigid foil, or a layer of flexible foil with a semi-rigid backing layer.

For mass production using induction welding, the web preferably comprises a metallic foil on its underside. The web might consist entirely of metallic foil, or it might comprise an upper layer of, for example, paper or card to which the foil is laminated.

The upper surface of the web may carry printed promotional material, and for this it is preferred that the web comprise an upper layer of card or paper so that the material can be printed easily.

Preferably, the edge of the sealing web projects beyond the rim around the entire periphery of the rim.

In the case of a circular container neck, the sealing web preferably comprises a circular disc having a diameter slightly larger than the diameter of the rim of the neck, to provide a 360° projecting edge.

By increasing the rigidity of the web, the removal of the web is enhanced by making it more "flip-off" in manner.

Alternatively, viewed from another aspect, the present embodiments include a sealing arrangement for a container neck, the sealing arrangement comprising a relatively rigid sealing web adhered to the rim of the neck, an edge of the web extending outwardly beyond the rim to facilitate removal of the web in a "flip-off" manner.

The web in rigid form may be constructed as a rigid metallic layer or as a flexible or semi-rigid layer attached to a rigid backing. The lower surface of the web is preferably metallic so that the web can be secured using induction welding.

In another aspect, the present embodiments relate to a tamper-proof feature for providing an indication once a flexible or a semi-rigid sealing web has been removed from the container neck rim.

In this third aspect, the present embodiments include a sealing arrangement comprising a container neck with a rim, a sealing web adhered thereto, and means for providing colouring on the rim of the neck visible once the sealing web is removed, whereby an indication on the rim can be given that the sealing web has been moved.

The means for providing the colouring may comprise means for providing a coloured residue on the rim, which is visible once the sealing web has been removed.

The means for providing the coloured residue on the rim may comprise a coloured film or layer on the web which is bonded, for example by heat or induction welding, to secure the sealing web to the rim. The material of the film or layer is preferably difficult to scrape or clean off the rim once it has been bonded thereto.

Although the above aspects of the present embodiments can be used independently of each other, a particularly advantageous sealing arrangement is provided by combining the third aspect with either the first or second aspect of these present embodiments.

Referring to FIG. 4, a container made of plastics material has a container neck 210 which is adapted to receive a closure (not shown). The neck 210 comprises a rim 212, a tapered sealing surface 214 which is adapted to form an interference fit seal with a corresponding sealing surface (not shown) within the closure, and a screw threaded portion 216 for threadedly retaining the closure on the neck 210.

The neck 210 is sealed by means of a peel-off semi-rigid protective sealing web 218 which has a thin layer or film of coloured material 220 coated on substantially the whole of its under surface (the thickness of the film is shown exaggerated in the drawing). The web is sealed to the rim 212 by heat welding, for example, using induction welding techniques. The rim 212 is chamfered radially inwardly around its entire circumference under the sealing web, such that the edge 222 of the sealing web projects radially outwardly beyond the rim 212.

In this exemplary embodiment, the sealing web 218 comprises an upper layer 218*a* made of paper or card, laminated to a lower layer 218*b* made of metallic foil, for example aluminum foil. The web is similar to conventional inserts which are welded in place within caps to provide a paper or card sealing surface as part of the cap. However, for this invention, the conventional insert would be turned upside down so that the metallic foil side is adjacent the container rim. This allows the webs to be sealed to the rims using induction welding techniques.

The chamfering of the rim 212 provides a circumferential recess 225 to enable a person to push on the underside of the web with his thumb, or grasp the projecting edge 222 with finger and thumb in order lift the edge 222 and peel the sealing web 218 back off the rim 212 (as depicted by the arrow 226, and the sealing web 218' shown in phantom). The semi-rigidity and resilient flexibility of this web assist the peeling of the web from the rim as one edge is lifted. The web can be removed in one piece, in a single "peeling" action. The sealing web 18 is thus very simple to remove, without suffering from the problem of tearing as with the thin flexible webs of the prior art.

The coloured film 220 may be coloured a contrasting colour to the container neck 210 and its rim 212. For example the neck 210 may be white, and the film 220 coloured green, or some other alternative, contrasting colour. When the sealing web 218 is removed, part of the film 220 will remain as a coloured residue on the surface of rim 12. This serves as a tamper-proof feature evident It will be appreciated that the coloured film may be omitted or replaced by a substantially transparent layer which will not give the positive tamper-proof indication.

The semi-rigid web 18 could be replaced by a relatively rigid web which is removed in a flip-off manner. To remove the web, a consumer would then press his thumb against the projecting edge 22 to lift the rigid web up and off the container rim.

As a further alternative, the coloured film may be used with a conventional sealing web, to provide a positive tamper-evident indication by leaving a coloured residue on the rim when the sealing web is removed.

FIGS. 5-12

The embodiment illustrated in FIGS. 5-12 relates to a relevant child-resistant closure system.

Many known child-resistant closures include a plurality of equidistant ramps on the outer surface of a crown portion of the inner closure part which cooperate with a plurality of equidistant, resilient oblique blades extending inwardly from a crown portion of the outer closure part. When viewed from the centre of the respective closure parts, the ramps have a right triangular section comprising a horizontal base, a vertical left side and a hypotenuse and the blades extend diagonally downward from the left towards a lower right free end.

When the outer closure part is rotated clockwise, i.e. in a right-handed sense, the free ends of the blades abut the vertical faces of the ramps, thereby driving the inner closure part with the outer closure part.

When rotation of the outer closure part is effected in the other, left-handed sense, i.e. anticlockwise, the blades simply trail over the ramps in the manner of a ratchet, the inner closure part being fixed on the container by its closure torque.

Typically, castellations are provided on both inner and outer closure parts which mate when the outer closure part is depressed. The inner closure part is then bound to rotate with the outer closure part. When the outer closure part is released, the blades act as leaf springs to return it to its rest position, in which the castellations are disengaged.

Child-resistant closure systems normally rely on the ability of the closure to spring apart, every time, after pressure has been applied, generally at right angles to the plane of the thread. If, even on rare occasions the two parts of the closure do not spring apart and disengage, the child-resistant feature of the closure no longer functions. It is therefore essential that the blades acting as leaf springs have and continue to retain sufficient resilience to exert sufficient pressure to force the two parts of the closure apart in order that there is disengagement at all times, apart from occasions when direct and sufficient pressure is applied to engage the closure system. The main failure of existing systems to work properly at all times is due to the weakness of the leaf springs which in the past have typically been made of uniform thickness, with a sharp angle on the inside edge where the leaf spring joins the flat face of the underside of the top part of the closure. This design is potentially unsatisfactory as the leaf springs can weaken at the point of joining the flat plane of the underside of the top part of the closure, and the leaves themselves tend to be stiff and as a result do not flex along the length of the spring leaf.

To overcome this problem and to ensure more flexibility and to ensure that the leaf springs retain their resilience and hence the ability to force the two parts of the closure apart, and also to ensure that when being closed the planes of the top and lower part of the closure remain in parallel planes, the present embodiment includes, in one aspect, a relevant child-resistant closure comprising a plurality of cantilever leaf springs extending obliquely from on part of the closure towards the other part of the closure, each cantilever leaf spring having a cross-section which tapers towards its free end, and the profile at the acute angle between each cantilever leaf spring and the closure part from which said spring extends is radiused.

Another problem arises where a closure is primarily intended for use by the elderly, and hence must be easy to open, but which, for safety, must be child-resistant. The number of castellations provided on known child-resistant closures is normally two, three or four, but this can require the closure to be rotated for up to 180° before engagement of the castellations can take place. Engagement after a much smaller rotation is desirable, and according to a further aspect of the present embodiment there is provided a container neck and closure therefor wherein the closure moves from fully closed to a fully open position by relative rotation through less than 360°, preferably approximately 90° or less, the closure being a relevant child-resistant closure and the number of said predetermined discrete angular ranges being such that angular displacement of the outer closure member relative to the inner closure member between adjacent positions in which the outer closure member can move to its displaced position is not greater than 45°, and preferably not greater than 25°.

A preferred angular displacement is 22.5°, in which case, from a normal rest position, the outer closure would move to a position where it could be moved with its displaced position by rotation through 12.25° relative to the inner closure member. This preferred arrangement is provided by the closure having sixteen castellations, in which the maximum turn required for engagement is only one sixteenth, i.e. 22.5°. This is an important feature when used in conjunction with the container and closure of our International Patent Application No. PCT/GB91/00850, where, in the preferred embodiment, the closure can be removed in only a quarter turn, and the addition of the child-resistant feature does not reduce the capacity to open the closure in approximately a quarter turn. This aspect particularly assists and supports ease of opening for the elderly and frail with only a twist of the wrists, without the necessity to let go of the closure of the container, even though being child-resistant.

The number of ramps in known closures varies, but is commonly three, four or six. The number of blades should be greater than two for stability, and should be a factor of the number of ramps.

In the past it has been arranged that the discrete angular ranges of angular displacement of the closure parts at which the castellations may engage one another is one in which the free ends of the blades on the outer closure part lie between ramps on the inner closure part.

A result of this is that it is perfectly possible for a container on which such a closure is installed to be left with the closure parts so oriented that the castellations may be engaged simply by immediate depression of the outer closure part. Such a situation can occur where a closure has been installed with the outer closure part depressed, or where an adult has depressed the outer closure part, but then changed his mind about removing the closure.

The present embodiment seeks to overcome the above problem and in a further aspect, the present embodiment provides a relevant child-resistant closure comprising means for biassing rotationally the outer closure part relative to the inner closure part from each angular displacement at which the outer closure part can adopt its displaced position to a respect angular displacement at which the outer closure part cannot adopt its displaced position.

Preferably, the rotational biassing means exert a torque which is greater in absolute value than any frictional torque resisting relative rotation of the closure parts.

In the preferred case, at no time can the closure of the invention be left in a condition at which immediate movement of the outer closure part from its rest position to its displaced position is possible. The outer closure part must first be rotated against some restoring force before such displacement can be effected.

In the case where the friction between closure parts is sufficient to resist the restoring torque, enabling the closure to be left in a "primed" condition as it were, an advantage is still obtained. Subsequent handling of the closure or the container to which the closure is attached, such as setting the container down, dropping it, picking it up, casting it into a "medicine box" will in most cases be sufficient to cause the outer closure part to move somewhat relative to the inner closure part. The outer closure part will then come to rest nearer to, if not actually at, the said respective angular displacement.

It is therefore extremely difficult, in normal usage, to leave the closure in a "primed" condition.

Preferably, the means to rotate the inner closure part with the outer closure part comprises a ratchet mechanism which restricts rotation of the outer closure part relative to the inner closure part in the said one sense, but permits such rotation in the said other sense.

Preferably, the rotational biassing means comprises the ratchet mechanism.

Preferably, the number of the said discrete angular ranges is equal to the number of stable positions of the ratchet mechanism. When the features of this embodiment are combined with the arrangement as disclosed in our International Patent Application No. PCT/GB91/00850, it is advantageous for the number of the said discrete angular ranges to be at least eight, preferably sixteen. This preserves the ability of the closure to be removed with a relatively small amount of rotation.

According to a further aspect of this embodiment there is provided a container and closure as claimed in PCT/GB91/00850 or a relevant child-resistant closure, wherein the container neck and the container closure have fully engaging thread profiles to prevent play between the container and the closure and ensure axial movement of the closure on the container. The threads may be of square section, rather-than conventional "V" section threads to provide maximum stability when the thread first engage, and increasingly thereafter, whereby in conjunction with the four threads as described in our Patent Application No. PCT/GB91/00850, the square section thread ensures that the closure is pushed, would down to its closed position on a parallel plane, thereby making it easier for the engagement of the child-resistant closure in one simple turn of the wrist. The same applies when opening.

For increased security, it is preferred that one of the closure parts be provided with a tamper-evident ring.

A further aspect of the present embodiment concerns the combination of a child-resistant closure system, together with a tamper-evident ring. A child-resistant closure has not previously been combined readily with a tamper-evident ring, because of the difficulty of opening using conventional child-resistant closure systems. According to this aspect of the present embodiment, there is provided a child-resistant closure in combination with a tamper-evident ring, and preferably according one or more of the above aspects of this embodiment. Additionally, the closure preferably includes the feature of additional support for the means of opening including an upstanding flange, or side flanges, to assist in applying torque when opening the closure. Preferably, the closure and container neck is as defined in the invention of PCT/GB91/00850, the disclosure of which is incorporated herein by way of reference, giving the advantage that as the retaining force of the closure system is overcome, and the turning of the closure relative to the container neck starts, combined with the angle of the four threads and the quarter turn required to open, whereby the closure is given sufficient rotational acceleration and thrust to shear through the connections between the tamper-evident ring and the closure in such a manner as to overcome easily the resistance necessary for the tamper-evident ring to be separated from the closure even with the incorporation of the child-resistant system.

As can be seen from FIG. 5, an outer closure part 310, constructed of molded plastics (other suitable materials may be used), consists of a crown portion 312 and a skirt portion 314. The crown portion is provided on its outer surface with a diametric handle 316. The particular form of handle shown includes a central opening 318. Towards the lower, free end of the skirt portion 314, there is provided an inwardly extending bead 320, whose purpose is to retain the outer closure part on the inner closure part as will be described below.

Both FIGS. 5 and 6 illustrate that the inner surface of the crown portion 312 is provided with sixteen equidistant castellations 322 of substantially rectangular form and four equidistant oblique resilient blades 324. The resilient blades 324 extend circumferentially from an upper, left-hand end 326, when viewed from the centre of the closure part, to a lower, right-hand free end 328.

As can be seen from FIGS. 7 to 10, an inner closure part 350, constructed of molded plastics (other suitable materials may be used), which includes a crown portion 352 and a skirt portion 354. The inner surface of the skirt portion 354 is provided with coarsely pitched threads 356 of square section 356 and vertical ribs 358, the function and purpose of which are described in detail in our International Patent Application No. PCT/GB91/00850. The top of the skirt portion 354 is provided with a tapered sealing surface, the function and purpose of which are as described above in relation to FIGS. 1–4.

Depending from the lower end of the inner closure part skirt portion 354 is a tamper-evident ring 370 which will be described below.

The crown portion 352 is provided around its periphery with sixteen upstanding, substantially rectangular castellations 360. These castellations 360 are adapted to engage the complementary castellations 322 on the outer closure part (see FIG. 6) 310. The outer periphery of the skirt portion 354 includes an outstanding ridge 362 below which, when the inner 350 and outer 310 closure parts are assembled, the bead 320 on the outer closure part 310 is retained. A degree of axial movement of the outer closure part 310 with respect to the inner closure part is permitted to engage and disengage the two sets of castellations 360, 322.

Figure 7:
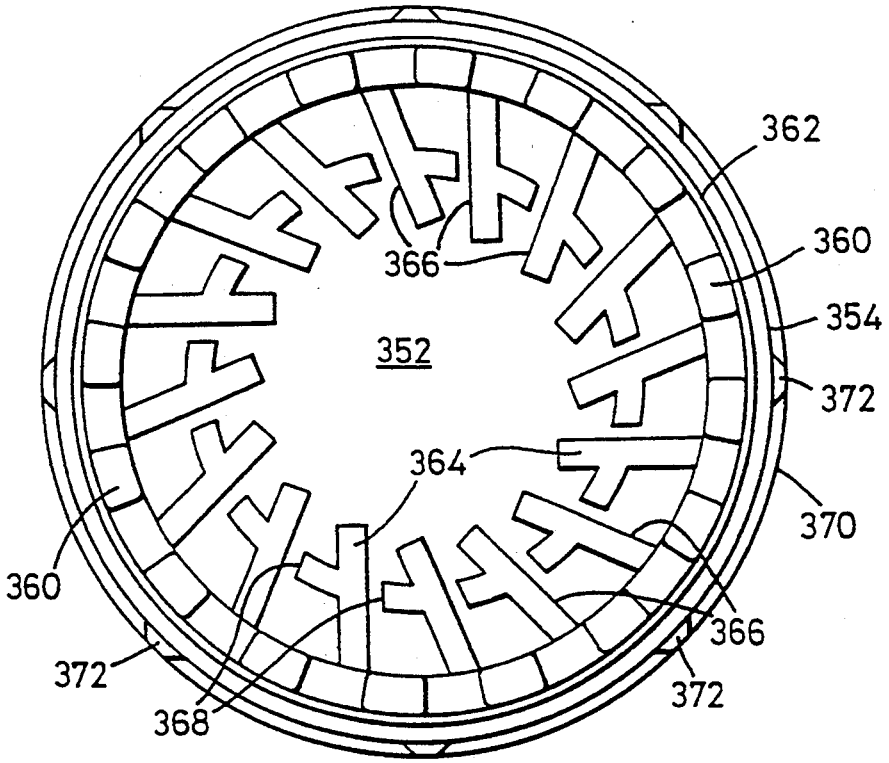
FIG. 7 is a plan view of the corresponding inner closure part.
Figure 9:
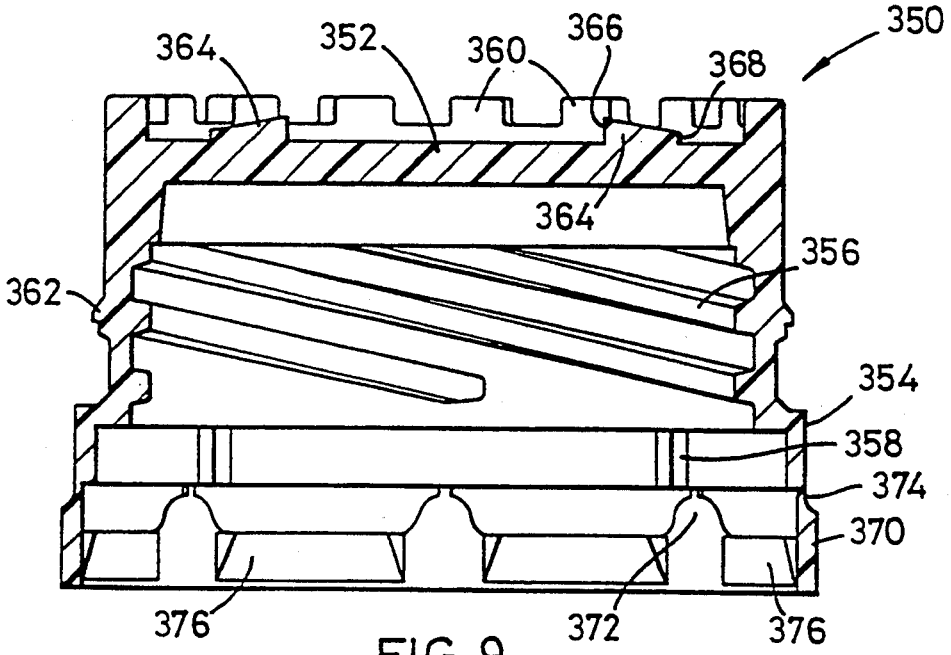
FIG. 9 is a longitudinal sectional view of the inner closure part of FIGS. 7 and 8.

Partly shown in FIG. 9, but fully in FIG. 7, are sixteen equidistant ramps 364, provided on the upper surface of the inner closure part crown portion 352. When viewed from the centre of the closure part, each ramp 364 is of substantially right triangular section having a horizontal base, a vertical left-hand side 366 and a hypotenuse, terminating in a right-hand side 368.

When the outer closure part 310 is installed on the inner closure part 350, and the outer closure part 310 rotated clockwise, the free ends 328 of the resilient blades 324 abut against the vertical side 366 of their respective ramps, thus rotating the inner closure part 350 with the outer closure part 310. However, assuming that the inner closure part 350 is reasonably tightly held in place, e.g. by a closure torque, then rotation of the outer closure part 310 anticlockwise will merely result in the resilient blades 324 trailing over the ramps 364 in the manner of a ratchet mechanism.

In order for the inner closure part 350 to be rotated anticlockwise, it is necessary for the outer closure part 310 to be depressed against the action of the resilient blades 324 to allow the complementary castellations 322, 360 to engage.

The handle 316 enables the elderly and frail more easily to apply the force required to push down and engage the two parts of the closure, whilst at the same time the handle 316 makes it easy to turn the closure to open it. When closing the same principles and advantages apply. The handle 316 therefore makes the closure much easier to operate, in spite of the child-resistant feature, compared with standard child-resistant closures which many people, not just children find difficult to open.

Alternatively, the handle 316 may be substituted by four side flanges to the outer closure part 310 which again enables easier opening and closing, or a standard cap with ribbed outer edges.

The relative angular displacements at which the complementary castellations 322, 360 may be engaged correspond to positions in which the free ends 328 of the resilient blades 324 have already travelled some distance along and up their respective ramps 364. They therefore correspond to positions of increased potential energy. The resilience of the blades 324 is such that, when the outer closure part 310 is released in such a displacement, the free ends 328 of the blades tend to move back down the sloping surfaces of the ramps 364 to their right hand sides 368. Once this has occurred, the complementary castellations 360, 322 are no longer so oriented as to be immediately engageable with one another.

Thus, all the rotationally stable positions of the outer closure part 310 with respect to the inner closure part 350 correspond to orientations of the castellations 322, 360 in which they cannot immediately be engaged only by depression of the outer closure part 310.

Figure 8:
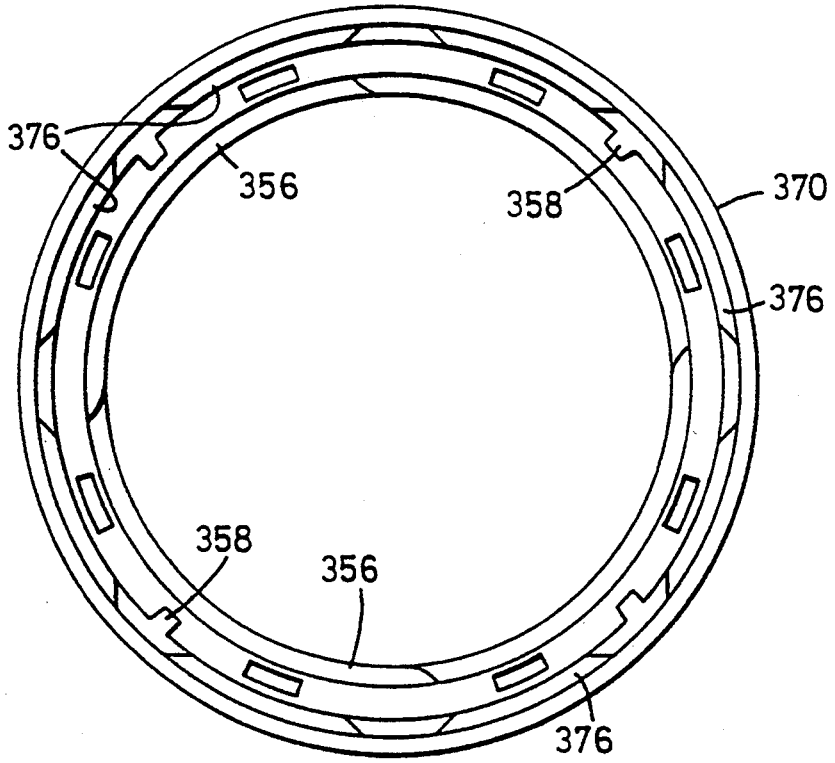
FIG. 8 is an underneath view of the inner closure part of FIG. 7.
Figure 10:
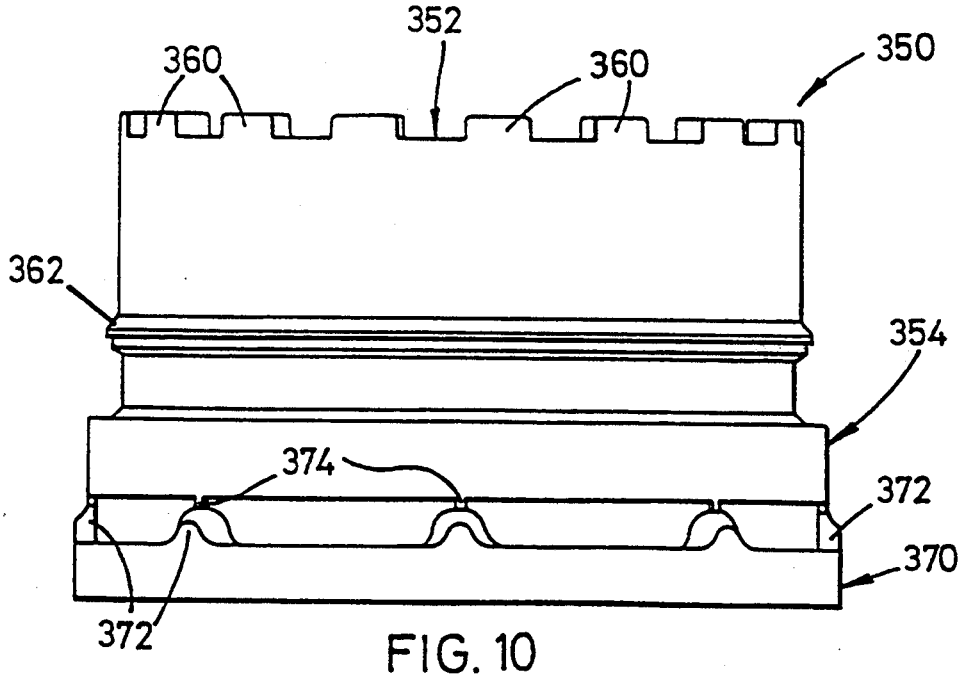
FIG. 10 is a side view of the inner closure part of FIGS. 7 to 9.

The tamper-evident ring 370 carried by the inner closure part 350 is shown in detail in FIGS. 8 to 10. Attached to the top of the ring and integral therewith are eight connecting members 372 which taper upwards from a relatively thick lower region into a relatively thin frangible bridge 374 attached to the inner closure part skirt portion 354. On the inside of the tamper-evident ring 370, extending between the connecting member are eight triangular section ring retaining clips 376 which are adapted to engage a circumferential projection on the outer surface of a container neck.

Figure 11:
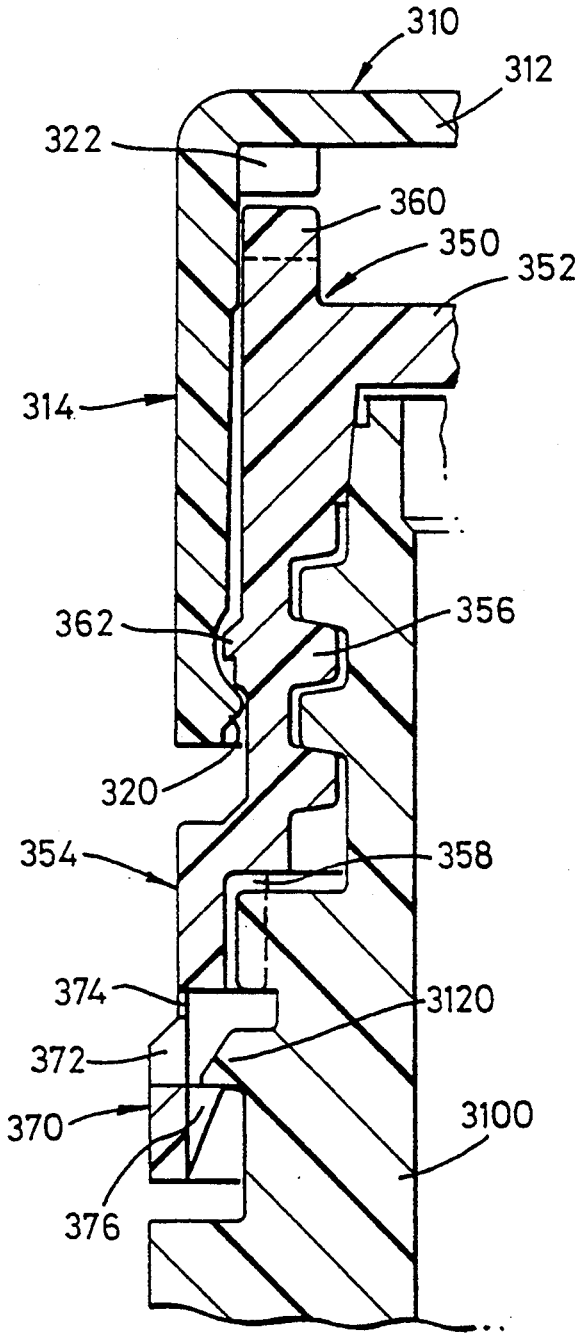
FIG. 11 is a longitudinal sectional view of the assembled closure retained on a container neck.

The assembled closure is shown in FIG. 11, and specific details of the thread 356 and vertical rib 358 and the seal between closure and container 390 may be found in our two Patent specifications cited herein. As can be seen in FIG. 11, the thread is essentially square in section, providing positive and axial alignment of the two closure parts. The container 390 includes an outstanding circumferential projection 392 which is engaged by the ring retaining clips 376. Unscrewing the closure will result in the frangible bridges 374 being stretched and broken.

Figure 12:
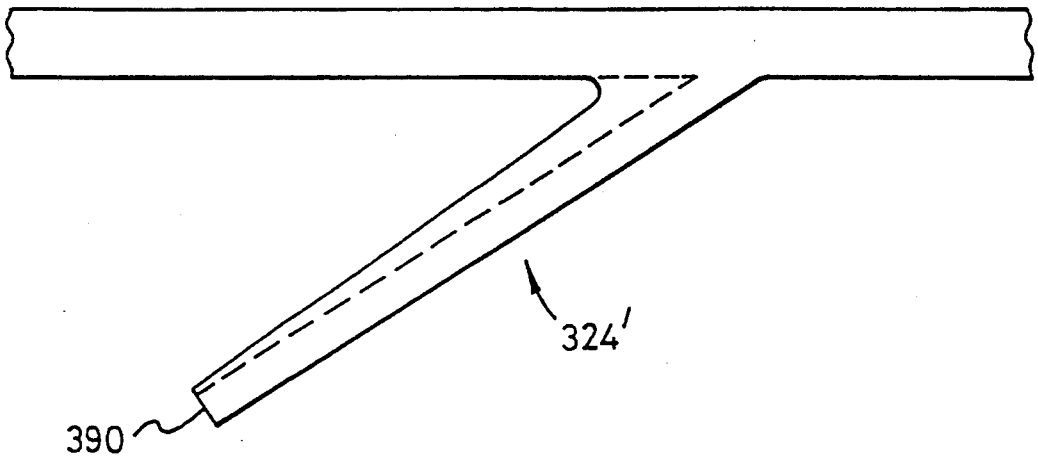
FIG. 12 is a side view showing the profile of a blade in the form of a leaf spring.

FIG. 12 shows a preferred profile of a blade in the form of a leaf spring 324'.

As can be seen, the leaf spring 324' is thicker at its base, becoming progressively thinner towards its free edge 394. The joint of the leaf spring 24'0 with the remainder of the outer closure part 310 is radiused to provide extra strength. This profile gives sufficient resilience and strength to the leaf spring 324' to ensure that the outer closure part 310 and inner closure part 350 are always separated until axial pressure is applied to counteract the bias of the springs 324'.

An important advantage of this embodiment of the invention is that, in conjunction with features of the container and closure described in PCT/GB91/00850, this is the only child-resistant closure which opens in under half a turn, i.e. 180°, and more generally in approximately a quarter turn i.e. 90° or less, also in conjunction with the container neck as described in relation to FIGS. 1–4 it is the only child-resistant closure system which can be used in conjunction with either both a tamper-evident ring and a foil seal whereby the seal of the closure is air and liquid proof after the foil has been removed or broken.

There is also another useful aspect in combining features of the above embodiment with the closure systems of PCT/GB91/00850. Viewed in one aspect this combination provides a container and closure therefor wherein the closure and container includes means for retaining the closure in a closed position on the container neck, the closure being a relevant child-resistant closure and the retaining means holding, in use, the closure in the closed position sufficiently strongly for the outer closure part to be rotatable in said other sense relative to said inner closure part when said inner part is in said rest position. The closure system preferably includes means for ensuring that the closure closes in the same position, every time of closure. This closure system ensures the functioning of the child-resistant closure, whereby when closed, the resistance to opening is sufficiently strong for the child-resistant feature to operate, but is sufficiently weak as to be overcome by the child-resistant system when properly engaged by an adult. The relevant child-resistant closure is preferably as claimed in PCT/GB91/00850. This feature provides the advantage that, upon engagement of the closure system, the closure is held on the container such that the child-resistant closure mechanism operates effectively but that the closure can be released, once the closure outer part is moved to the displaced position, by application of a predictable torque. Conventional spring blades type child-resistant closures are screwed onto a neck thread with more than a 360° turn for closure. In order for all conventional spring blades type child-resistant systems it is essential that they are screwed up very tightly, when being closed, otherwise the child-resistant system does not become operable at all, thus obviating the purpose of the child-resistant system. The weakness of conventional child-resistant systems is therefore obvious, as arthritic, weak and elderly users are unable to close such containers sufficiently tightly, either to close them properly, or, even if they were closed tightly, perhaps by somebody else, then to open them. This embodiment overcomes the problem of conventional child-resistant closures of tightening the closure sufficiently, in that the closure does not have to be closed tightly in order for the child-resistant system to become operable, and therefore is particularly effective for the arthritic, weak and elderly, as this combination of new closure systems enables the containers, bottles and closures to be opened and closed easily, in approximately a quarter of a turn, with an effective child-resistant System.

FIGS. 13–15

FIGS. 13–15 relate to providing handle means on the closure.

FIG. 13 illustrates an example of a conventional type of relevant child resistant closure. The outer part 410 of the closure is generally circular, and includes a flat top wall 412 and a circular side wall 414 depending from the top wall 412. The outer surface of the side wall 414 includes small vertical ribs 416 arranged side by side around the closure, to enable a person to grip the side wall 414 to screw or unscrew the closure on a container neck.

However, this arrangement makes it awkward for a person to press down axially on the closure while at the same time applying a twisting force as required to unscrew the closure. Typically a person has to press his fingers against the top corner of the closure, as illustrated by in phantom at 418 in FIG. 13. To unscrew the closure at the same time the person usually has to grip the side wall 414 quite tightly since only a small upper portion of the sidewall 414 is being gripped. The problem is particularly important for elderly or handicapped people who may find it difficult to press down and grip the closure.

Viewed from one aspect the present embodiment includes a child resistant closure with handle means on the closure, the handle means providing a wall or surface arranged to facilitate removal of the closure from a container neck.

The closure is preferably a relevant child-resistant closure, although this invention is applicable to other types of child-resistant closure not falling within this definition.

The handle means may comprise handle means upstanding from the closure. The handle means may comprise one or more projections such as a flange or flanges. The flange or flanges may project from the closure in a direction parallel to the rotational axis of the closure.

The handle means may in particular comprise a diametric flange upstanding from the upper surface of the closure.

The closure may comprise a substantially flat surface extending adjacent either side of the handle means, the flat surface providing a surface on which a person may push to press axially down on the closure.

The handle means may be formed integrally with the outer closure part of the said relevant child resistant closure.

The closure may be a "quarter-turn" closure which may be moved between a fully closed position and a fully disengaged open position by relative rotation through about 90° or less.

The closure may include a tamper evident ring. Suitable tamper evident rings are, for example, described above in relation to FIGS. 9–11, and below in relation to FIGS. 16–22.

In another aspect, the present embodiment also provides a container closure assembly comprising a container neck, and a container closure with handle means as aforesaid.

The closure 420 shown in the accompanying FIGS. 14 and 15 includes handle means in the form of an upstanding diametric flange 422 integrally formed with the outer closure part. The portion of the closure adjacent either side of the handle means comprises a generally flat top surface 423 of the closure. The handle greatly facilitates attachment and removal of the closure on a container neck, without prejudicing the child-resistant feature of the closure.

To screw or unscrew the closure, a person grips the handle with his fingers as shown phantom at 424. The closure is a relevant child resistant closure, and so to unscrew the closure a person must press down axially on the closure at the same time as he applies a twisting torque to unscrew the closure (e.g. in an anticlockwise direction). With the present embodiment, when the closure is to be unscrewed, the person can push down axially on the closure both through the tips of his fingers against the top surface of the closure, and through the gripping of the handle itself. It is thus much easier for a person to apply a twisting force in a clockwise or an anticlockwise direction (as depicted by the arrow 426 in FIG. 15), while at the same time applying an axial downward force (as depicted by the arrow 425 in FIG. 14) to overcome the child resistant feature of the closure. This is particularly advantageous for elderly or handicapped people.

The closure may include a tamper evident ring, for example, as illustrated in FIGS. 9–11 above. An alternative design of a tamper evident ring is described in more detail hereinafter in FIGS. 16–22. In a later embodiment, the lower portion of the outer closure part conceals the tamper evident ring until the occasion on which the closure is removed from a container neck for the first time, whereupon the ring becomes detached from the closure.

With the handle means of these embodiments a person can readily apply sufficient torque to break the frangible connections to a tamper evident ring and also unscrew the closure, while at the same time pressing down axially on the closure to overcome the child resistant feature. Such an arrangement usable by elderly or handicapped people has not been achieved hitherto.

FIGS. 16–18

Figure 16:
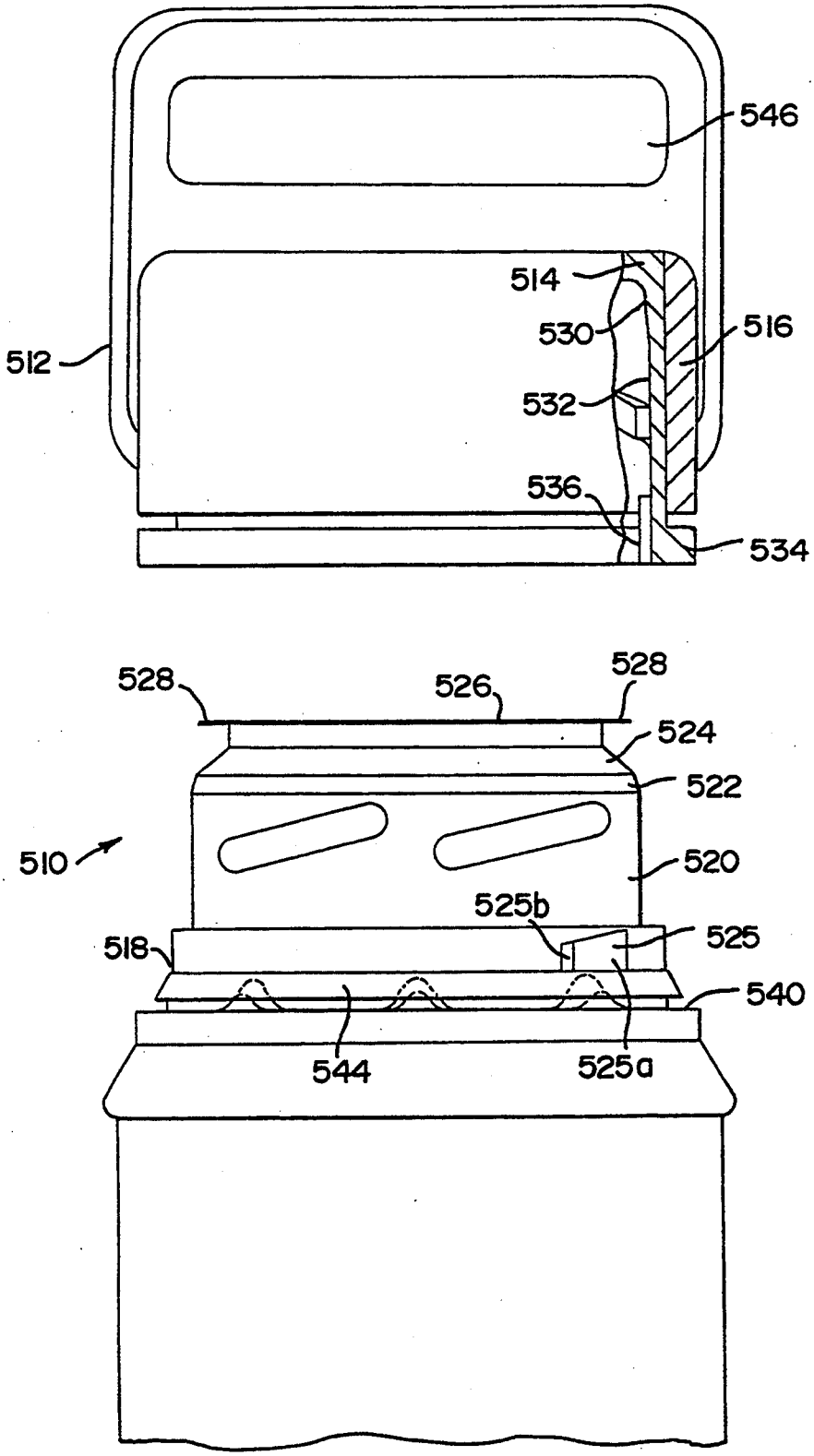
FIG. 16 is a side view of another embodiment of a container neck and closure, with a portion of the closure being cut away.
Figure 17:
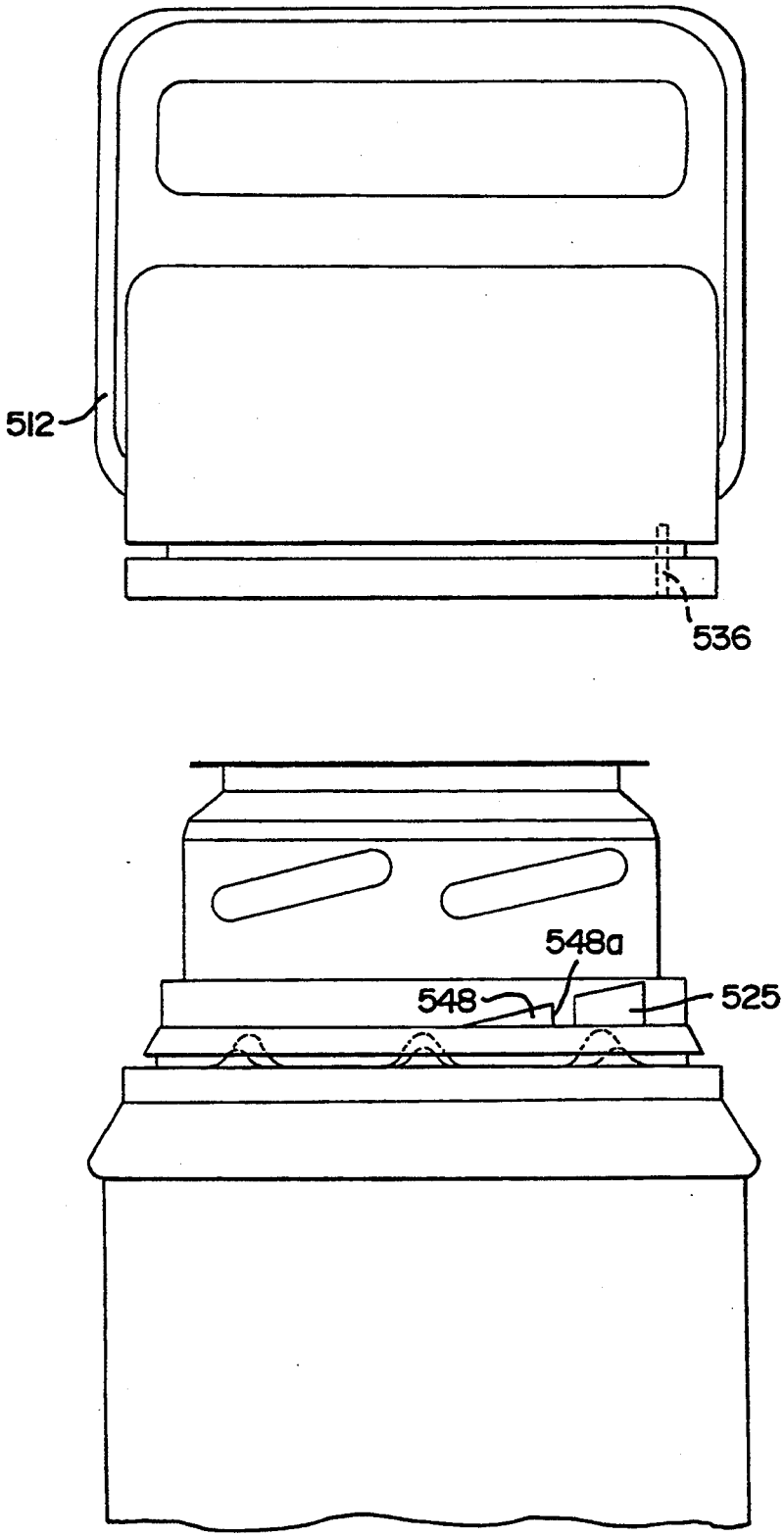
FIG. 17 is a view similar to FIG. 16 but showing an alternative embodiment.
Figure 18:
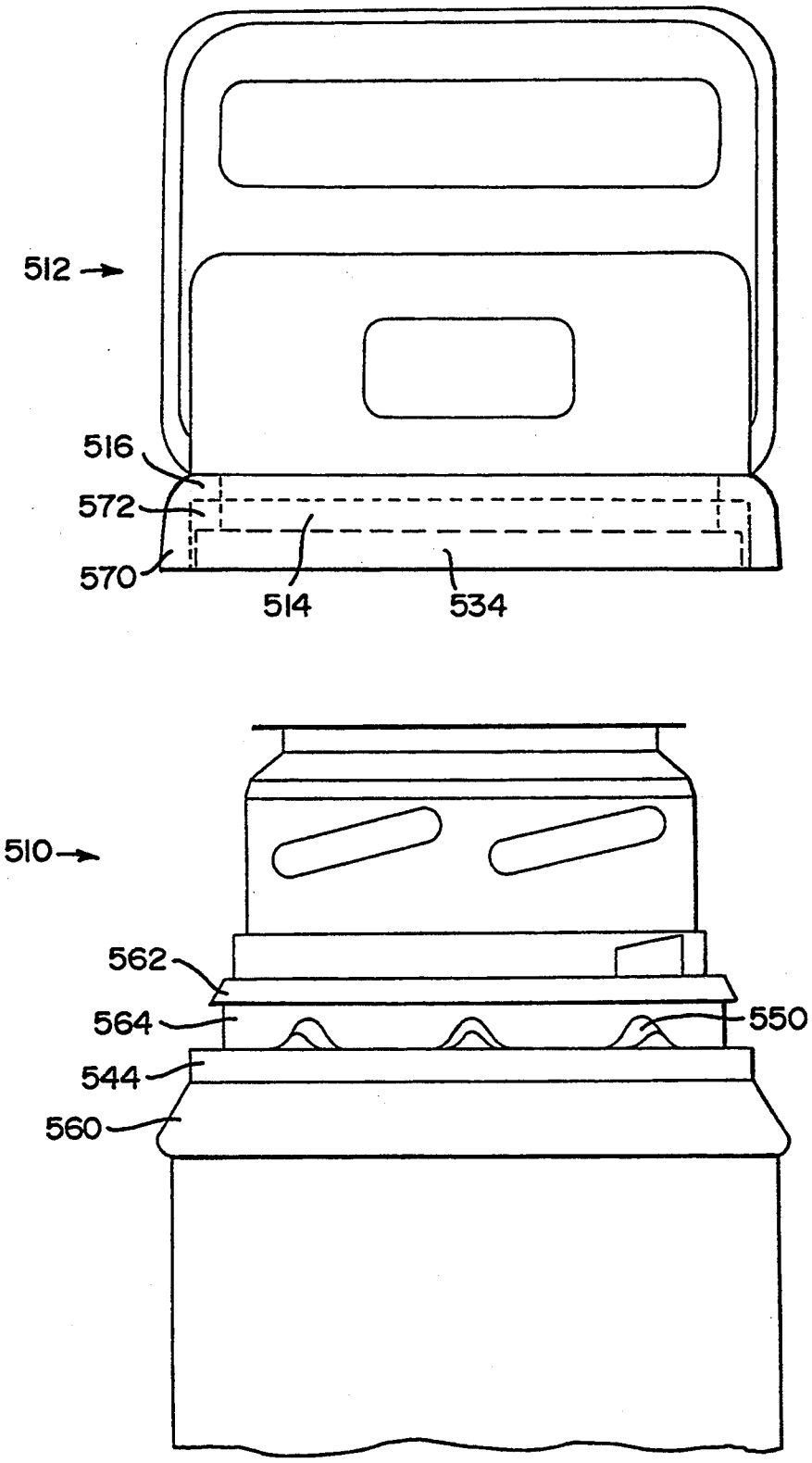
FIG. 18 is a similar view to FIGS. 16 and 17 but showing a further alternative embodiment.

The embodiments in FIGS. 16–18 relate to further features of a container closure assembly. The embodiments are particularly, but not exclusively, directed to container necks and closures which are adapted to fit one another by having complementary screw threads. The embodiments are also particularly, but not exclusively, directed to containers which are designed to be sealed against the ingress of air, or liquid, or other contaminants, when the closure is fitted to the container neck.

A problem with conventional containers is that, often, a user will overtighten a closure on the container neck to ensure that a reliable seal is formed. The closure is then difficult to remove later because it is tight. If the closure is considerably overtightened, it may be extremely difficult to remove later, and it may also cause damage by permanently deforming parts of the closure and/or the container neck.

The problem of overtightening can also occur when the closure is a child-resistant closure. Such closures rely on the closure being secured to the container neck with a predetermined degree of tightness, such that a predetermined torque must be applied to unscrew the closure. If the closure is not secured with the necessary degree of tightness, the child-resistant feature will not operate effectively. Therefore, child-resistant closures are often overtightened to ensure that the closure will operate effectively, since otherwise they closure might fail to be child-resistant.

Viewed in a first aspect, the present embodiments include an assembly comprising a container neck and a closure therefor, complementary threads on the container neck and the closure, means for positively defining a closed position of the closure on the container neck, retaining means for holding the closure, in use, in the closed position, the closure being movable between the closed position and an opened position by relative rotation through approximately 90 degrees or less, and the assembly further comprising means for preventing the closure from being overtightened substantially beyond the closed position.

Preferably, the means for defining the closed position produces a detectable "click" effect when the closed position is reached.

Preferably, the retaining means retains the closure, in use, in the closed position until a predetermined release torque is applied between the closure and the container neck.

Such an arrangement is particularly suitable for use with a child-resistant closure such as that described above in relation to FIGS. 5–12. The positively defined closed position indicates to a user that no further tightening of the child-resistant closure is required, and the retaining means holds the closure in position until a predetermined amount of torque is applied between the container neck and the closure. For example, should a child attempt to open the closure, the amount of torque that will be transmitted through the child-resistant closure will be less than the torque required to overcome the retaining means. When an adult attempts to open the closure, the adult will press the closure downwardly to engage the torque transmitting castellations in the child-resistant closure to enable adequate torque to be applied to overcome the retaining means. The invention thereby ensures that the child-resistant feature will operate effectively.

The means for defining the closed position and the retaining means may be embodied together as projections on the container neck and on the closure, the projections engaging as the closed position is reached. At least one of the projections may preferably be profiled to have a circumferential ramp surface over which the other projection can ride easily as the closure nears the closed position, and a radially inwardly extending abutment surface against which the other projection bears when the closure is to be unscrewed from the closed position.

Preferably, the closure and the container neck have complementary sealing surfaces for forming a seal when the closure is in its closed position on the container neck. The complementary sealing surfaces may advantageously form the means for preventing the closure frown being overtightened substantially beyond the closed position. The sealing surfaces preferably extend in a direction at least a component of which is lateral, or radial. With this arrangement, if the closure is overtightened beyond its closed position, the sealing surfaces will bear against each other more strongly, to thereby oppose further tightening of the closure.

An alternative arrangement is to provide stop projections on the container neck at positions circumferentially beyond the projections which define the closed position. Preferably, the stop projections have a radial abutment surface adapted to engage the projections on the closure.

Viewed in a second aspect, the present embodiments provide an assembly comprising a container neck and a closure therefor, complementary threads on the container neck and the closure, means for positively defining a closed position of the closure on the container neck, the closure having a skirt portion an inner surface of which is adapted to seal, in use, against an outer surface of the container neck when the closure is screwed into the closed position, the said surfaces forming the seal co-operating to oppose overtightening of the closure substantially beyond the closed position.

Preferably, the assembly also comprises means for retaining the closure in the closed position until a predetermined release torque is applied between the closure and the container neck. The means defining the closed position and the retaining means may be embodied as projections, as described above.

Viewed in a third aspect the present embodiment also includes an assembly comprising a container neck and a closure therefor, complementary threads on the container neck and the closure, means for positively defining a closed position of the closure on the container neck, complementary sealing surfaces on the container neck and the closure for forming a seal when the closure is screwed into the closed position, the sealing surfaces being inclined relative to the longitudinal axis of the container neck whereby the sealing surfaces co-operate to oppose overtightening of the closure substantially beyond the closed position.

Preferably, the assembly also comprises means for retaining the closure in the closed position until a predetermined release torque is applied between the closure and the container neck. The means for defining the closed position and the retaining means may be embodied together as projections, as described above.

Viewed in a fourth aspect, the present embodiments also include an assembly comprising a container neck and a closure therefor, complementary threads on the container neck and the closure, the closure having a skirt portion an inner surface of which is adapted to seal, in use, against an outer surface of the container neck, the assembly further comprising means for positively defining a closed position of the closure on the container neck at which position the skirt portion is adequately seated on the container neck to obtain a seal, whereby, overtightening of the closure on the container neck can be avoided.

Preferably, the assembly also comprises means for retaining the closure, in use, in the closed position until a predetermined release torque is applied between the closure and the container neck.

Preferably, the means for defining the closed position produces a detectable "click" effect when the closed position is reached.

The means for defining the closed position and the retaining means may be embodied together as projections on the container neck and on the closure, the projections engaging as the closed position is reached. At least one of the projections may preferably be profiled to have a circumferential ramp surface over which the other projection can ride easily as the closure nears the closed position, and a radially inwardly extending abutment surface against which the other projection bears when the closure is to be unscrewed from the closed position.

The skirt portion is preferably deformable temporarily to allow the projections to ride over one another when the closure is screwed into or unscrewed from the closed position.

The invention according to this aspect is particularly suitable for use with a child-resistant closure as described above in relation to FIGS. 5–12. The positively defined closed position indicates to a user that no further tightening of the child-resistant closure is required. The retaining means holds the closure in position until a predetermined amount of torque is applied between the container neck and the closure, thereby ensuring that the child-resistant feature can operate effectively.

In a fifth aspect, the present embodiments include an assembly comprising a container neck and a closure therefor, complementary threads on the container neck and the closure, the closure having a skirt portion an inner surface of which is adapted to seal, in use, against an outer surface of the container neck, the assembly further comprising means for defining an ultimate stop position of the closure on the container neck beyond which stop position the closure cannot be tightened further.

Such an arrangement prevents a user from overtightening the closure to such an extent that the closure cannot be removed later without extreme difficulty. The arrangement may also prevent damage such as permanent deformation of co-operating surfaces of the closure and container neck, which might otherwise occur if the closure is considerably overtightened on the container neck.

The means for defining the ultimate stop position is preferably used in combination with the means for defining the closed position, as described above in accordance with the first aspect of the invention.

In one such combination, the ultimate stop position may be defined at substantially the same position as the closed position. With such an arrangement, the closure will always be tightened up to a predetermined closed position.

In an alternative combination, the ultimate stop position may be defined at a position beyond the closed position. There will thus be defined a range of closure positions to which the closure may be tightened.

The means for defining the ultimate stop position may comprise circumferential stop means for defining a stop position on the circumference or periphery of the container neck. This may co-operate with a projection on the closure to define an ultimate angular orientation of the closure on the container neck beyond which the closure cannot be rotated. The circumferential stop means may comprise a projection having a radially outwardly extending abutment surface to abut a corresponding projection on the inner surface of the closure.

Alternatively, the means for defining the ultimate stop position may comprise axial stop means for defining an axial position beyond which the closure cannot be further tightened. For example, such an axial stop means may comprise a radially flat abutment surface on the container neck, which surface co-operates with a corresponding surface or edge of the closure.

Alternatively, the axial stop means may be embodied in the arrangement of the sealing surfaces of the container neck and closure. For example, the sealing surfaces may be tapered, or inclined at an angle, relative to the longitudinal axis of the container neck and the closure. With such an arrangement, as the closure is tightened beyond the usual sealing position, the sealing surfaces will tend to produce an axial force opposing further tightening of the closure on the container neck. The sealing surfaces may also tend to produce an increasing circumferential frictional force opposing rotation of the closure as the closure is tightened on the container neck.

Viewed in a sixth aspect, the present embodiments include an assembly comprising a container neck and a closure therefor, complementary threads on the container neck and the closure, the closure having a skirt portion an inner surface of which is adapted to seal, in use, against an outer sealing surface of the container neck, the skirt portion being tapered radially outwardly towards the open end of the closure, the sealing surface of the container neck being tapered radially inwardly towards the open end of the container neck, and the closure being movable from an opened to a closed position by relative rotation through approximately 90° or less.

Preferably, the sealing surfaces are tapered equally so as to be complementary. Preferably the taper is at an angle of between about 1° and about 45°, most preferably between about 1° and about 25°, and in particular about 4° or 5°.

Viewed in a seventh aspect, the present embodiments include an assembly comprising a container neck and a closure therefor, and a tamper evident ring, the ring being initially coupled to the closure by severable connections and being visible between the closure and the container neck to indicate that the closure has not yet been removed by a user, the arrangement being such that, in use, the connections are severed on the occasion that a user first removes the closure, the ring being subsequently movable to a position on the container neck which is clear of the closure when the closure is later replaced, to indicate that the closure has been removed from the container neck at least once.

Such an arrangement can provide a convenient indication of whether the connection between the tamper evident ring and the closure is intact. If the connection is intact, the ring will be supported between the closure and the container neck. This indicates that the container is unopened. Preferably, a portion of the ring will project below the lower edge of the closure so that the ring is plainly visible. The ring may be made in a contrasting colour to the closure and/or the container.

When the closure is removed, the connections will be severed, and the ring can drop down the neck to a position in which it is clear of, and visibly separated from, the closure when the closure is replaced later. This position of the ring indicates that the closure has been removed at least once from the container, and may indicate to a person purchasing the container that the container has been tampered with.

Viewed in an eighth aspect, the present embodiments include an assembly comprising a container neck and a closure therefor, and a tamper evident ring, the ring being slidable in a longitudinal direction on at least a portion of the container neck and being captive thereon, and the ring being initially coupled to the closure by severable connections which connections are, in use, severed on the first occasion that a user removes the closure from the container neck.

Such an arrangement ensures that the tamper evident ring cannot be removed from the container neck, for example, by a person who has maliciously tampered with the container. The tamper evident ring is thus always present on the container neck to indicate whether or not the closure has previously been opened.

Preferably, when the assembly includes a tamper evident ring, the closure is provided with an upstanding diametric handle. The handle may be in the form of an upstanding flange.

Such a handle has been found to be especially convenient for enabling the closure to be tightened or unscrewed with ease. The handle is especially convenient for use by elderly people who might otherwise have trouble in grasping the sides of the closure sufficiently strongly to tighten or unscrew the closure. The flange is particularly advantageous in enabling an elderly person to apply with ease a sufficient torque to break the severable connections between the tamper evident ring and the closure.

The tamper evident ring may be used in conjunction with a child-resistant closure, such as the design described above in relation to FIGS. 5 to 12 and/or 13 to 14. The upstanding flange handle would then also provide a convenient way for an elderly person to apply a downward pressure on the closure to engage the castellations, as well as enabling the person to apply sufficient torque to release the closure.

Viewed in a ninth aspect, the present embodiments also include a container neck and a closure therefor, the container neck having a substantially outwardly facing sealing surface near the open end of the container neck, the sealing surface being adapted to co-operate, in use, with a complementary sealing surface of the closure to form a seal, the container neck further comprising a threaded portion for co-operating, in use, with a complementary thread of the closure, the threaded portion of the container neck being further from the open end of the container neck than the sealing surface.

Such an arrangement can seal the contents of the container from any contamination such as dirt which may exist on the threaded portions of the container neck and closure.

Viewed in a tenth aspect, the present embodiments also include a container neck adapted to receive a complementary closure, the outer surface of the container neck adjacent the open end having a reduced circumference compared to the base portion of the container neck, a peelable sealing web being sealed over the open end of the container neck, an edge or edges of the sealing web projecting radially proud of the reduced circumference portion of the container neck.

Such an arrangement is advantageous in facilitating the peeling of the seal. At least one edge of the seal in effect overhangs the reduced circumference portion of the container neck to provide a tab by which the seal can be peeled off. Preferably, the entire periphery of the seal overhangs, so that an annular tab is formed around the reduced circumference portion of the container neck..

The reduced circumference portion may be formed substantially as a step, or groove, at the open end of the container neck. The size of the step, or groove, will be sufficient to enable a user to grasp the overhanging portion of the seal so that it can be peeled back.

In one embodiment, the side of the step may be chamfered radially outwardly away from the open end of the container neck.

Although the various aspects of the embodiments described above may be used independently of one another, a particularly advantageous arrangement is achieved by combining the aspects together.

In detail FIG. 16 shows a container having a container neck 510, and a closure 512 for fitting to the neck 510. The closure 512 is preferably a child-resistant closure incorporating the features shown in FIGS. 5–12 above. For clarity, the inner and outer closure parts 514 and 516 of the child-resistant closure are shown in FIG. 16, but the remaining detail of the child-resistant closure system is omitted.

The container neck 510 is formed with a base portion 518, a ¼-turn threaded portion 520, an upper sealing surface 522 and crown portion 524 at the open end of the container neck, having a reduced circumference. Two diametrically opposed, and axially chamfered, radial projections, or protrusions, 525 are formed on the base portion 518. Each protrusion has a circumferential ramp surface 525*a* and an inwardly extending radial abutment surface 525*b*.

A peelable foil sealing web 526 is sealed over the open end of neck such that its edge 528 projects radially proud of the crown portion 524. The crown portion 24 is chamfered radially outwardly away from the open end of the neck 510, to form a recess below the edge 528 of the sealing web 526. The projecting edge 528 forms a tab by which the foil can be grasped by a user's fingers, and peeled off.

The portion of the closure which is adapted to fit on to the container neck 510 (i.e. the inner closure part 514) is profiled to have an upper skirt portion 530, a ¼-turn threaded portion 532 and a lower skirt portion 534. Four inwardly projecting axial ribs 36 are provided on the lower skirt portion.

The detail of the ¼-turn threaded portions 520 and 532 of the container neck 10 and closure 12, respectively, and the axial ribs 36 and protrusions 25, are preferably as disclosed in our International application No. PCT/GB91/00850. With this arrangement, the closure 12 is movable between an opened position in which it is released from the neck, and a closed position in which it is firmly attached to the neck, by rotation through about 90° or less. The threads each have four starts.

The detail of the upper skirt portion 530 of the closure 512 and of the sealing surface 22 of the container neck 510, are preferably as described above in relation to FIGS. 1–4. With this arrangement, the inner surface of the upper skirt portion 530 is adapted to make a seal against the sealing surface 522 of the neck when the closure 512 is tightened on the neck 510. The upper sealing surface 522 is tapered radially inwardly towards the crown portion 524, and the upper skirt portion 530 is tapered radially outwardly towards the open end of the closure 512. The tapers preferably complement each other, and have a taper angle of about 4° or 5° relative to the longitudinal axis of the container neck and closure.

In use, when the closure 512 is placed over the container neck 510, the inner closure part 514 passes over the edge 528 of the sealing web 526 without applying pressure directly to the sealing web 526. This ensures that the sealing web 526 will not be damaged by the application of the closure 512 to the neck 510.

The closure 512 is rotated by hand in a clockwise direction (as viewed from above the container) through an angle of about 90° or less to screw the closure 512 on to the neck 510. As the closure 512 approaches its closed position, one of the ribs 536 will begin to ride against the ramp surface **525*a* of each protrusion 525, and the upper skirt portion 530 of the closure 512 will approach sealing contact with the sealing surface 522 of the neck 510. As the closure 512 further approaches the closed position, the lower skirt portion 534 will deform into an oval shape to allow the ribs 536 to ride easily over the ramp surfaces 525*a* of the protrusions 525. As the closure 512 approaches the closed position, the user will be alerted to this by a mild increase in the torque required to rotate the closure as the ribs 536 ride over the protrusions 525**.

When the closure reaches it closed position, the ribs 536 will pass the end of the ramp surfaces **525*a*, and will snap radially inwardly as the lower skirt portion 534** resumes it normal circular shape. In so doing, a "click" sound will be emitted, and a "click" effect will be felt through the material of the closure. This indicates to the user that the closed position has been reached, and that no further tightening of the closure is required.

In the closed position the upper skirt portion 530 of the closure 512 makes sealing contact with the sealing surface 522 of the neck, to form a reliable seal.

The engagement between the sealing surface 522 and the upper skirt portion 530 also serves to prevent the closure 512 from being overtightened substantially beyond the closed position. As the closure is tightened, the tapered sealing surfaces will bear against each other more strongly, producing a force which tends to opposed further axial movement of the closure.

The protrusion 525 also serves as a retaining means to hold the closure 512 in the closed position until a predetermined torque is applied between the inner closure part 514 and the neck 510. If the applied releasing torque is insufficient the ribs 536 will abut the radial abutment surfaces **525*b* of the protrusions 525, which thereby prevent the closure 512 from being unscrewed. When the applied torque is sufficient, the lower skirt portion 534 of the closure 512 will deform to an oval shape to allow the ribs 536** to pass over the protrusions. As explained above this ensures that the child-resistant feature will operate effectively and reliably.

The container neck 510 is also provided with a tamper-evident ring 544. The ring 544 is slidable on the base portion of the neck 510, but is held captive on the base portion by abutments (not shown). The ring 544 will initially be coupled to the closure by severable connections (shown diagrammatically at 550), which are severed on the first occasion that the closure is removed from the container neck. The detail of the ring is preferably as described hereinbefore and/or as that described in relation to FIGS. 9–11.

The closure is preferably provided with an upstanding diametric flange handle 546. The detail of this is preferably as that described above, and/or as that disclosed in our International application PCT/GB90/00850. Such a handle has been found to be especially convenient for enabling the closure to be tightened or unscrewed with ease. The handle is especially convenient for use by elderly people who might otherwise have trouble in grasping the sides of the closure sufficiently strongly to tighten or unscrew the closure.

FIG. 17 illustrates a modified embodiment very similar to that of FIG. 16. The difference is that the assembly in FIG. 17 also includes a stop means for defining an ultimate stop position of the closure 512 on the neck 510, beyond which position the closure 512 cannot be tightened further, to prevent the closure from being overtightened. In this exemplary embodiment the stop means are provided in the form of circumferential stop means for preventing rotation of the cap beyond a ultimate circumferential position.

The circumferential stop means co-operate with the ribs 536 of the closure 512 to define an angular position beyond which the closure 512 cannot be tightened further. The stop means are in the form of stop protrusions 548 arranged circumferentially beyond the protrusions 525, in a clockwise direction (as viewed from above the container). Each protrusion 548 has a radial abutment surface **548*a* against which a rib 536 will abut as the closure 512 reaches the ultimate stop position. In the arrangement shown in FIG. 17, each stop protrusion 548 is spaced by a short distance from the corresponding protrusion 525, so that the ultimate stop position is defined as being substantially the same as closed position, and the relevant rib 536 will engage between the adjacent pair of protrusions 525 and 548. The arrangement of the protrusions on the neck is thus similar to that described in PCT/GB91/00850. However, in an alternative embodiment, the stop protrusions 548 may be spaced further from the protrusions 525** so that a range of closure positions is defined.

Alternatively, the stop means could be provided in the form of axial stop means to prevent further axial movement of the closure beyond an ultimate axial stop position. For example the stop means could be formed partly by an upwardly facing radially flat surface 540 adjacent the base portion of the neck 510. This surface 540 would abut the lower edge, or rim, of the closure if the closure were tightened substantially beyond the normal closed position.

The axial stop means could also partly be formed by the engagement between the upper skirt portion 530 of the closure 512 and the sealing surface 522 of the neck 510. As the closure is tightened beyond the normal closed position, these tapered sealing surfaces will bear against each other more strongly, producing a force which tends to oppose further axial movement of the closure 512.

Although in the embodiment illustrated in FIG. 16 the inner closure part 514 projects below the edge of the outer closure part 516, it will be appreciated that in other embodiments the outer closure part may be extended downwardly so as to substantially conceal the edge of the inner closure part. This would avoid the possibility that a child might overcome the child-resistant feature of the closure by turning the exposed portion of the inner closure part 514.

A further embodiment illustrating this is shown in FIG. 18. The embodiment shown in FIG. 18 is very similar to the embodiments shown in FIGS. 16 and 17, and the same reference numerals denote features of the third embodiment which are already described in relation to the first two embodiments.

The base of the container neck 510 is formed with a shoulder 560 and a radially projecting flange 562 which together define a waist portion 564 of the neck on which the tamper-evidence ring 544 is mounted. The ring 44 is slidable axially up and down the waist portion 564, but is captive thereon.

Initially, before the container has been opened for the first time by a user, the closure 512 will be in its closed position on the container neck 510, and the ring 544 will be coupled to the bottom of the closure by severable connections (shown diagrammatically at 550). The ring 544 will be in its uppermost position abutting the flange 562, and the ring 544 will be held in that position by the connections 550 to the closure 512. The lower edge of the tamper-evident ring 544 will project slightly below the level of the edge of the closure 512, so that the tamper-evident ring can be seen. In this position, the ring indicates that the connections 550 to the closure are intact, which means that the closure 512 has not been removed since manufacture.

When a user removes the closure 512 for the first time, the severable connections 550 are severed, so that the ring 44 is no longer coupled to the closure 512. The ring 544 will slide downwardly along the waist portion 564 until the ring 544 rests against the shoulder 560. When the closure 512 is later replaced on the neck 510, the tamper-evident ring 544 will be clearly seen to be spearated axially from the bottom of the closure 512. In this position, the ring 544 indicates that the closure 512 has been removed at least once since manufacture. To a person purchasing the container, this may indicate that the container has been tampered with.

It will be appreciated that this embodiment provides a reliable and convenient indication of whether the connections to the tamper evident ring 544 are intact. Even after the connections 550 have been severed, the tamper-evident ring 544 is not removable from the container neck, and so the ring 544 cannot be discarded by a person who has maliciously tampered with the container.

The diameter of the waist portion 564 at a position adjacent the shoulder 560 may be increased slightly, so that the tamper-evident ring 544 forms a close fit:, or a friction fit, with the waist portion at the position adjacent the shoulder 560. With such an arrangement, the tamper-evident ring will tend to be retained against the shoulder by the friction fit. This can prevent the ring 544 from sliding back up the waist portion 564, even if the container is tipped on its side.

Also in FIG. 18, the design of the child-resistant closure 512 is modified compared to the arrangement in FIGS. 16 and 17. The modification consists of the lower region of the outer closure part 516 being enlarged and formed as an outer skirt 570 to cover the lower skirt portion 534 of the inner closure part 514. With this arrangement the inner closure part 514 is substantially concealed by the outer closure part, and this avoids the possibility that a child might overcome the child-resistant feature of the closure 512 by directly turning the inner closure part 514. An axial clearance 572 is left between the outer closure part 516 and the lower skirt portion 534 of the inner closure part 514, to allow room for the outer closure part 516 to be pressed downwardly when an adult desires to open the container.

FIGS. 19–22

The embodiments in FIGS. 19–22 relate to other features of a tamper-evident ring. In a first aspect, these embodiments provide an assembly comprising a container neck, a closure adapted to fit the neck, and a tamper-evident ring, the ring being initially substantially concealed by the closure when the closure is fitted to the container neck, the arrangement being such that, in use, after the occasion on which the closure is first removed from the container neck, the tamper-evident ring remains substantially visible on the container neck when the closure is replaced on the neck.

Such an arrangement provides a positive indication once the closure has been removed for the first time. The positive indication is the appearing of the tamper-evident ring itself. The invention appreciates the real essence of a tamper-evident ring, which is, to provide a warning or positive indication if the closure has been removed from the container at least once. It is not necessary to see the tamper-evident ring if the ring is properly intact.

Before the closure has been opened for the first time the tamper-evident ring, being substantially concealed by the closure, also will not give the closure an unsightly appearance.

Preferably, the tamper-evident ring is movably retained on the container neck, and the assembly further comprises releasable holding means for initially holding the tamper-evident ring in a first position in which it is substantially concealed by the closure, the holding means releasing the tamper-evident ring when the closure is first removed from the container, to allow the ring to move into a second position in which it is not substantially concealed by the closure when the closure is replaced on the container neck.

Preferably, the holding means comprises severable connections between the tamper-evident ring and the closure, which connections are completely severed when the closure is first removed from the container neck. The severable connections may be integrally formed with the tamper-evident ring and with the closure.

The tamper-evident ring may be coloured a contrasting colour to the container so that the tamper-evident ring will be clearly visible, and easily discernable at a glance, once the closure has been removed for the first time. For example, the tamper-evident ring may be coloured red as a warning colour.

The portion of the container neck on which the tamper-evident ring sits when in its visible, second position may itself be coloured a colour which contrasts both the rest of the container and the tamper-evident ring. When the tamper-evident ring is in its concealed, first position, this portion of the neck will be visible, and so it may be coloured with a safety colour, such as blue or green, to indicate that the tamper-evident ring arrangement is intact.

Preferably, the tamper-evident ring is slidably retained on a portion of the neck, and is retained thereon. This prevents a person who has maliciously tampered with the container from discarding the tamper-evident ring.

Preferably, in the second position the tamper-evident ring is separated from the bottom of the closure by a distance at least equalling the axial width of the tamper-evident ring. With such an arrangement, a user can see quite clearly at a glance that the tamper-evident ring is detached from the closure.

Preferably, the closure includes a recess, or a clearance, in which the tamper-evident ring is received when in its concealed, first position. The severable connections are preferably made between an inner wall or walls of the recess, and an edge of the tamper-evident ring. The recess may be defined by a skirt portion of the closure, which covers the tamper-evident ring.

The closure may be of any suitable type, for example, a screw-on closure, or a snap-fit closure. The closure may be a ¼ turn (or less) closure, for example as described in PCT/GB91/00850. The present embodiments are also particularly suitable for use with a child resistant closure, such as that described above in relation to FIGS. 1–4 because the tamper-evident ring is will not interfere with the axial or rotational movement of the outer part of the child-resistant closure.

In a second aspect, these embodiments also provide a closure adapted to fit a container neck, the closure comprising a tamper-evident ring and means for substantially concealing the tamper-evident ring from view when in use on a container, until the closure is first removed from the container neck.

Preferably, the concealing means comprises a recess or clearance within the closure in which recess or clearance the tamper-evident ring is substantially received, and holding means for initially holding the tamper-evident ring within the recess or clearance until the closure is removed from the container neck on the first occasion, whereupon the holding means releases the tamper-evident ring so that it will no longer be concealed within the clearance or recess when the closure is replaced.

The concealing means may be in the form of a skirt portion of the closure which covers the tamper-evident ring.

Preferably, the holding means comprises means for forming severable connections with the tamper-evident ring, which connections are intended to be severed on the first occasion that the closure is removed from the container neck.

In another aspect, these embodiments relate to an improvement in the design of severable connections for tamper evident rings. A problem with some conventional designs is that when the connections are severed, projecting "wires" or stubs remain on the surface of the ring. As well as being unsightly, such stubs may obscure a person from viewing at a glance whether the ring is detached or intact. They might also interfere with the closure when it is replaced on the container neck.

In the third aspect, these embodiments provide a container closure, a tamper evident ring formed integrally with at least a substantial part of the closure and joined thereto by one or more severable connections, one or each severable connection comprising a relatively wide or thick portion adjacent the closure and narrowing to a thin severable zone at the point where the connection joins the tamper evident ring. With such an arrangement, when the tamper evident ring becomes detached, the surface to which the severable connections were made will be relatively smooth, and in particular, there will be no projecting "wires" or stubs caused by the former severable connections.

The arrangement is particularly advantageous when the closure is shaped so that it conceals the severable connections to the tamper evident ring. When the severable connections are broken, the "wires" or stubs will remain on the closure and be concealed by the closure. For example, the closure may include a skirt portion which conceals the severable connections.

The arrangement is also particularly advantageous when the closure is designed to substantially conceal the tamper-evident ring until the closure is removed from a container neck for the first time. With such an arrangement, the "wires" or stubs from the severable connections will remain concealed when the tamper-evident ring becomes detached.

Figure 19:
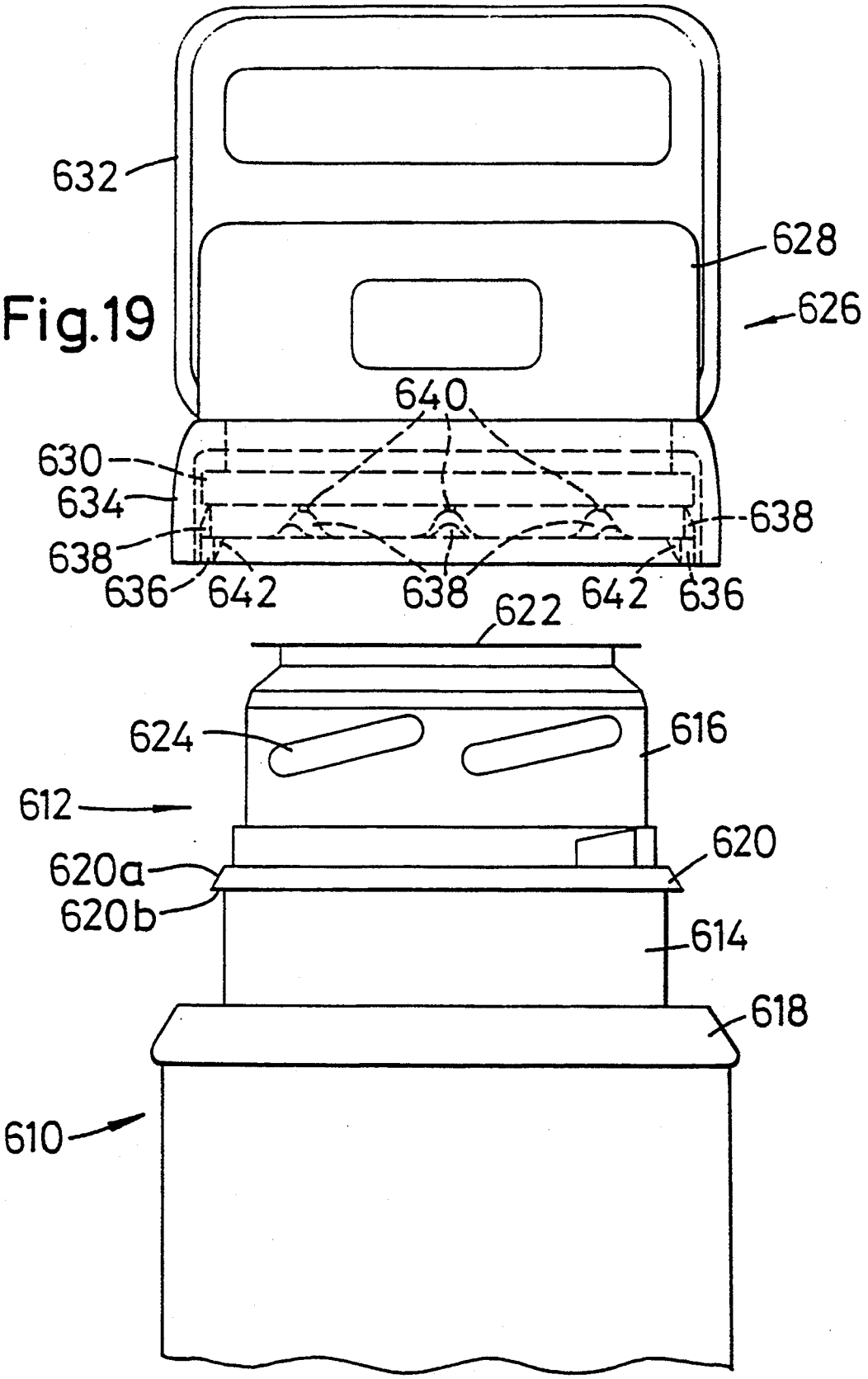
FIG. 19 is a side view of a container closure assembly with a tamper-evident ring, shown with the closure removed.
Figure 20:
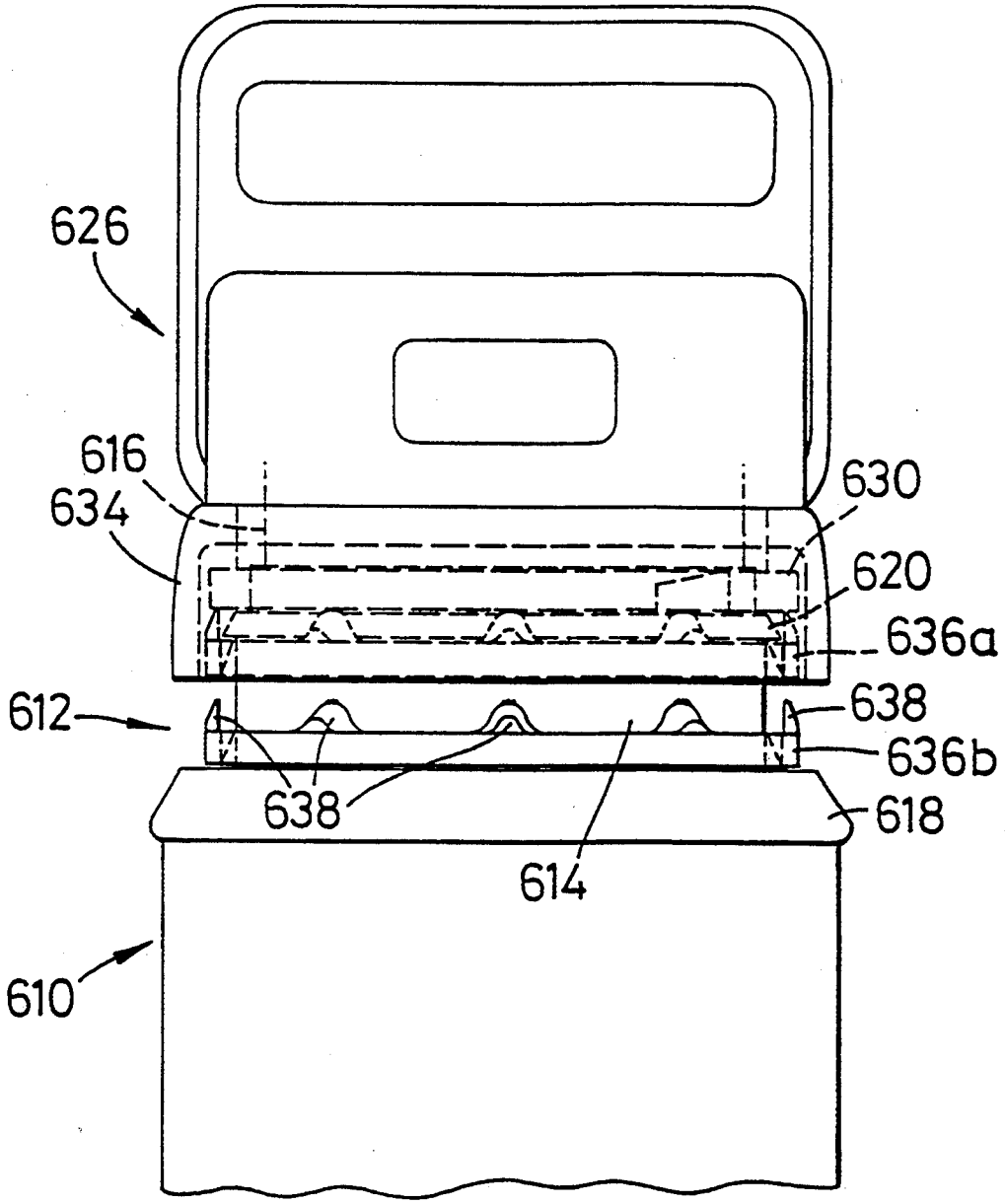
FIG. 20 is a side view of the container closure assembly of FIG. 19 shown with the closure fitted.
Figure 21:
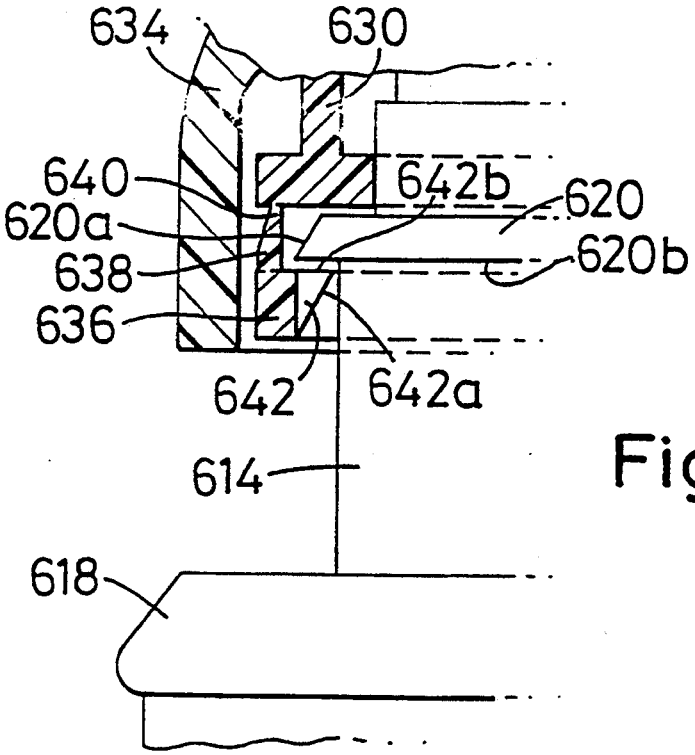
FIG. 21 is a section view showing a detail of the container closure assembly of FIG. 20.

In detail the drawings FIGS. 19 to 21 show a container 610 with a neck portion 612 which has a lower waist portion 614 and an upper crown portion 616. The waist portion 614 is defined at its lower end by a shoulder 618 which joins the neck 612 to the body of the container, and at its upper end by an abutment flange 620. The flange 620 has an radially inwardly inclined upper surface **620*a* and a flat lower abutment surface 620*b*. The waist portion 614** is adapted to receive a tamper-evident ring as described hereinafter.

The crown portion 616 of the neck 612 has a foil sealing web 622, and carries screw threads 624 adapted to secure a screw threaded closure 626 to the container 610.

In this exemplary embodiment, the closure 626 is a relevant child-resistant closure, although it will be appreciated that other types of child-resistant or non-child-resistant closures might be used instead.

The closure 626 comprises an outer closure part 628 and an inner closure part 630. The outer part 28 has an upstanding flange handle 632, and a lower skirt-portion 634. The inner part 630 is coupled internally to the outer part 628 through a child-resistant mechanism (not shown), and carries an inner screw thread (not shown) to match the screw threads 624 of the container neck 612.

The closure 626 is fitted with a tamper-evident ring 36 in the form of an annular member which is received substantially entirely within the skirt portion 634 of the closure. Attached to the top of the ring 636 and integral therewith are eight connecting members 638 which taper upwards from a relatively thick lower region into a relatively thin frangible bridge 640 attached to the bottom of the inner part 630 of the closure 626. On the radially inner face of the ring 636, extending between the connecting members 638, are eight triangular section ring retaining clips 642 which are adapted to engage the abutment flange 620 of the container neck 612. Each clip 642 is profiled with a radially inwardly tapered lower ramp surface 642*a* and a flat upper abutment surface 642*b*.

Once the desired contents have been placed in the container 610, the closure 626 is screwed on in the normal way, to secure the container in a sealed condition ready for sale. As the closure 626 is screwed down for the first time, the ramp surfaces 642*a* of the ring retaining clips 642 bear against the tapered surfaces 620*a* of the flange 620. The ring 636 deforms sufficiently to allow the ramp surfaces 642*a* to ride easily over the flange 620. When the closure reaches its fully screwed-down position, the ring 636 will be in the a first position in the neck 612 as illustrated at 636*a* in FIG. 20, fitting immediately under the flange 620.

In this condition, the tamper-evident ring 636 is substantially concealed from view by the outer part 628 of the closure 626. In this condition, the assembly indicates that the closure 626 has not been removed since it was first fitted on to the container.

When the closure 626 is unscrewed for the first time, the abutment surfaces 642*b* of the ring retaining clips 642 bear against the abutment surface 620*b* of the flange 620 to prevent the ring 636 from being removable from the neck 612 with the closure. The frangible bridges 640 act as severable connections which are severed as the closure 626 is unscrewed, so that the ring 636 becomes detached from the closure 626. Once detached, the ring 636 is free to slide axially down the waist portion 614 of the neck 612, until it rests at a second position against the shoulder 618 as denoted at 636*b* in FIG. 20.

When the closure is replaced on the neck 612, the lower skirt portion 634 of the closure no longer conceals the tamper-evident ring 636, and the ring remains visible on the neck 612 to indicate that the closure has been removed at least once since it was first fitted.

In its visible position, the tamper-evident ring 636 is separated from the bottom of the skirt portion 634 of the closure 626 by at least a distance equalling the axial width of the tamper-evident ring. This enables a user, or potential purchaser, to see clearly at a glance that the tamper-evident ring 636 is detached from the closure 626.

The ring 636 is slidable on the waist portion 614 of the neck 612, but is held captive thereon by the shoulder 618 and the abutment flange 620. This ensures that the ring 626 cannot be discarded once it has become detached from the closure 626, and the ring remains on the neck 612 as a permanent indication that the closure 626 has been removed at least once.

The tamper-evident ring 636 is coloured a contrasting colour to the rest of the container and closure, so that it will be clearly visible on the container neck once it has become detached from the closure.

It will be appreciated that this embodiment of the invention is suitable for use with a child-resistant closure, because it does not interfere with the axial movement of the outer closure part 628, and the tamper-evident ring 636 will not become detached if a child tries to open the container 610 by rotating the outer closure part 628. However, the principles of the invention are equally applicable for other types of non-child-resistant screw-on or snap-fit closures.

Figure 22:
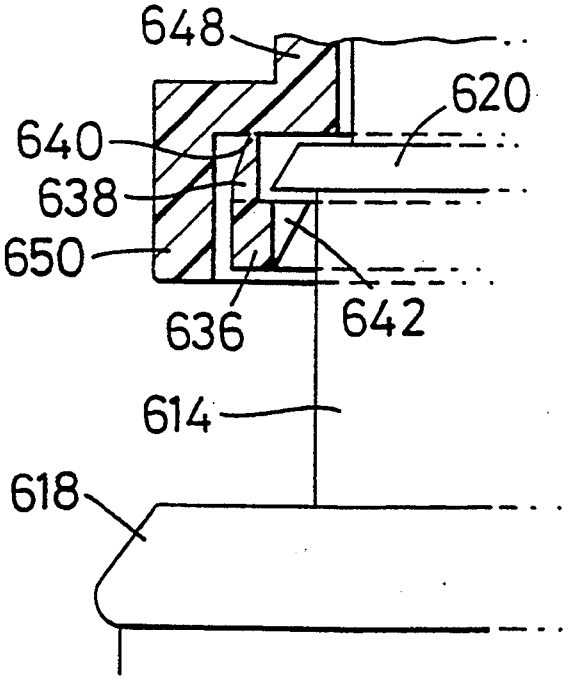
FIG. 22 is a sectional view similar to FIG. 21 but showing a modified design of container closure assembly.

FIG. 22 shows a modified embodiment including a non-child-resistant closure. In this embodiment, the inner and outer closure parts described previously are replaced by a single-part closure member 648, which may be a screw-threaded closure or a snap-fit closure. The tamper-evident ring 636 is substantially concealed within a lower skirt portion 650 of the closure, and is severably connected thereto by the thin frangible webs 640 in the same manner as described previously.

Figure 23:
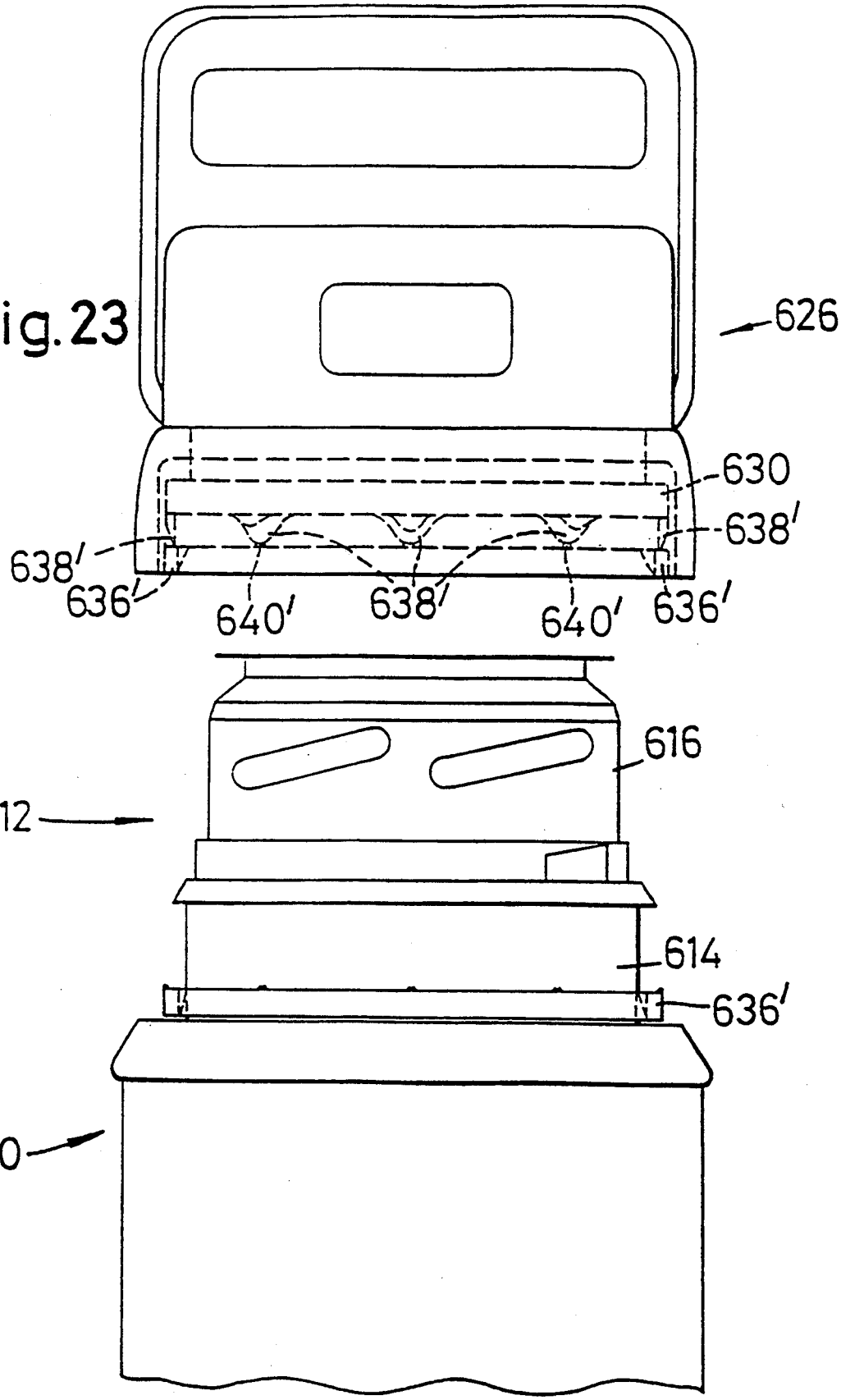
FIG. 23 is a side view of a container closure assembly with an alternative form of tamper evident ring.
Figure 24:
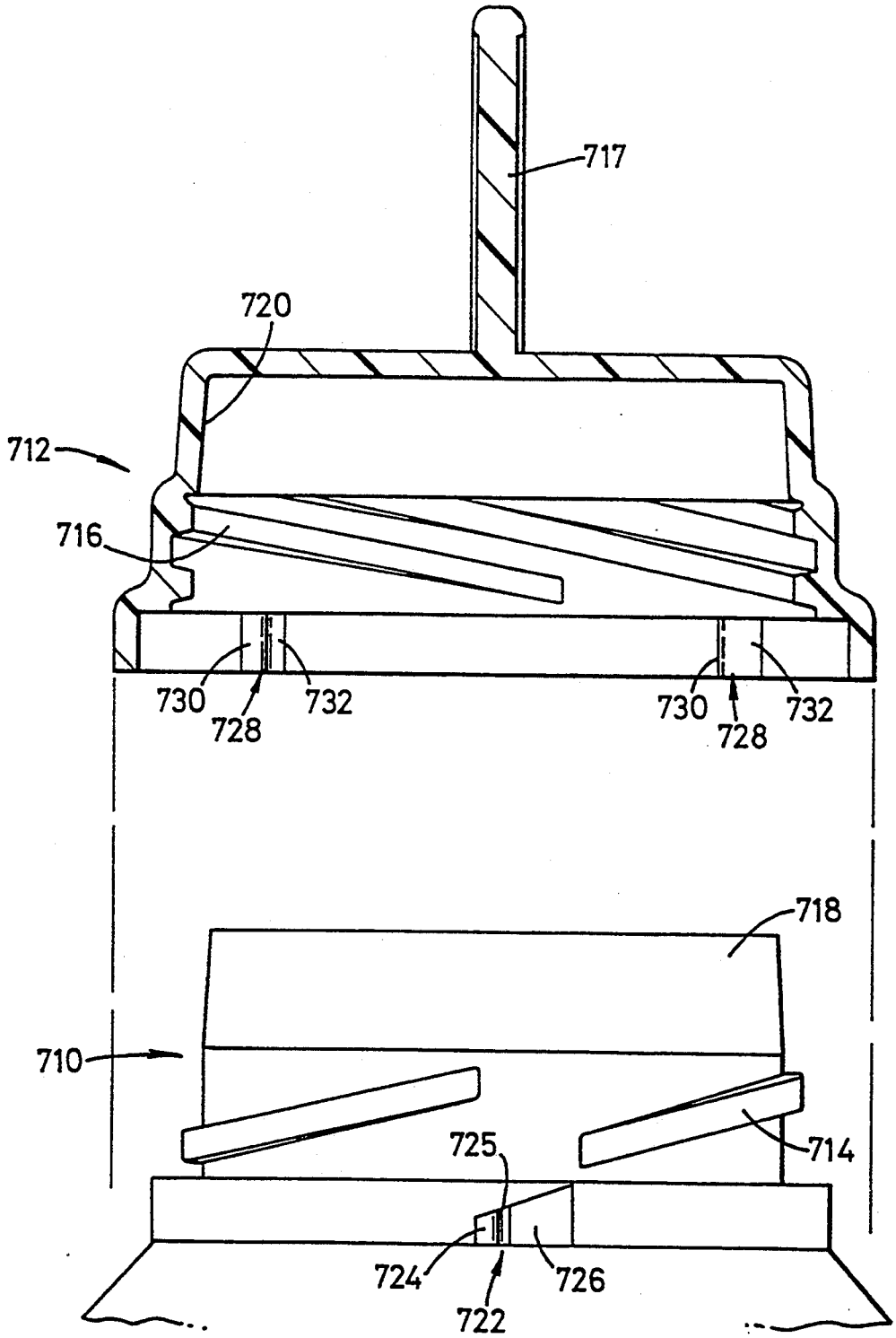
FIG. 24 is a side view of a closure and container neck with urging means, the closure being shown in section.
Figure 25:
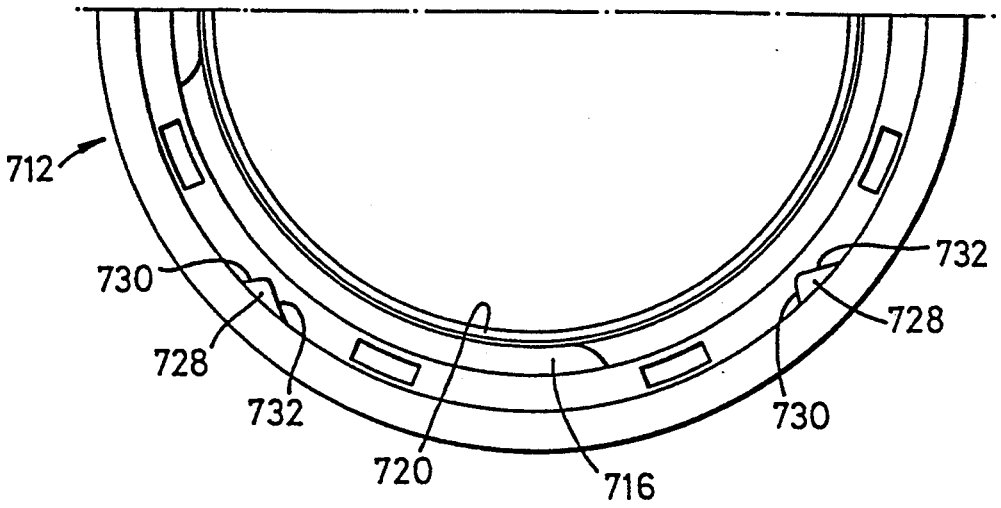
FIG. 25 is a half sectional underside view of the closure of FIG. 24.
Figure 26:
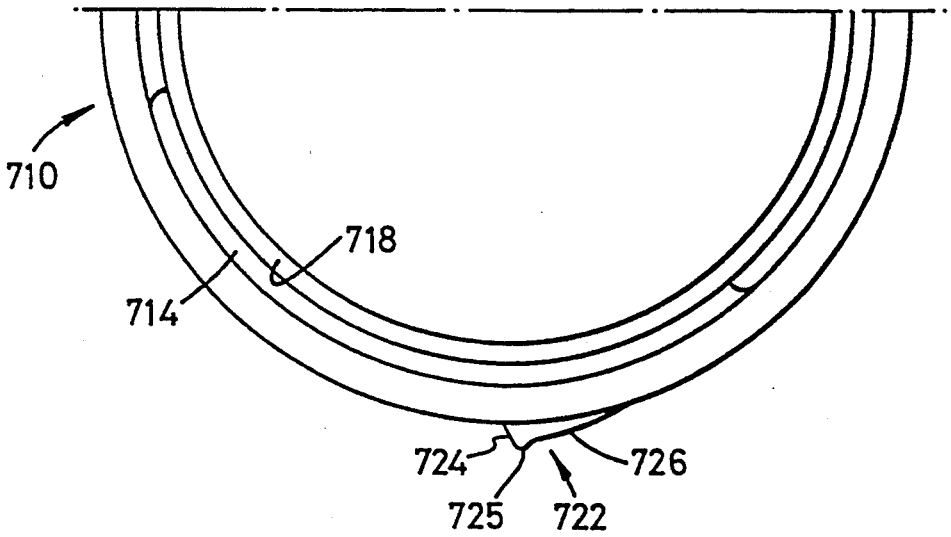
FIG. 26 is a half plan view of the container neck of FIG. 24.

FIG. 23 shows a modified design of tamper evident ring 636'. The assembly is similar to that shown in FIGS. 19 and 20, and the same reference numerals are used where appropriate. In FIG. 23, the shapes of the severable connections 638' are inverted. The connections taper from a relatively thick or wide upper region adjacent the inner closure part 630 to a thin severable bridge or zone 640' at the point where the connection joins the tamper-evident ring 636.

When the closure is removed from the container neck for the first time, the connections 638' sever at the severable zone 640', leaving the thick portions as "wires" or stubs on the inner surface of the closure. These stubs are concealed by the skirt portion of the outer closure part 628.

The tamper evident ring 636 when detached therefore has a relatively smooth upper surface. Small imperfection may occur at the places to which the connections 638' were joined formerly, but no large projecting "wires" or stubs are left on the surface of the tamper evident ring.

This modified design of severable connection maybe used with any of the embodiment in this application which incorporate a tamper evident ring. It is also of more general application for use with tamper-evident closure assemblies.

Although in the preferred embodiment described above the tamper-evident ring is coupled to the closure by severable connections which, in use, are severed by axial forces, in other embodiments, other types of tamper-evident ring may be used. For example, rings which are severed by circumferential twisting forces, or by cutting devices on the neck or closure, may be used.

FIGS. 24–29

The embodiment illustrated in FIGS. 24–29 relates to features of a screw threaded closure assembly which provides a seal between the closure and the container neck when the closure is screwed into its fully closed or sealing position.

In one aspect, it relates to an improvement for the closure assembly described above in relation to FIGS. 16–18. In the above embodiments radial stop projections have been provided on the neck and on the closure which "click" past each other as the closure reaches its fully closed position. This indicates to a person that no further tightening is required. To unscrew the closure out of its closed position, a person has to apply a predetermined release torque to "click" the projections back past each other. The projections therefore also serve to prevent the closure from becoming loose accidentally, even though the closure is not screwed down especially tightly.

With such a design, the manufacturing tolerances for the closure and the container neck may be quite critical.

The projections should be positioned and dimensioned such that they "click" past one another at precisely the position of the closure on the container neck at which the seal is formed.

Viewed in a first aspect, the present embodiment provides a container closure assembly comprising a container neck, a closure therefor, screw thread means on at least one of the closure and the container neck for retaining the closure on the container neck, sealing means for forming a seal between the closure and the container neck when the closure is at a sealing position on the container neck, and urging means co-operating between the closure and the container neck when the closure is near the sealing position for urging the closure into the sealing position independently of whether an external closing torque is being applied to the closure, and thereafter for maintaining the closure in the sealing position until a sufficient external release torque is applied to the closure.

Such an arrangement can positively retain the closure in its sealing position, without having to be manufactured to the same precision as the prior art.

Preferably, the urging means maintains a force on the sealing means when the closure is in its sealing position. This can ensure that the respective sealing surfaces of the sealing means are firmly seated against each other, even though the closure may not be screwed down especially tightly when in the sealing position. The arrangement can thus increase the force experienced by the sealing means, leading to an improved seal, without requiring the closure to be screwed down very tightly on the container neck.

Preferably, the urging means comprises first means on the container neck for co-operating with the second means on the closure, at least one of the first and second means including a ramp surface against which the other of the first and second means bears when the closure is near the sealing position, the ramp surface extending in a direction to urge the closure in a direction towards its sealing position.

Preferably, the first and second means each comprise a respective ramp surface extending in a direction to urge the closure towards its sealing position.

Preferably, the first means comprises one or more outwardly facing projections on the container neck, and the second means comprises one or more inwardly facing projections on the closure.

Preferably, the or each second means projection is mounted on a resilient portion of the closure which portion is capable of deforming to enable that projection to ride over the first means projection when the closure is screwed into, or out of, the sealing position.

Preferably, the projections include respective lead-in ramp surfaces which bear against each other, in use, to ease the projections over each other when the closure is being screwed towards its sealing position, before the aforementioned ramp surfaces which apply an urging force begin to bear against each other.

Preferably, the urging means is arranged to apply a rotational urging force to the closure relative to the container neck.

Preferably, the closure can be moved between its sealing position and a fully open position by relative rotation through 180° or less, and more preferably through about 90° or less. The rotation may, for example, be about 45°-50°.

This embodiment is also important in enabling the closure to be retained securely on the container neck during transportation, or if the container is accidentally dropped. Additionally, the invention can serve to pull automatically the sealing surfaces of the closure and container neck against each other to achieve a reliable liquid-tight and/or air-tight seal.

The sealing surfaces may comprise a tapered rim on the container neck, and a matching tapered surface on the inside of the closure. In the preferred embodiment angle of taper is about 4° or 5° relative to the longitudinal axis of the container, but of course any taper angle might be used.

In the preferred embodiment, the resilience of the material of the closure is used to supply an urging force. The closure deforms slightly from its circular shape to an oval shape when the first and second means projections engage, and the resilience of the closure tends to urge the closure to return to its circular shape.

In the preferred embodiment, the closure has a handle in the form of an upstanding diametric flange. This enables the closure to be gripped and turned easily, and is especially advantageous for disabled or elderly people.

The closure may include tamper evident means and/or child resistant means.

In one embodiment, the container neck and the closure may be manufactured to a certain tolerance such that the fully closed and sealing position of the closure on the container neck will be within a tolerance range of possible closed positions, as defined relative to the position of the urging means. The urging means is then preferably arranged such that the urging means will act on the closure at least whenever the closure is at a position within the tolerance range of possible closed positions, and more preferably when the closure is at a position which is near but outside the tolerance range of possible closed positions.

Viewed in a second aspect related particularly to this, the present embodiment provides a container closure assembly comprising a container neck, a closure therefor, screw thread means on at least one of the closure and the container neck for retaining the closure on the container neck, sealing means for forming a seal between the closure and the container neck when the closure is at a sealing position on the container neck, which sealing position is within a predetermined tolerance range of possible sealing positions, and urging means cooperating between the closure and the container neck when the closure is at a position anywhere within the tolerance range of possible sealing positions, for urging the closure into its sealing position independently of whether an external closing torque is being applied to the closure, and thereafter for maintaining the closure in the sealing position until a sufficient external release torque is applied to the closure.

With this aspect of the embodiment, closure assemblies can be manufactured which achieve a reliable seal, and which avoid overtightening, without requiring each container neck and each closure to be manufactured to strict tolerances. The container necks and the closures can therefore be made easily, and quite cheaply without prejudicing the reliability of each closure assembly. The invention can also compensate for any wear of the closure or of the container neck, if they are made of materials which will wear in use, e.g. soft plastics material.

In detail, FIGS. 24–29 show a container closure assembly in the form of a container neck 710 and a container closure 712, both made of plastics material.

The neck 710 is of generally circular section, and includes a screw threaded portion 714 which has a four-start, square section thread. The closure 712 has a complementary threaded portion 716, such that the closure can be screwed into a fully closed sealing position on the neck by relative rotation through about 90° or less. The closure 712 has a handle in the form of an upstanding diametric flange 717.

The neck 710 and the closure 712 also include complementary sealing surfaces 718 and 720, respectively, for forming a liquid-tight and/or airtight seal between the closure and neck when the closure is in its fully closed, sealing position. The sealing surfaces 718 and 720 are tapered at an angle of about 4° relative to the longitudinal axis of the neck 710. In this embodiment, the engagement of the sealing surfaces 718 and 720 when the closure 712 is screwed on to the neck 710 defines the fully closed position of the closure.

The neck 710 also carries first means in the form of two radially opposite projections 722 which extend in the circumferential direction around portions of the neck 710. Each projection 722 comprises a respective first radial ramp surface 724 forming one side of the projection 722 and a respective second radial ramp surface 726 forming the other side of the projection 722. The first ramp surface 724 has an inclination of about 30° relative to the radial direction of the neck (i.e. about 60° relative to the tangent of the neck surface), and the second ramp surface 726 has a much gentler inclination to serve as a lead-in ramp surface. Each projection 722 also includes a small ridge 725 between the ramp surfaces 724 and 726.

The closure 712 carries second means in the form of four equally angularly spaced projections 728. Each projection 728 comprises a respective first radial ramp surface 730 on one side of the projection, and a respective second radial ramp surface 732 on the opposite side of the projections. The first radial ramp surface 730 has an inclination of about 30° relative to the radial direction of the closure (i.e. about 60° relative to the tangent of the closure surface), and second ramp surface 732 has a gentler lead-in inclination of about 55° relative to the radial direction of the closure (i.e. about 35° relative to the tangent of the closure surface).

Figure 27:
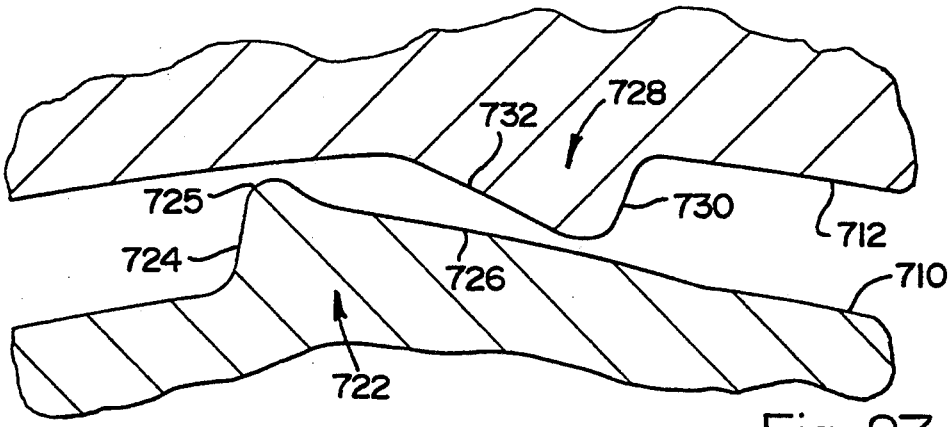
FIGS. 27–29 are diagrammatic illustrations of the urging means as the closure approaches its fully closed position.
Figure 28:
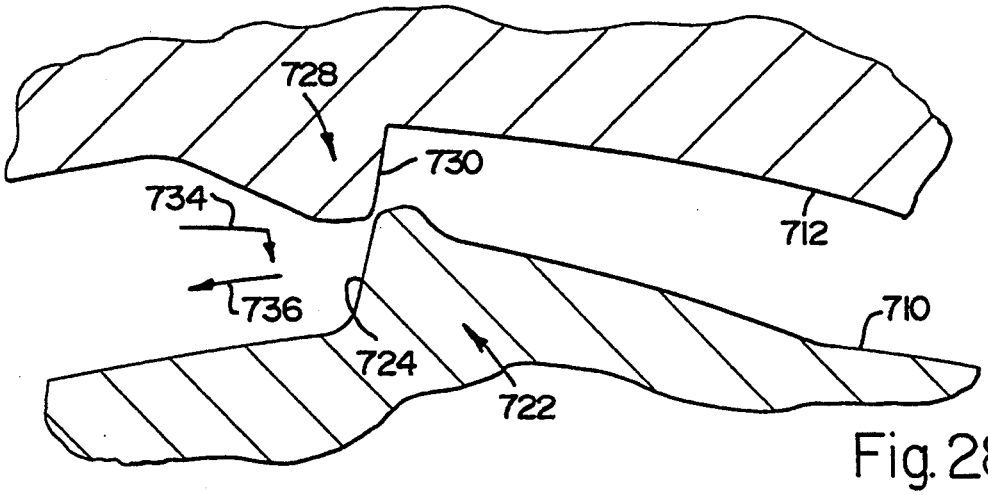
Figure 29:
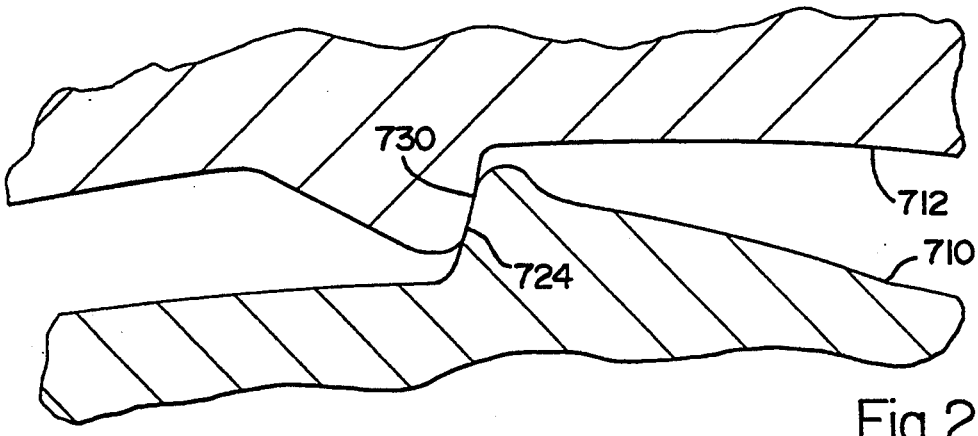

Referring especially to FIGS. 27–29, the projections 722 and 728 are arranged to form urging means which co-operate as the closure 712 nears its fully closed, sealing position to urge the closure 712 into its sealing position independently of whether any external closing torque is being applied to the closure.

As the closure 712 initially approaches its sealing position, two of the four projections 728 of the closure 712 will approach the two opposite projections 722 of the neck 710. As the closure 712 is further moved rotationally the lead-in second ramp surface 732 of the closure 712 will bear against the lead-in second ramp surface 726 of the neck (see FIG. 27). Further rotation of the closure 712 causes the wall of the closure 712 to deform slightly into an oval shape to enable the projections 722 and 728 to ride over each other. When the closure 712 reaches the position depicted in FIG. 28, the resilience of the wall of the closure 712 urges the projection 728 of the closure radially inwardly (as depicted by the arrow 734) so that the first ramp surface 730 of the closure 712 now bears against the first ramp surface 724 of the neck 710, thereby urging the closure 712 in a rotational direction (as depicted by the arrow 736).

The ridge 725 is provided to positively define the point at which the urging effect of the projections 722 and 728 takes over. The ridge 725 also causes a "click" effect which a person can feel through the closure when screwing the closure closed. The "click" effect indicates that the closure is now being urged into its sealing position, and need not be further tightened.

The projections 722 and 728 are arranged such that the fully closed, sealing position of the closure 712 (as defined by the sealing surfaces 718 and 720) will occur while the first ramp surfaces 730, 724 respectively, of the closure 712 and the neck 710 are in contact (as depicted in FIG. 29). This ensures that the closure 712 is urged fully into its sealing position, even if little or no external closing force is applied to the closure at that instant.

When in the fully closed, sealing position, the first ramp surfaces 724 and 730 of the projections 722 and 728, respectively, co-operate to maintain the closure firmly in its sealing position to prevent the closure from becoming loose, even though the closure is not screwed down especially tightly. The closure 712 is retained in this position until a sufficient external opening or release torque is applied to the closure 712 to cause the projections 722 and 728 to ride back over each other, whereafter the closure 712 can be unscrewed from the neck 710.

It will be appreciated that in the fully closed, sealing position, the urging force applied by the projections 722 and 728 urges the sealing surfaces 718 and 720 against each other. Therefore, the arrangement ensures that the sealing surfaces are seated against each other sufficiently firmly to form a reliable seal, even though the closure is not screwed down especially tightly on the neck.

The above effects are especially advantageous in the present embodiment, where the closure is movable between a fully disengaged position and a fully sealing position by relative rotation through 90° or less. The embodiment provides a container which is easily openable and closable even for elderly people, but yet which achieves a firm and reliable seal when closed.

It will also be appreciated that the exact rotational position of the closure 712 when in the fully closed, sealing position is not critical, owing to the configuration of the first ramp surfaces 724 and 730 of the projections 722 and 728, respectively. Therefore, the closure 712 and the container neck 710 can be manufactured to a much less critical tolerance than if the projections had radially flat surfaces instead of ramp surfaces.

The manufacturing tolerances of the closure 712 and the container neck 710 are such that the sealing position of the closure will lie within a predetermined tolerance range of possible sealing positions. The projections 722 and 728 are arranged such that they will co-operate to urge the closure 712 towards its sealing position whenever the closure is at a position anywhere within the predetermined tolerance range of possible sealing positions. In this exemplary embodiment, the projections 722 and 728 are arranged to co-operate to apply the urging force when the closure is at a position near, but just outside, the predetermined tolerance range of possible sealing positions.

Two second means projections 722 on the container neck 710 are adequate to retain the closure 712 in its sealing position. Four first means projections 728 are provided on the closure 712 since the closure 712 can be placed on the neck 710 in any one of the four start positions defined by the four-start thread. The second means projections 722 are chamfered axially to prevent the first means projections 728 from coming into contact with them until the closure nears its sealing, fully closed position.

It will be appreciated that the closure described above could also be supplemented by child-resistant means to make the closure child-proof, and/or by tamper-evident means to indicate whether the container has been opened since the closure was fitted during manufacture. Suitable child-resistant and tamper evident mechanisms are, for example, described above.

FIGS. 29–31

Figure 30:
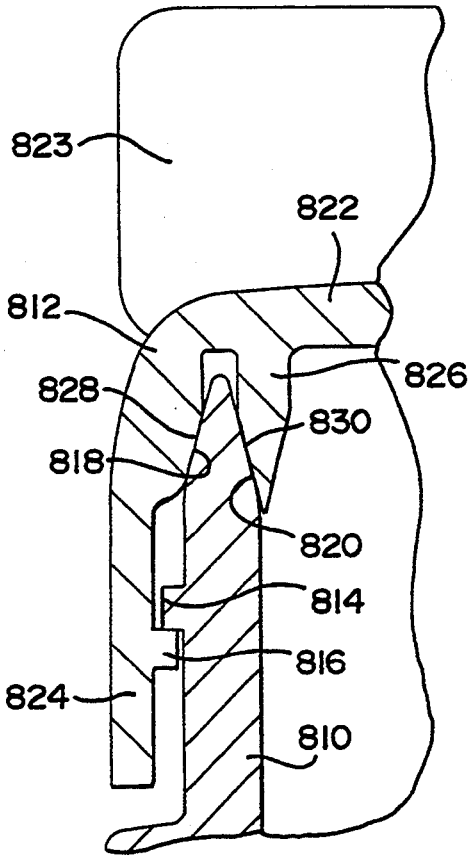
FIG. 30 is a sectional view of part of a screw threaded closure assembly with sealing means.
Figure 32:
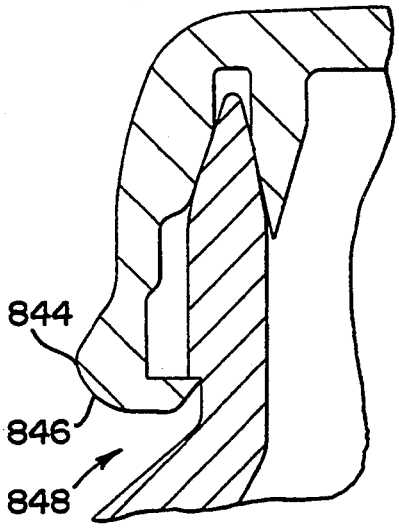
FIG. 32 is a sectional view of a modified closure assembly to that of FIG. 31.
Figure 31:
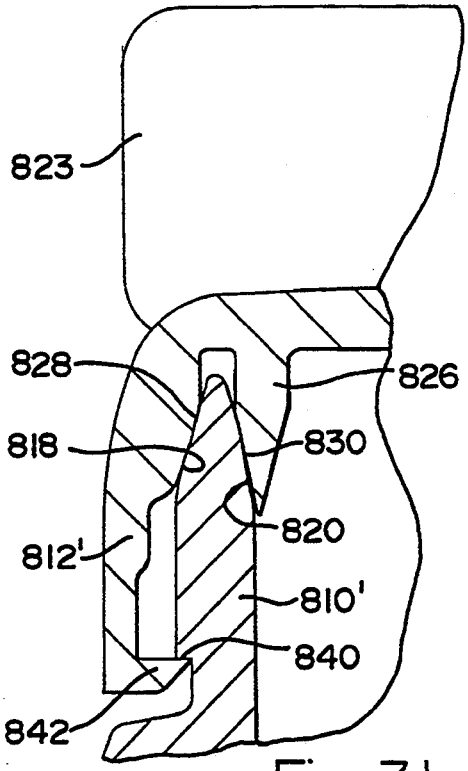
FIG. 31 is a sectional view of a closure assembly similar to that of FIG. 30 but with a snap fit closure.

The embodiments shown in FIGS. 30–32 relate to features of a container closure assembly for forming a reliable seal when the closure is fitted to the container neck.

Such closure assemblies are often used in containers for food, drinks, medicines or other perishable or contaminable contents, to preserve the quality of the container contents.

One known arrangement for a sealing closure assembly is for the closure to be provided with an annular sealing wall which fits inside the container neck, and forms a seal against the radially inner surface of the neck when the closure is fitted on the neck.

A problem which may be encountered with conventional closure assemblies, such as that described above, is that with a screw threaded closure, for example, the closure has to be screwed down tightly to ensure that a reliable seal is formed. This means that the closure may be difficult to remove later, and it may also cause damage by deforming the engaging surfaces of the closure and the neck.

Viewed in a first aspect the present embodiments provide a container closure assembly comprising a container neck, a container closure, means for retaining the closure in a closed position on the neck, first sealing means on the closure adapted to seal against an outer surface of the neck when the closure is in its closed position, and second sealing means on the closure adapted to seal against an inner surface of the neck when the closure is in its closed position.

With such an arrangement, the closure when fitted to the container neck forms a seal against both the inner and outer surfaces of the container neck. This sealing arrangement can provide a more reliable seal than a conventional seal, without requiring the closure to be fastened down very tightly on the container neck.

The outer surface of the neck against which the first means is adapted to form a seal may be a circumferentially facing outer surface, or it may alternatively be any other surface, such as a top surface, on the outside of the container neck.

Preferably, the first and second sealing means form respective seals with the container neck at positions which are substantially directly opposite each other. This can further improve the sealing effect by "wedging" the wall of the container neck between the first and second means of the closure.

Preferably, the first sealing means comprises an inner surface of a skirt portion of the closure, which inner surface is adapted to seal against the neck. The outer surface of the neck may include an outwardly tapered portion, and the inner surface of the skirt portion of the closure may be adapted to form an interference fit with the outwardly tapered portion of the neck. The skirt portion of the closure may include an inwardly tapered surface to form a complementary fit with the outwardly tapered portion of the neck.

The angle of taper of the tapered portion of the neck may be between about 1° and 45°, preferably between about 1° and 25°, and in particular about 4° or 5°.

The second sealing means preferably comprises a plug portion of the closure, which plug portion is shaped to fit inside the container neck, the circumferential surface of the plug portion being adapted to seal against the inner surface of the neck.

Preferably the inner surface of the container neck includes an outwardly tapered portion, the circumferential surface of the plug portion being adapted to form an interference fit with the tapered portion of the neck. The plug portion may include an inwardly tapered surface to form a complementary fit with the outwardly tapered inner surface of the neck. The angle of taper may be between about 1° and 45°, preferably between about 1° and 25°, and in particular about 4° or 5°.

The angle of taper of the inner surface of the neck preferably matches the angle of taper of the outer surface of the neck.

In the case where the container neck and the closure are of circular section, the means for retaining the closure in its closed position preferably includes a thread. Most preferably a thread is provided on the closure and a complementary thread on the container neck. As illustrated in one of the detailed embodiments, the threads are preferably of square section to provide a positive fit. The threads are preferably arranged so that the closure can be moved between the closed position and an open position by relative rotation through 180° or less, for example, through 90°. The invention is suitable for such an arrangement because it does not rely on the closure being fastened down especially tightly to achieve a reliable seal. The closure may include features described in PCT/GB91/00850. The closure may be a child-resistant closure, for example as described hereinbefore.

Alternatively, the retaining means might comprise a snap fit connection between the closure and the container neck.

The closure may comprise a handle in the form of an upstanding diametric flange. Such a handle is particularly convenient for use with both a screw threaded fastening closure and a snap-fit fastening closure. The handle enables a person to grip the closure easily by hand to remove, or fasten, the closure.

Viewed in a second aspect, the present embodiments provide a closure adapted to fit a container neck, the closure comprising first sealing means adapted to seal against an outer surface of the neck when the closure is in a closed position on the neck, and second sealing means adapted to seal against an inner surface of the neck when the closure is in the closed position on the neck.

The first sealing means may comprise an inner surface of a skirt portion of the closure, which inner surface is adapted to seal against the neck. The skirt portion may be tapered inwardly, for example, to complement an outward taper of the neck.

The second sealing means may comprise a plug portion of the closure, which plug portion is shaped to fit inside the container neck, the circumferential surface of the plug portion being adapted to seal against the inner surface of the neck. The surface of the plug portion may be tapered, inwardly for example, to complement an inward taper of the inner surface of the neck.

The first and second sealing means are preferably directly opposed so that when the closure is fitted to a container neck, the first and second sealing means form respective seals with the neck at positions which are substantially directly opposite each other.

The closure may further comprise a screw thread, or snap-fit connecting means, for retaining the closure on the neck in the aforementioned closed position. The closure may comprise a handle in the form of an upstanding diametric flange to enable the closure to be gripped easily by hand to remove, or fasten, the closure.

Referring to FIG. 30, a container neck 810 is shown with its closure 812 in its closed, sealed position on the neck 810. In this exemplary embodiment, both neck 810 and the closure 812 are of circular section and are provided with complementary screw threads 814, 816, respectively. The threads 814 and 816 are of square section to provide a positive fit. The threads are arranged such that the closure can be moved between the closed position and an open position by relative rotation through about 90° or less.

The upper portion of the neck 810 is tapered outwardly on its outer surface 818, and on its inner surface 820. The angle of taper is about the same on both surfaces 818 and 820, and is approximately 4° or 5°.

The closure 812 consists of a crown portion 822, a handle portion 823, a skirt portion 824, and an annular plug portion 826 fitting inside the container neck 810. The handle portion 823 is in the form of an upstanding diametric flange, which enables a person to grip the closure easily to fasten, or remove, the closure. The skirt portion 824 includes first sealing means in the form of a first sealing surface 828 which is adapted to form an interference fit seal against the radially outer surface 818 of the neck 810. The first sealing surface 828 is tapered inwardly to complement the taper of the outer neck surface 818. The plug portion 826 includes second sealing means in the form of a second sealing surface 830 which is adapted to form a seal against the radially inner surface 820 of the neck 810. The second sealing surface 830 is also tapered inwardly to complement to taper of the inner neck surface 820.

In this embodiment the first and second sealing surfaces 828 and 830 of the closure form seals against radially opposite faces of the container neck at positions which are substantially directly radially opposed. The upper portion of the neck is "wedged" between the sealing surfaces, which achieves a particularly reliable and effective seal.

It is to be noted, however, that in an alternative embodiment of this invention, the first and second sealing surfaces might not be directly radially opposed. For example, the first sealing surface 828 could instead be arranged below the screw threads 814.

The container neck and the closure are preferably made of material which enables a reliable seal to be formed by the interference fits between the sealing surfaces of the closure and the container neck.

FIG. 31 shows a similar arrangement of sealing surfaces for a snap-fit closure assembly. Where appropriate, the same reference numerals of FIG. 30 are used to denote corresponding features of FIG. 31. The main difference in FIG. 31 is that the screw threads are replaced by a lip 840 on the container neck 810, and an inwardly facing deformable snap-fit projection 842 on the closure 812 for engaging under the lip 840. The closure 812' is made of a deformable material such as deformable plastics. The arrangement includes the same first and second sealing means as described above to ensure that a reliable seal is made when the closure is fitted to the container neck.

FIG. 32 illustrates a modification of the embodiment in FIG. 31. In the modified embodiment, the flange handle is replaced by an annular protrusion 844 which projects radially outwardly near the lower edge 846 of the closure. The wall of the container neck is inclined to provide a clearance 848 under the lower edge 846 of the closure. With this arrangement, to remove the closure from the container neck, a person can grip around the annular protrusion 844, and under the lower edge 846 of the closure, to get a good grip.

Although in the detailed embodiments described above, the first and second sealing means comprise sealing surfaces of the closure, in other embodiments sealing elements might be fitted to the closure to form the first and second sealing means. For example, sealing elements made of compressible material, e.g. rubber, could be used.

Although in the detailed embodiments described above, both the inner and outer surfaces of the neck include tapered portions, in alternative embodiments, only one, or possibly neither, of the outer surfaces might be tapered. The sealing surfaces of the closure might still be tapered, or instead one or both of the sealing surfaces might not be tapered. The actual arrangement used can be varied to meet the requirements of the container and closure for a particular application.

FIGS. 33–36

The embodiments shown in FIGS. 33–36 relate to a sealable container, and to a method and apparatus for forming such a container. In particular, the invention relates to a container having an opening which is intended to be sealed by a closure releasably retainable over the opening.

Such containers are commonly made of plastics material which is blow-molded, since this is the most cost-efficient method of production. The mold is made in two separable halves to enable the mold parts to be removed easily from the container once it has been formed.

On the other hand, the closures for the containers are normally injection molded, to obtain the necessary shape detail on the inner surfaces of the closures. This interior detail cannot be achieved easily with blow molding.

We have appreciated that a problem sometimes exists with such blow-molded containers, which hinders the formation of a reliable seal when the closure is fitted over the opening. The problem is caused by the formation on the exterior of the container of a seam running along a line corresponding to the join line of the mold halves. The seam results from the imperfect fitting together of the mold halves when the plastics material is blown forcibly against the mold surfaces. The seam commonly comprises a slightly projecting ridge, or a slight step in the surface of the plastics material.

The seam hinders the formation of a reliable seal preventing the closure from fitting intimately against the surface of the container immediately either side of the seam. This problem can be particularly important for containers for foods, drinks or medicaments, which should be sealed in a liquid-tight or an air-tight fashion by the closure to prevent the container contents from being contaminated by, for example, dirt or moisture. The problem lies in the production of the container, since the injection molding process for forming the closure does not cause the production of a seam on the closure.

Viewed in a first aspect, the present embodiment provides a method for forming a container having an opening which is intended to be sealable by means of a closure releasably retainable over the opening, the method comprising forming a seamless first portion of the container by a first process, which first portion includes a sealing surface extending around the opening, the sealing surface being intended to seal in use against a said closure, and forming a second portion of the container by a second process, which second portion may include a seam or seams.

With this embodiment, a seamless sealing surface around the opening is formed, which can match the normally seam-free surface on the inner surface of the closure. The seal is thereby improved by using two seam-free sealing surfaces.

The container is preferably formed of plastics material. The first and second portions are preferably integrally formed.

The embodiment appreciates that the requirements for forming the first portion of the container generally conflict with the requirements for forming the second portion. For example, blow-molding is not ideal as the first process (for forming the first portion) as this causes seams as in the prior art. The first process preferably comprises injection molding as this technique avoids seams being produced.

On the other hand, injection molding is not ideal as the second process (for forming the second portion of the container) since this requires mold parts to define both the interior and exterior surfaces of the container. In the case of a container having a relatively narrow neck joined to a relatively wide body, a very complicated and expensive injection mold would be required.

Preferably the second process comprises blow-molding as this enables relatively elaborate exterior profiles and shapes to be formed usually with only a two-part mold. The blow-mold could be formed in more parts if desired. The resulting formation of seams on the second portion does not affect the improved sealing characteristics achieved by the seamless first portion of the container.

The first portion of the container may include the opening. The second portion of the container preferably includes the majority, if not all, of the body of the container.

The first portion of the container may comprise generally a neck, or at least the upper portion of a neck, of the container. In particular, the first portion may consist of the portion of the neck from the container opening to the sealing surface. The second portion consists of the remainder of the neck below the sealing surface and the body of the container.

The neck may include means for releasably retaining a closure on the neck to cover the opening. Such means may comprise a screw thread, or snap fit means. In the detailed embodiment, the portion of the neck carrying the retaining means is blow molded.

The method may comprise injection molding the first portion of the container around a hollow floating mandrel, and blow-molding the second portion of the container by blowing gas through the hollow floating mandrel.

Viewed in a second aspect, the present embodiment provides a container having an opening intended to be sealable by means of a closure releasably retainable over the opening, the container comprising a seamless first portion including a sealing surface extending around the opening, the sealing surface being intended to seal in use against a said closure, and a second portion which may include a seam or seams.

The first portion may include the opening. The first portion may have been formed by injection molding. The second portion may have been formed by blow-molding.

The container is preferably formed of plastics material, the first and second portions being integrally formed.

Viewed in a third aspect, the present embodiment provides means for forming a container as aforesaid by a process of injection molding and blow molding, the means comprising a floating mandrel about which a seamless first portion of the container can be injection molded, the first portion of the container including an opening and a sealing surface extending around the opening, the sealing surface being intended in use to seal against a releasably retainable closure for sealing the opening, and the floating mandrel being hollow to enable gas to be blown through the mandrel for blow-molding a second portion of the container.

In detail FIGS. 33 and 34 show a plastics container which comprises a neck 910 integrally joined to a body 912. The neck is of generally circular section, and includes an upper region 910*a* comprising an opening 914 over which a secondary sealing web (not shown) may be secured, an upper shoulder 915, and a slightly tapered sealing surface 916 extending around the neck below the shoulder 915.

The neck also includes a lower region 910*b* which includes a screw thread 918, a projecting collar 919 and a waist region 921 under the collar 919 which is adapted to retain a tamper-evident ring (not shown). The neck is intended to receive a closure (not shown) which can be threadedly retained by the screw thread 918. The sealing surface 916 is intended to form an interference fit seal with a corresponding sealing surface (not shown) within the closure. The upper region on 910*a* of the neck 910 forms a first portion of the container which is of seamless construction, and in particular the sealing surface 916 is seamless. The lower region 910*b* of the neck 910 includes a seam 920 running axially down two opposite sides of the neck. As described below, the seam 920 is a result of the blow-molding process used to form the body 912 and the lower region 910*b* of the neck. In FIG. 33, the position of the seam 920 is also denoted by the broken line visible through the opening 914.

The body 912 is of generally rectangular section, and includes the seam 920, running down diagonally opposite corners of the body 912 and across the base of the body (not shown). The lower region 910*b* of the neck 910 and the body 912 together form a second portion of the container which, in this exemplary embodiment, is produced with a seam 920.

The profile of the container neck is thus very similar to the embodiments described hereinbefore in relation to the tamper-evident ring feature, the square-section thread feature, the inclined sealing surface feature, and the sealing web feature. The neck is suitable for receiving a closure having features described in PCT/GB91/00850 and/or with a child-resistant feature and/or fitted with a tamper-evident ring.

Referring to FIG. 35, the upper region 910*a* of the neck 910 of the container is formed by injection molding plastics material around a hollow floating mandrel 922. (For clarity, the outer mold part used in the injection molding process is not shown in FIG. 35). The floating mandrel 922 defines the opening 914 of the neck 910. Adjacent the end of the mandrel 922 a "bung" 923 of plastics material is formed extending across the wall of the neck 910. It is from this bung 923 of material that remainder of the neck 910 and the body 912 will be formed.

Referring to FIG. 36, the remainder of the neck 910 and the body 912 of the container are formed by inserting the floating mandrel into the mouth of a blow-mold 924*a*, 924*b* and blowing hot air through the centre of the floating mandrel (as depicted by the arrow 926) to blow the material of the bung 923 outwardly against the surfaces of the mold 924*a*, 924*b*. The mold is made in two separable halves 924*a* and 924*b* to facilitate removal of the mold once the body 912 has been formed.

The seam 920 is formed as a consequence of the imperfect fitting together of the mold halves 924*a* and 924*b* which inevitably occurs when the plastics material is blown forcibly against the surfaces of the mold. The seam 920 may be in the form of a slightly projecting ridge corresponding to the join line of the mold halves 924*a* and 924*b*, or it may be a slight step in the surface of the plastics material at the join line.

It will be appreciated that with the construction of the container as described in this embodiment, the upper region of the neck 910 and in particular the sealing surface 916 are produced without a seam which might otherwise interfere with the sealability of the container when the closure is screwed onto the neck 910. On the other hand, the remainder of the container is produced by a process which is more suitable to forming an elaborate external profile.

In the present exemplary embodiment, the closure (not shown) is intended to be attachable to the thread 18 of the neck by limited rotation through about 90° or less, between a fully open and a fully closed position. With such an embodiment, it is important that a reliable seal be formed after the closure has been rotated through only about 90°. The present invention enables perfectly fitting sealing surfaces (916) to be provided to accomplish this despite the limited available movement of the closure.

Although in the preferred embodiment, the container is formed of plastics material, it will be appreciated that the other moldable materials could be used instead.

In the preferred embodiment as shown in the drawings, the inner surface of the neck 910 diverges away from the opening 914. The floating mandrel 922 has a flared "cone" shape to define such an inner surface of the neck 910. The mandrel can be extracted from the neck 910 through the opening 914 by relying on the expandability and resilience of the plastics material to return the neck 910 to its intended molded shape.

FIG. 37

In addition to any of the embodiments described above, the container may be provided with an optional insert which can be fitted through the neck of the container. The insert reduces the available capacity of the container. This is useful when the container is required to hold only a relatively small volume of contents, but allows the same container shape to be used for easy opening and other features described above. The container may, for example, be of rectangular section to enable a person to grip the container body easily. Details of an insert are described, for example, in PCT/US91/00850.

Figure 37:
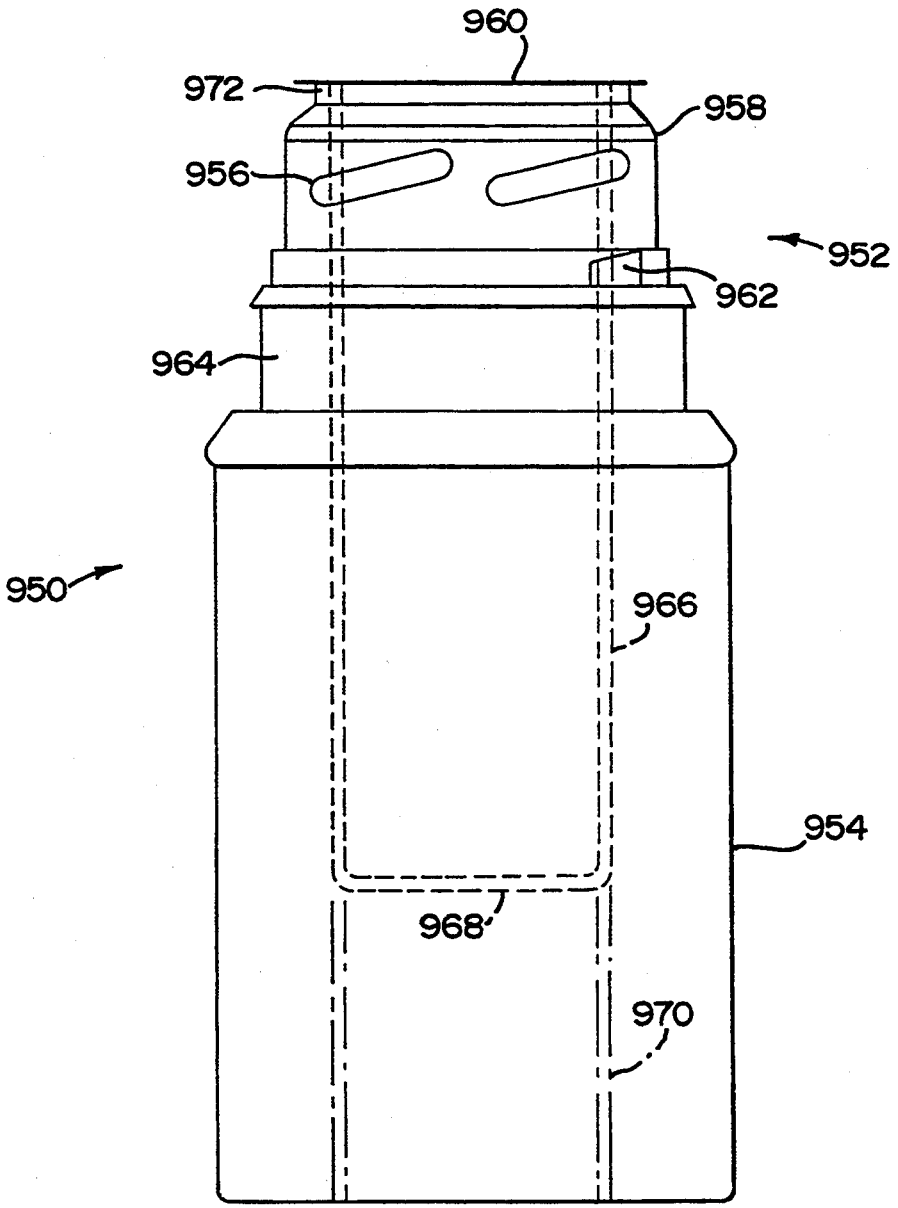
FIG. 37 is a side view of a container fitted with an optional liner to reduce the container capacity.

The embodiment in FIG. 37 illustrates independently an optional insert or liner for the container.

This embodiment provides a container comprising a container portion of a first cross sectional area and a neck of a second cross-sectional area less than the first cross sectional area, and an open tubular liner or inner sleeve of less capacity than the container and capable of insertion into the container through the neck whereby the container can be used with the full container capacity or optionally with a reduced capacity of the liner.

This embodiment enables the same container size to be used for a number of reduced capacities of contents. The embodiment is particularly useful when the container comprises features described hereinbefore for easy-opening of the container for elderly or handicapped people. The exterior shape of the container preferably enables the container to be gripped easily. For example it may be polygonal in section, e.g. rectangular or square. The size of the container preferably enables it to be held easily by hand. By using the liner of the present embodiment, this container body can be used to contain smaller volume of contents than the full capacity of the container. This might be desirable, for example, for tablets or other medicaments.

Therefore, this embodiment appreciates that while it might be desirable to use a relatively large container for easy opening, the capacity of such a container may be inappropriate for small quantity contents.

The liner also does not interfere with features described hereinbefore, such as a removable sealing web, and sealing surfaces of the container and its closure.

Preferably, the liner is cylindrical in shape, and dimensioned to fit against the inner surface of the neck. The liner thus cuts off access through the neck to the volume outside the liner. The liner may be dimensioned to form a tight fit or a seal with the inner surface of the container neck. The liner may be open at both ends and extend to the bottom of the container. Alternatively, the liner may include a base wall. This latter design enables different lengths, or sizes, of liner to be provided which enable different capacities to be achieved using the same container body.

The liner is preferably held in place in the container to prevent the liner from coming out accidentally. This may be achieved by a friction fit in the neck. Alternatively, the liner may have a projection such as an annular bead or flange on its outer surface which forms a snap fit into a corresponding recess on the neck, or a snap fit behind a corresponding projection, for example a bead, on the neck.

The liner is open at its end adjacent the container neck and relies on sealing features of the container and its closure when the container is to be closed. This is particularly advantageous the container and the closure include other features of this invention as described hereinbefore.

In detail, FIG. 37 illustrates a container 950 having a neck 952 and a body 954. The neck 952 is cylindrical in section and is of smaller cross-section than the body 954 which is of rectangular section. The container neck includes a four-start square section thread 956, a tapered sealing surface 958 and is sealed by a removable sealing web 960. The neck also includes stop means projections 962 and a portion 964 adapted to receive a tamper evident ring (not shown). The neck is intended to be sealed by means of a closure (not shown) which may be as illustrated in any of the previous embodiments.

As illustrated in phantom, the container includes a liner or insert in the form of a tubular sleeve 966 which is inserted through the container neck. The liner 966 is cylindrical to seal against the inner surface of the neck. In one form, the liner has a base 968 to provide a container of volume less than the full capacity of the body 954. In this way, the container 10 can be used to contain different volumes, and the sleeve volume can be different, for example, by making the sleeve in different lengths. In an alternative form, as denoted by the numeral 970, the liner may be open at both ends and extend to the bottom of the body 954 of the container. The liner may be secured in place by co-operating profiles or projections (not shown) on the outer surface of the liner and the inner surface of the neck.

A small annular groove or recess (not shown) may be formed in the outer surface of the rim of the neck 954, almost immediately adjacent the open end of the neck 954 sealed by the sealing web 960, to provide a drip proof rim for the neck. Alternatively, the upstanding portion 972 of the rim of the neck immediately adjacent to its open end may itself form a drip-proof rim. The angle between the portion 972 and the tapered portion of the neck acts to collect any drips. The portion 972 may be modified to be inclined outwardly towards the open end to enhance the drip-proof feature of the rim.

FIGS. 38–39

This embodiment relates to a container neck and a container closure, and also to a container and closure therefor.

Containers having closures are well known and have a wide variety of uses. For example, they may contain medicines or pharmaceuticals. They may contain drinks, such as carbonated or non-carbonated water, colas and the like, or wines or spirits (e.g. gin or whisky). Again they may contain petrol, oil, or household preparations or chemicals such as hair care products, detergents, bleaches and the like. The present invention is applicable to all of these areas of use and many others besides.

The conventional containers mostly have simple screw closures, which suffer from various disadvantages. For example, the closures are difficult for elderly or infirm people to operate because quite a significant torque is required and because the closure needs to be turned through more than one revolution relative to the container either to remove the closure or to replace it.

If the container is a drinks container, it may be difficult for the user to seal it satisfactorily. On the one hand, the user may under-tighten the closure on the container (and thus not create an effective seal between container and closure), in which case the drink would not retain its original quality. A soft drink or still wine would not stay fresh; a carbonated beverage, sparkling wine or champagne would lose its fizziness, and spirits would evaporate. On the other hand, if the user over-tightened the closure, the closure would be difficult to unscrew again.

A similar sealing problem also arises with containers for other liquids. If the user under-tightened the closure, the liquid might evaporate (e.g. petrol), give off odorous or harmful vapours (e.g. oil or certain hazardous chemicals), or become contaminated. Again, if the user over-tightened the closure, the closure would be difficult to unscrew.

According to one aspect of the present embodiment, there is provided a container neck and a container closure comprising a first thread on one of the neck and the closure, a complementary second thread on the other of the neck and the closure such that the closure is moveable from fully disengaged from the neck to fully closed by turning the closure relative to the neck by less than 360°, at least one stop formation carried by said one of the neck and the closure, and stop means on said other of the neck and the closure engageable with the stop formation or at least one of the stop formations to hold the closure in a closed position on the neck, the arrangement of the or each stop formation, the stop means and the threads being such that the stop means is rotated past the stop formation or at least one of the stop formations without engagement therewith when the closure is screwed on to the neck, engagement of the stop means with the stop formation or at least one of the stop formations commencing only when the closed position is neared.

Preferably, the or each formation is chamfered axially in the same sense as the first thread whereby engagement of the stop means with the stop formation or at least one of the stop formations commences only when the closed position is neared.

The axial chamfer on the or each stop formation can allow it to be designed with a height which is on average greater than that achievable with an unchamfered design of stop formation, whilst still avoiding the stop means prematurely engaging with the stop formation during screwing of the closure onto the neck. This greater height can provide a more positive closing action.

Preferably, the axial chamfer on the or each stop formation has the same or approximately the same pitch as the first thread.

Preferably, the neck has an opening and the or each stop formation is located on the neck on the side of the first thread remote from the opening.

Preferably, the or each stop formation comprises a respective pair of stop profiles defining a space therebetween for engagement by the stop means when the closure is closed on the neck. The stop profile of the or each stop formation engaged by the stop means as the closed position is neared preferably comprises a ramp portion for progressive engagement by the stop means during closure, and a projection extending above the level of the ramp portion at its end adjacent the space defined by the pair of stop profiles. The projection is advantageously an axially extending rib.

Preferably, the closure is moveable from fully disengaged from the neck to fully closed by turning the closure relative to the neck by approximately 90°.

Preferably, the first and second threads each have four thread starts.

Preferably, the stop means comprise a plurality of axially extending ribs angularly spaced from one another. More preferably, the container neck and closure comprises four ribs spaced angularly at 90°, and two stop formations spaced angularly at 180°.

The or each stop formation may be carried by the neck and may be located on the outside thereof.

Preferably, the closure has a skirt portion carrying the stop means, which skirt portion is sufficiently resilient to allow flexing and alteration of the shape of the skirt thereby creating a spring action as the stop formations and stop means on the neck and closure engage or disengage. The skirt may be cylindrical but capable of deforming temporarily to an oval section as the stop formations and stop means on the neck and closure approach full engagement, returning to a cylindrical section when such stop formations and stop means are fully engaged.

Preferably, the closure carries a sealing ring which is coaxial with the axis of rotation of the closure on the neck and is arranged to engage the inside of the neck to seal the container as the stop formations on the neck and closure engage.

In another aspect, this embodiment provides a container comprising a container neck and closure as aforesaid wherein the container has a container portion of substantially rectangular section, from which container portion the neck extends, and the closure has a planar handle portion, the threads, stop formations and stop means ensuring that the handle portion lies parallel to one of the sides of the rectangle in the closed position.

It will be appreciated, of course, that in general the container need not be of rectangular section. It may (especially if used for containing carbonated drinks) be of substantially circular section or else of any other suitable cross-section. Even if the container is of circular section, it will be understood that the present invention can still ensure consistent orientational alignment of the container and closure, which can be useful, for example, if the container and/or closure carry labels.

In a closely related aspect, the present embodiment also provides a container and closure therefor, the container having a neck and an opening in the neck to allow material to be put into and taken out of the container, the neck carrying a first thread arrangement, the closure carrying a complementary second thread arrangement, one of the neck and closure carrying stop means, the other of the neck and closure carrying at least one pair of stop profiles defining a space therebetween for engagement by the stop means to hold the closure in a closed orientation on the neck, the closure carrying a sealing ring which is coaxial with the axis of rotation of the closure on the neck and is arranged to engage the inside of the neck to seal the container as the stop means engages with the pair or at least one of the pairs of stop profiles.

By this arrangement, an effective seal between container and closure can be consistently and easily effected. The cooperation of the stop means and stop profiles to stop the closure at a set orientation on the container can ensure that the closure is neither under-tightened onto the container (in which case an effective seal would not be established), nor over-tightened (in which case the closure would be difficult to unscrew again).

Preferably, the first and second thread arrangements each have at least three thread starts.

Preferably, the pitch of the first and second thread arrangements is such that the closure is moveable from fully disengaged from the neck to fully closed by turning the closure relative to the neck by less than 360°.

In another closely related aspect, the present embodiment also provides a container and closure therefor, the container having a neck and an opening in the neck to allow material to be put into and taken out of the container, the neck carrying a first thread arrangement and the closure carrying a second complementary thread arrangement, one of the neck and closure carrying stop means, the other of the neck and closure carrying at least one pair of stop profiles defining a space therebetween for engagement by the stop means to hold the closure in a closed orientation on the neck, the pitch of the first and second thread arrangements being such that the closure is moveable from fully disengaged from the neck to fully closed by turning the closure relative to the neck by less than 360°, the first and second thread arrangements each having at least three thread starts.

The provision of at least three thread starts on the neck and closure can render the closure less prone to tilting and rocking when screwed onto the container neck than might be the case if only one or two thread starts were provided. This can afford a more positive and accurate engagement between the stop means and the pair or pairs of stop profiles.

Preferably, the closure carries a sealing ring which is coaxial with the axis of rotation of the closure on the neck and is arranged to engage the inside of the neck to seal the container as the stop means engages with the pair or at least one of the pairs of stop profiles. The provision of at least three thread starts on the neck and closure can afford a better sealing action than might be achievable with fewer thread starts due to the greater stability which they can provide.

Preferably, the sealing ring has an outer surface which engages the neck of the container more tightly the more the closure is drawn on to the neck.

Preferably, the closure is moveable from fully disengaged from the neck to fully closed by turning the closure relative to the neck by approximately 90°.

More preferably, the neck has four external threads each extending through 90°, and the closure has four internal threads.

The present embodiment also provides in another related aspect a closure for a container comprising a planar top and a cylindrical portion depending therefrom, the cylindrical portion having a thread carrying part extending from the top carrying internal threads for engagement with threads of a container and a skirt depending from the thread carrying part, the skirt being of a wall thickness thinner than the thread carrying part with locking means extending inwardly of the inner wall of the skirt, the most radially inward surface of the locking means lying further from the longitudinal axis of the closure than does the most radially outward surface of the thread carrying part of the closure.

In a further related aspect, there is provided according to the present embodiment a container comprising a container portion of a first cross sectional area and a neck of a second cross sectional area less than the first cross sectional area and a second container of less capacity than the container and capable of insertion into the container through the neck whereby the container can be used with the full container capacity or with a reduced capacity of the second container.

Referring to the detailed example in the drawings, FIGS. 38 to 41 show a molded container 1010 of moldable material, for example a polymer such as polyethylene. A variety of polymers could be used. Indeed, it will be appreciated that the container could be made of many alternative materials, such as glass (e.g. a drinks bottle) or metal (e.g. an oil can).

The container 1010 has decoratively shaped portions 1011 and 1012 and a plain central portion 1013 around which a label may be affixed; a prime use for this particular shape and design of container is for holding pharmaceuticals. Clearly, other shapes and designs of container would be appropriate for different uses. The container could be of circular section if it were employed for containing drinks; it could be a can if it were employed for containing motor car engine oil.

The container has a neck 1014 carrying four threads 1015 each extending around one quarter of the neck circumference, the neck 1014 being tubular to provide an opening for allowing material into and out of the container.

Figure 38:
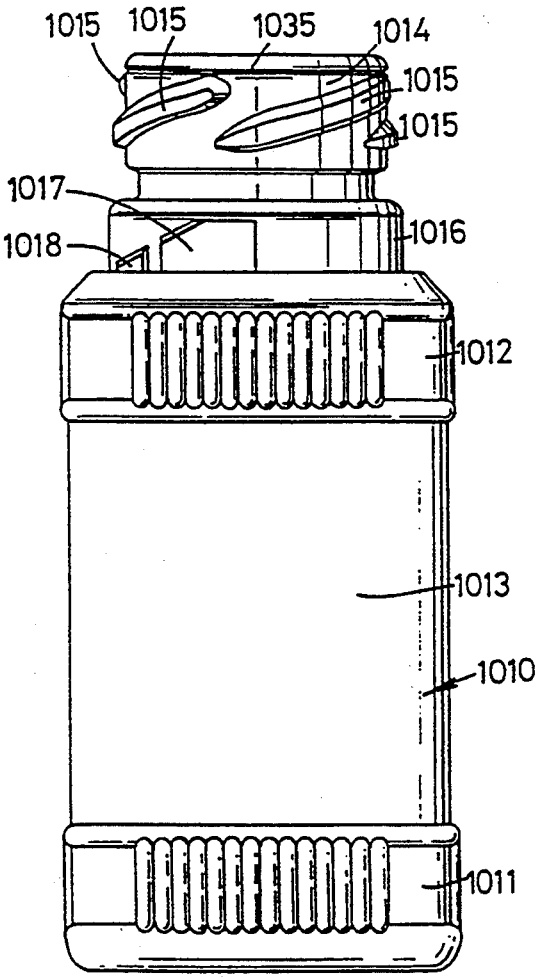
FIG. 38 is a side view of a further embodiment of a container.
Figure 39:
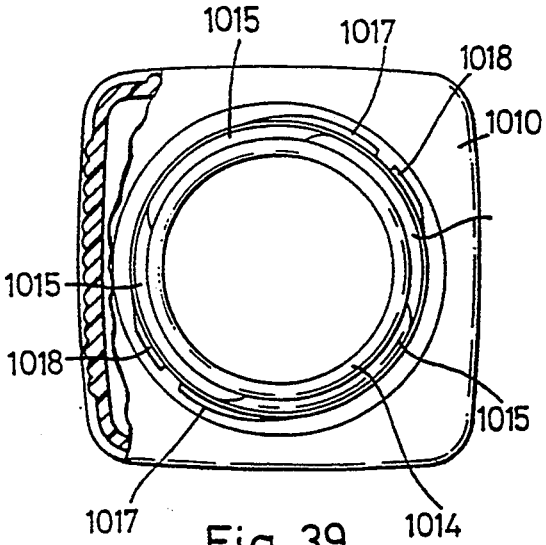
FIG. 39 is a plan view of the container of FIG. 38.
Figure 40:
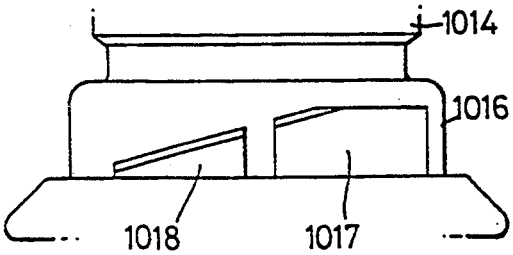
FIG. 40 is a detail of the container neck.
Figure 41:
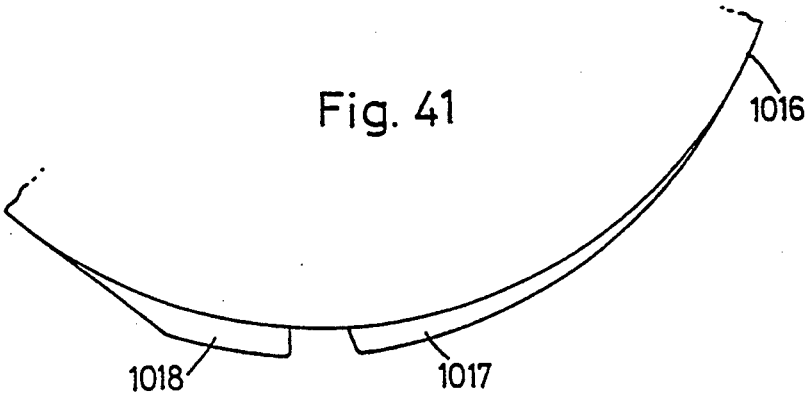
FIG. 41 is a plan view on an enlarged scale of a stop profile on the container neck.
Figure 42:
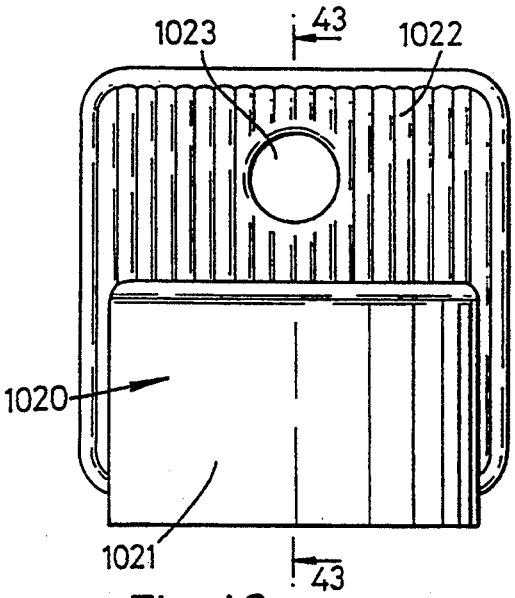
FIG. 42 is a side view of a cap for the container of FIGS. 38–41.
Figure 43:
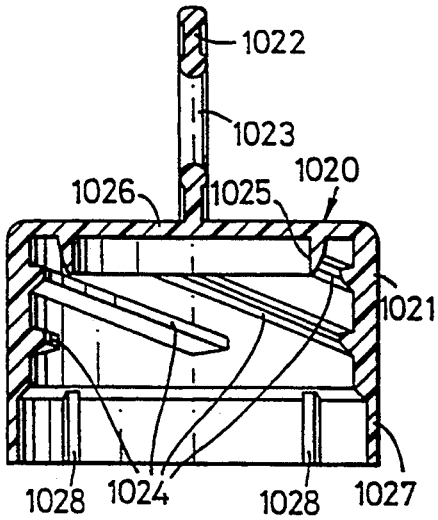
FIG. 43 is a sectional view along the lines 43—43 in FIG. 42.
Figure 44:
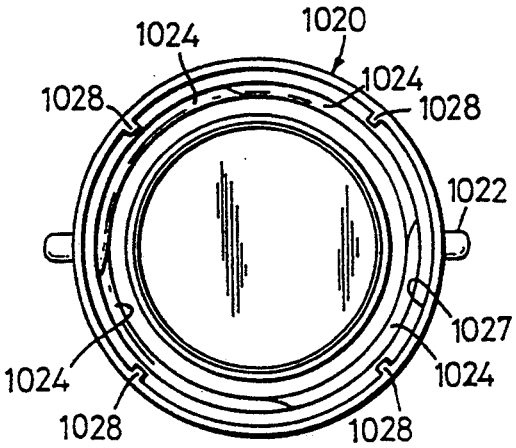
FIG. 44 is an underneath plan view of the cap of FIGS. 42 and 43.
Figure 46:
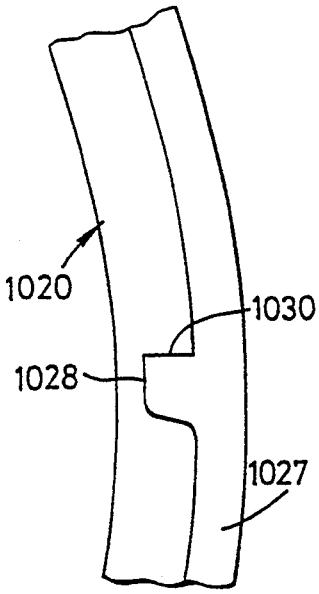
FIG. 46 shows a detail of a locking rib on the cap of FIGS. 42–45.
Figure 45:
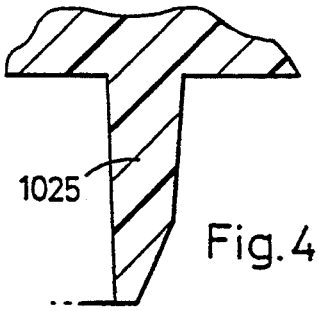
FIG. 45 is a sectional view on an enlarged scale of a sealing ring of the cap of FIGS. 42–44.

A lower portion of the neck 1014 has a shoulder portion 1016 carrying two pairs of stop profiles, each pair of stop profiles having first and second stops 1017 and 1018 respectively. As can be seen in FIGS. 38 and 40, the axial profile of the stop profiles is tapered, and, as is shown in FIG. 41 in greater detail, the first and second stops 1017 and 1018 have different profiles when viewed axially. These profiles will be explained in more detail in connection with cooperation of the container with a cap as shown in FIGS. 42 to 46.

FIGS. 42 to 46 show a molded cap 1020 of moldable material, for example a polymer such as polypropylene. The cap 1020 is conveniently injection molded. It will be appreciated that the cap could be made of alternative materials and by alternative processes.

The cap 1020 has a hollow cylindrical closure portion 1021 closed at the top for mating with the container 1010, and a handle portion 1022 for easy gripping manually. The handle portion 1022 has a hole 1023 to allow a container 1010 to be hung from a peg, and to allow insertion of a member such as a pencil to increase leverage in case of need.

The internal cylindrical surface of the closure portion 1021 has four internal threads 1024 each extending around a quarter of the circumference of the cap 1020, and matable with the threads 1015 of the container 1010. It will be appreciated that the threads need not extend around a quarter of the circumference of the cap, but could, for example, extend around a half of its circumference.

An internal sealing ring 1025 extends from planar closure wall 1026 towards the open end of the closure portion 1021. The profile of the sealing ring 25 is shown on an enlarged scale in FIG. 45, which profile is tapered and provides a grind fit seal with the rim of the container 1010 at its top opening.

The closure portion 1021 has a skirt 1027 at its lower end, the skirt 1027 being thinner than the wall of the remainder of the closure portion 1021, thus giving the skirt more flexibility and ability to deform than has the remainder of the closure portion 1021. The skirt 1027 carries four axially extending locking ribs 1028 equally spaced around the inner periphery of the skirt 1027. Two ribs 1028 cooperate with the pairs of stop profiles 1017, 1018 when the cap 1020 is engaged on the container 1010. The profile of a rib 1028 is shown on an enlarged scale in FIG. 46, the rib 1028 having a raked leading profile 1029 with respect to the direction of cap engagement, and a radial trailing profile 1030.

The action of the container and cap when putting on and taking off the cap is as follows:

The cap 1020 is first placed over the container 1010, with the closure portion 1021 over the neck 1014 of the container. The cap is then turned clockwise to engage the cap threads 1024 with the neck threads 1015. It will be appreciated that there are four possible thread engagement start positions, spaced apart by angles of 90°.

The cap 1020 is rotated through 90° relative to the container 1010 to full engagement. In the final part of the 90° movement, two opposed ribs 1028 ride up respective first stop profiles 1017, causing transformation of the cap skirt 1027 into an oval shape, and then the ribs 1028 fall into engagement between the stop profiles 1017 and 1018 of the respective pair, with the skirt springing back into a cylindrical shape. Each stop profile 1017 has a softer profile than each stop profile 1018, the latter presenting a square face to a respective rib 1028 to prevent overturning.

As the cap 1020 is drawn on to the container neck 1014, the cap sealing ring 1025 is drawn axially into the neck 1014. The fact that the engagement is multi-threaded ensures that cap movement is axial with respect to the container 1010 and that the sealing ring seats accurately onto the neck. The sealing ring 1025 provides a tapered, grind fit seal to give an air and liquid proof closure. It will be appreciated that the locking arrangement of ribs 1028 and stop profiles 1017 and 1018 ensures that an effective seal is consistently achieved whilst preventing overtightening of the cap on the neck.

To remove the cap 1020, the cap is unscrewed, initial unscrewing action causing the pair of engaged ribs 1028 to ride over the stop profiles 1017 to release the cap. It must be remembered that four ribs 1028 are provided, such that for each start position there is a pair of ribs 1028 to engage the pairs of stop profiles. Thus it is apparent that two of the ribs will remain clear of the stop formations when the closure is in its closed position. To avoid action with the two ribs 1028 which are not in operation, the axial profile of the stop profiles 1017, 1018 is chamfered, so that the non-engaging ribs pass axially clear of the stop profiles 1017 and 1018 on engagement and disengagement of the cap 1020 and container 1010. FIG. 40 shows the axially chamfered stop profiles 1017 and 1018.

It will be appreciated that the profiles of the ribs 1028 and stop profiles 1017, 1018 can be altered, as can the skirt thickness, to vary the strength of the locking arising from engagement of the ribs 1028 between the stop profiles 1017 and 1018. The stiffer the lock, the more difficult is engagement and disengagement; different strengths may be appropriate for different uses. It is also possible that the stop profiles could be formed inside the skirt 1027, and the ribs outside the shoulder 1016.

An alternative embodiment of stop profile 1017 is shown in FIGS. 48 and 49. The stop profile 1017 comprises a ramp portion 1100 terminating in a rib 1102 which extends axially across the width of the stop profile 1017. The rib 1102 serves to warn the user that the cap has been turned nearly to its fully closed position by requiring a discrete increase in torque for full closure to be effected. It also affords a more positive closing and opening action than can be obtained with a smooth tapered profile.

While a four start, quarter turn engagement has been described, other multi-start engagements may be used, utilising the same principle.

The skirt 1027 is approximately one third of the thickness of the main body of the cap 1020. This has an important implication in injection molding the cap 1020, in that, when the cap is to be ejected from the mold, the female part of the mold can be unscrewed from the cap 1020 without impinging on the four ribs 1028, the inner surfaces of which lie on a circle of diameter greater than the internal diameter of the cap 1020 in the region of the threads 1024.

A liner (not shown) may be inserted into the container, after molding, through the neck 1014. The liner would be cylindrical, to seal against the neck, and have a base to provide a container of volume less than the container 1010. In this way, the container 1010 can be used to contain different volumes, and the sleeve volume can be different, for example by making the sleeve in different lengths.

The container 1010 has a drip fee lip provided by an annular recess 1035 at the opening of the neck 1014.

With four thread starts and a quarter turn to engage the cap 1020 on the container 1010, the handle portion will remain parallel to two essentially flat faces of the container 1010 (see FIG. 47).

This embodiment of an invention provides a container which is both easy to open, and which has a sufficiently strong lock for the closure on the neck to prevent difficulties (such as opening or spillage) during transport of the container, and to offer some resistance to children opening the container.

FIG. 50

Figure 50:
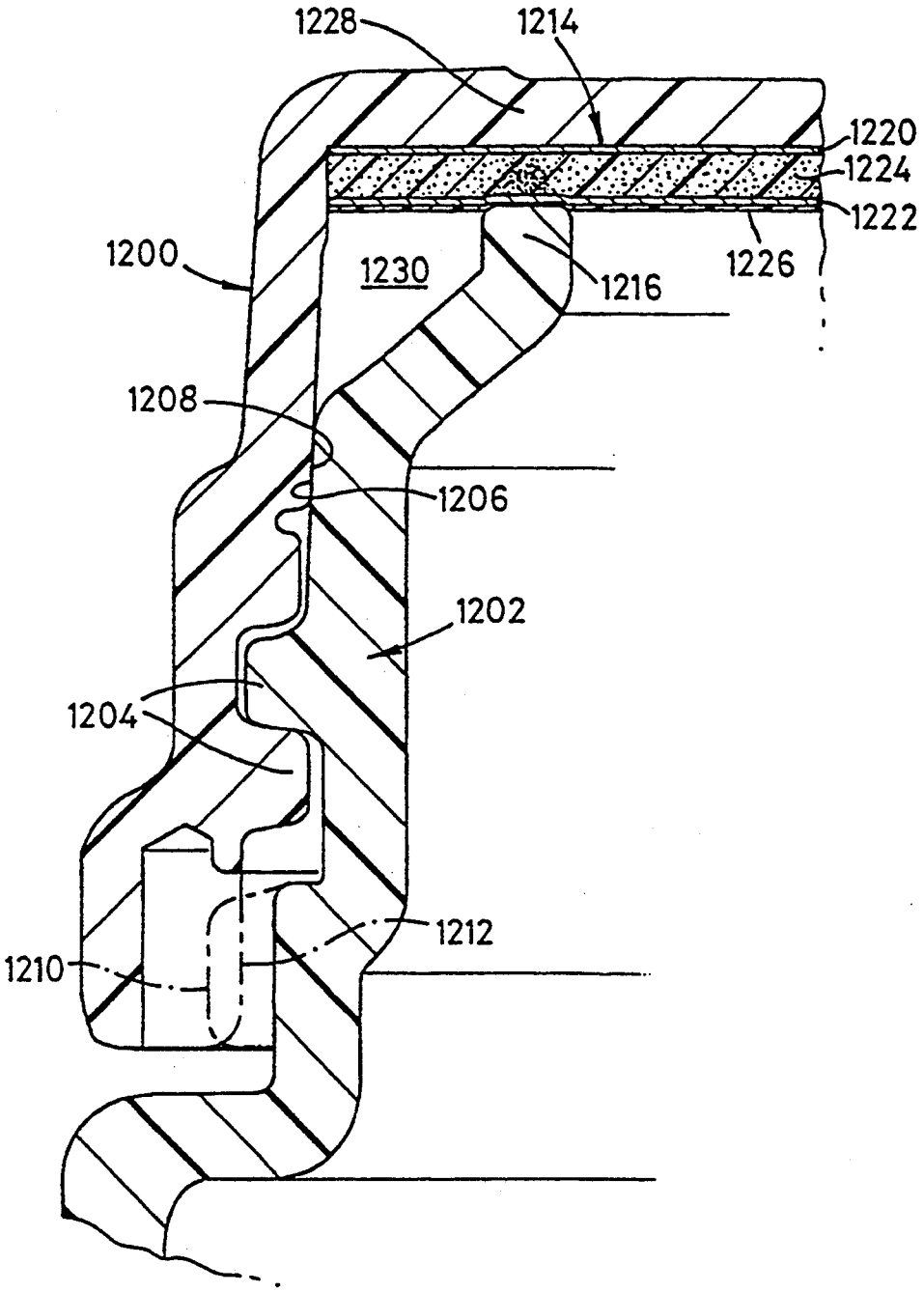
FIG. 50 is a sectional view showing a sealing web which is reusable in the closure.

The embodiment in FIG. 50 relates to a modification which is especially advantageous in combination with the embodiments illustrated in FIGS. 2–4, 16–23, and 33–37, but is also of use with other container closure designs.

In a first aspect this embodiment provides a container closure assembly wherein the rim of the container neck has a semi-rigid or relatively rigid sealing web bonded thereto, the web being removable in one piece to gain access to the container contents, and the container closure having an internal region into which the web can be fitted and retained by the closure after the web has been removed from the container rim, the web thereafter acting as a sealing member or pad retained in the closure to fit against the rim when the closure is replaced on the neck.

With this arrangement, the sealing web is reusable once the web has been peeled off the container neck. The web is inserted manually into the closure where it becomes retained and used as a seal in the closure.

This is particularly advantageous when used in combination with the sealing surfaces on the neck and closure which form a seal outside and below the rim of the neck. The reusable seal in the closure prevents the container contents from possibly collecting in the closure outside the rim of the neck if, for example, the container is dropped accidentally or is tipped over. Particularly if the container contents are grannular or liquid (or some other flowable product), some of the contents might otherwise be able to collect outside the rim of the neck, and might conceal there or else spill out when the closure is removed.

Preferably, the sealing web is semi-rigid or relatively rigid in a radial direction so that it can be lifted off or "flipped" off the rim to remove the web initally. Preferably, the sealing web is compressible in an axial direction so that it will provide good compressible sealing properties when it is reused in the closure.

The sealing web when fitted back into the closure may be retained either by clips or projections, or merely by being a relatively tight "friction" fit inside the closure. The closure does not, however, retain the closure with a greater strength than the inital sealing bond between the web and the rim of the container neck. The arrangement is designed such that when the closure is removed for the first time, the sealing web remains integrally bonded to the rim as a tamper proof peel-off seal. In later use, when the sealing web is refitted into the closure to serve as a sealing member or pad, the sealing web is retained in the closure, for example by a friction fit, to prevent it from falling out each time that the closure is unscrewed.

In a second aspect, this embodiment provides a sealing web suitable for re-use as described above, the web being relatively rigid or semi-rigid in a planar direction so that the web will retain substantially its planar web shape when in use, the web being resiliently compressible in a direction perpendicular to the plane of the web (ie. compressible in the axial direction of the container neck).

Preferably, the web comprises a laminate of at least one relatively rigid or semi-rigid layer and at least one compressible layer. More preferably, the web comprises upper and lower layers made of semi-rigid or relatively rigid material, these layers being separated by a layer of compressible material.

Preferably, at least one of the layers comprises metal or metalised material so that the web can be bonded to the rim of the container neck by induction welding. The under surface of the web may be coated with a coloured film to leave a tamper-proof indication on the rim of the container neck.

In detail FIG. 50 shows a partial section through a container closure assembly comprising a closure 1200 fitted to a container neck 1202. The closure assembly is similar to the arrangements shown in FIGS. 4, 16–23 and 33–34 described above. In particular, the closure is secured by square section threads 1204, and the container neck and the closure carry complementary sealing surfaces 1206 and 1208, respectively. The sealing surfaces are tapered at an angle of about 4° or 5° so that when the closure is screwed down, a reliable automatic seal is formed. Ramp shaped stop formations 1210 and 1212 (similar to the formations 722 and 728 of FIGS. 25–29) are formed on the container neck 1202 and the closure 1212, respectively.

A sealing web in the form of a disc 1214 is bonded to the rim 1216 of the neck as a tamper-proof seal which has to be removed by a user to gain access to the container contents. The disc is formed as a laminate of upper and lower disc layers 1220, 1222, respectively, of a rigid or semi-rigid material, separated by a layer 1224 of resiliently compressible material. This structure gives the disc rigidity, or semi-rigidity, against bending in a radial direction (ie. in the plane of the web), but also compressibility in the axial direction.

The under surface of the layer 1222 is coated with a thin coloured film 1226 (similar to the film 220 in FIG. 4) to provide a tamper-proof indication on the rim once the sealing web has been removed.

The lower layer 1222 preferably includes metal, or metalised material, so that the web disc can be bonded to the rim 1216 of the container neck using induction welding. The diameter of the disc 1214 is such that it forms a fairly tight friction fit inside the closure adjacent the top wall 1228 of the closure. As seen in FIG. 50, when the closure is in its fully screwed-down position, the disc 1214 is compressed between the rim 1216 of the neck and the top wall of 1228 of the closure.

The assembly is designed so that the friction fit of the disc 1214 in the closure 1200 is considerably less strong than the induction welded bond between the disc 1214 and the rim 1216 of the neck. Therefore, when a person removes the closure for the first time, the disc will remain intact, integrally bonded to the rim 1216. The radially projecting edge of the disc can be used as a lift-off tab to enable a person to peel off the disc (in the case of a semi-rigid disc) or "flip-off" the disc (in the case of a rigid disc), in a similar fashion to the removal of the disc in FIG. 4.

Once removed from the rim, the disc 1214 can be re-used as a sealing member or pad for the closure, by re-inserting the disc 1214 into the closure so that it lies adjacent the top wall 1228. The rigid/semi-rigid property of the disc 1214 ensures that the disc will not have been distorted substantially during the peel-off or flip-off removal, and the disc 1214 will therefore be able to be retained against the top-wall 1228 by the friction fit to prevent the disc from falling out.

When the closure 1200 is replaced on the container neck 1202 and is screwed down, the disc 1214 will form a pad which is pressed down against the surface of the rim 1216. The sealing surfaces 1206 and 1208 form a main air-tight and/or liquid-tight seal for the container, but the presence of the disc 1214 prevents the container contents from being able to spill over the rim 1216 and into the space 1230 between the rim 1216 and the wall of the closure 1200. Without the disc 1214, some of the container contents might otherwise be able to collect in the space 1230 if, for example, if the container were to be dropped accidentaly or tipped over, and this might cause some spillage on the next occasion that the closure was removed.

The compressibility of the disc 1214 can ensure that the disc 1214 when acting as a sealing member or pad in the closure makes firm contact against the rim 1216, thereby achieving a good seal which can prevent even liquid contents from being able to escape into the space 1230 outise the rim 1216.

It will be appreciated that the present invention in various aspects has been described above merely by way of example, and that modifications may be made within the spirit and scope of the invention. The descriptions of the embodiments are not to be taken as limiting the possible combinations of features of the invention, all such possible combinations being envisaged in this application.

Although various features of the invention may be used independently, particular advantages may be achieved by combining two or more of the features.

We claim:

1. A container closure assembly comprising:

a container neck;

a closure for said container neck;

a screw thread on at least one of said closure and said container neck for retaining said closure on said container neck;

a sealing mechanism forming a seal between said closure and said container neck when said closure is at a sealing position on said container neck; and an urging mechanism co-operating between said closure and said container neck when said closure is near said sealing position to apply a closing torque to said closure independently of whether an external closing torque is being applied to said closure, and thereafter maintaining a closing torque on said closure when said closure is in said sealing position on said container neck until a sufficient external release force is applied to said closure.

2. The container closure assembly of claim 1, wherein said urging mechanism comprises a first element on said container neck that cooperates with a second element on said closure, at least one of said first and second elements comprising a ramp surface against which the other of said first and second elements bears when said closure is near said sealing position, said ramp surface extending in a direction to urge said closure in a direction towards said sealing position.

3. The container closure assembly of claim 2, wherein said first element comprises a respective urging ramp surface, and said second element comprises a respective urging ramp surface, said ramp surfaces extending in a direction to urge said closure towards its sealing position.

4. The container closure assembly of claim 3, wherein said first and second elements each further comprise respective lead-in ramp surfaces which bear against each other, in use, to ease said projections over each other when the closure is being screwed towards said sealing position, before said urging ramp surfaces of said first and second elements begin to bear against each other.

5. The container closure assembly of claim 4, wherein at least one of said first and second elements further comprises a projecting ridge formation between said respective lead-in ramp surface and urging ramp surface.

6. The container closure assembly according to claim 3, wherein said first and second elements are constructed and arranged such that the urging ramp surface of said first element bears resiliently against said urging ramp surface of said second element when said closure is at said closed position thereby to generate a force to urge said closure more tightly into said closed position.

7. The container closure assembly of claim 2, wherein said first element comprises at least one outwardly facing projection on said container neck, and said second element comprises at least one inwardly facing projection on said closure.

8. The container closure assembly of claim 7, wherein said at least one projection of said first element is mounted on a resilient portion of said closure, which resilient portion is capable of deforming to enable said at least one projection of said second element to ride over said at least one projection of said first element when said closure is screwed near said sealing position.

9. The container closure assembly according to claim 7, wherein said at least one projection of said first element comprises at least one isolated projection.

10. The container closure assembly according to claim 9, wherein there are a plurality of projections of the first element spaced remotely from each other.

11. The container closure assembly according to claim 7, wherein said at least one projection of said second element comprises at least one isolated projection.

12. The container closure assembly according to claim 11, wherein there are a plurality of projections of said second element spaced remotely from each other.

13. The container closure assembly of claim 1, wherein said sealing position corresponds to a closed position of said closure on said container neck.

14. The container closure assembly according to claim 1, further comprising a generally planar handle surface of said closure.

15. The container closure assembly according to claim 14, wherein said handle surface comprise an upstanding handle portion.

16. The container closure assembly according to claim 15, further comprising a generally planar surface extending on opposite sides of said upstanding handle portion, said generally planar surface forming an upper wall of said closure.

17. The container closure assembly according to claim 1, wherein said closure comprises a child-resistant closure.

18. A container closure assembly comprising:

a container neck;

a closure for said container neck;

a screw thread on at least one of said closure and said container neck for retaining said closure on said container neck;

a sealing mechanism that forms a seal between said closure and said container neck when said closure is at a sealing position on said container neck, which sealing position is within a predetermined tolerance range of possible sealing positions;

an urging mechanism that cooperates between said closure and said container neck when said closure is positioned anywhere within said tolerance range of possible sealing positions, and applying a closing torque to said closure independently of whether an external closing torque is being applied to said closure, and thereafter maintaining a closing torque on said closure when said closure is in said sealing position on said container neck until a sufficient external release torque is applied to said closure.

19. The container closure assembly of claim 18, wherein said urging mechanism applies a closing force to said closure when said closure is at a position near but just outside said tolerance range of possible sealing positions.

20. The container closure of claim 18, wherein said closure can be moved between its sealing position and a fully open position by relative rotation through up to about 180°.

* * * * *

UNITED STATES PATENT AND TRADEMARK OFFICE

CERTIFICATE OF CORRECTION

PATENT NO. : 5,411,157
DATED : May 2, 1995
INVENTOR(S) : Roger M. King et al.

It is certified that error appears in the above-indentified patent and that said Letters Patent is hereby corrected as shown below:

On the Title Page

In column 2, line 4 under "OTHER PUBLICATIONS", delete "filed".

Column 64,

In claim 15, line 2, delete "comprise" and substitute --comprises--.

Signed and Sealed this

Seventh Day of November, 1995

*Attest:*

*Attesting Officer*

BRUCE LEHMAN

*Commissioner of Patents and Trademarks*